US008404416B2

(12) United States Patent
Haruyama et al.

(10) Patent No.: US 8,404,416 B2
(45) Date of Patent: Mar. 26, 2013

(54) ELECTROPHOTOGRAPHIC PHOTORECEPTOR, PROCESS CARTRIDGE, AND IMAGE FORMING APPARATUS

(75) Inventors: Daisuke Haruyama, Kanagawa (JP); Masahiro Iwasaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 344 days.

(21) Appl. No.: 12/627,723

(22) Filed: Nov. 30, 2009

(65) Prior Publication Data

US 2010/0330473 A1 Dec. 30, 2010

(30) Foreign Application Priority Data

Jun. 26, 2009 (JP) ..... 2009-152857

(51) Int. Cl.
*G03G 5/14* (2006.01)
*G03G 21/16* (2006.01)
*G03G 21/18* (2006.01)
*G03G 15/06* (2006.01)

(52) U.S. Cl. ..... 430/66; 399/111; 399/115; 399/121

(58) Field of Classification Search ..... 430/66; 399/111, 115, 121
See application file for complete search history.

(56) References Cited

U.S. PATENT DOCUMENTS 4,818,650 A 4/1989 Limburg et al.
4,956,440 A 9/1990 Limburg et al.
5,283,145 A 2/1994 Nukada et al.
5,290,928 A 3/1994 Nukada et al.
5,298,617 A 3/1994 Nukada et al.
5,302,479 A 4/1994 Daimon et al.
5,308,728 A 5/1994 Imai et al.
5,338,636 A 8/1994 Nukada et al.
5,358,813 A 10/1994 Iijima et al.
5,378,569 A 1/1995 Nukada et al.
5,393,629 A 2/1995 Nukada et al.
(Continued)

FOREIGN PATENT DOCUMENTS

CN 101196697 A 6/2008
EP 0 377 998 A2 7/1990
(Continued)

OTHER PUBLICATIONS

English Translation of JP 2006276103 A (Oct. 2006).*
(Continued)

*Primary Examiner* — Jonathan Jelsma
(74) *Attorney, Agent, or Firm* — Oliff & Berridge, PLC

(57) ABSTRACT

The invention provides an electrophotographic photoreceptor having a surface protection layer that satisfies the following requirements: (1) including a crosslinked substance of at least one selected from a guanamine compound or a melamine compound, and at least one charge transporting material having at least one substituent selected from —OH, —$OCH_3$, —$NH_2$, —SH or —COOH; (2) including the at least one of a guanamine compound or a melamine compound in an amount of from about 0.1 to about 5% by weight; and (3) having a universal hardness of from about 180 to about 220 N/$mm^2$ and a creep ratio of from about 5% to about 8%, the universal hardness and the creep ratio being obtained by performing a hardness test by pushing a Vickers quadrangular pyramid diamond indenter against the surface protection layer at a maximum load of 20 mN, in an environment of 25° C. and a relative humidity of 50%.

15 Claims, 5 Drawing Sheets

U.S. PATENT DOCUMENTS

| | | | | |
|---|---|---|---|---|
| 5,416,207 | A | 5/1995 | Imai et al. | |
| 5,456,989 | A | 10/1995 | Nogami et al. | |
| 5,459,004 | A | 10/1995 | Daimon et al. | |
| 5,463,043 | A | 10/1995 | Nukada et al. | |
| 5,639,581 | A | 6/1997 | Iwasaki et al. | |
| 5,654,119 | A | 8/1997 | Ishii et al. | |
| 5,734,003 | A | 3/1998 | Iwasaki et al. | |
| 6,180,303 | B1 | 1/2001 | Uematsu et al. | |
| 6,489,069 | B1 | 12/2002 | Itami et al. | |
| 6,555,279 | B2 | 4/2003 | Nakata et al. | |
| 6,829,454 | B2 * | 12/2004 | Miyakawa et al. | 399/159 |
| 7,302,210 | B2 * | 11/2007 | Fukushima et al. | 399/159 |
| 7,384,717 | B2 | 6/2008 | Dinh et al. | |
| 2001/0031412 | A1 | 10/2001 | Itami et al. | |
| 2002/0106570 | A1 | 8/2002 | Kami et al. | |
| 2002/0119382 | A1 | 8/2002 | Nakata et al. | |
| 2003/0129512 | A1 | 7/2003 | Sugino et al. | |
| 2003/0194625 | A1 | 10/2003 | Tanaka et al. | |
| 2004/0063014 | A1 | 4/2004 | Yoshimura et al. | |
| 2005/0026058 | A1 | 2/2005 | Kami et al. | |
| 2005/0181291 | A1 | 8/2005 | Kami et al. | |
| 2006/0093931 | A1 | 5/2006 | Itami | |
| 2006/0199092 | A1 | 9/2006 | Sugino et al. | |
| 2007/0065741 | A1 | 3/2007 | Iemura et al. | |
| 2007/0077506 | A1 * | 4/2007 | Kihara et al. | 430/58.35 |
| 2007/0148570 | A1 | 6/2007 | Iwasaki et al. | |
| 2008/0026308 | A1 | 1/2008 | Qi et al. | |
| 2008/0089712 | A1 | 4/2008 | Nukada et al. | |
| 2008/0107980 | A1 | 5/2008 | De Jong et al. | |
| 2009/0004583 | A1 | 1/2009 | Nukada et al. | |
| 2009/0067874 | A1 * | 3/2009 | Hoshio | 399/100 |
| 2009/0117476 | A1 | 5/2009 | Heuft et al. | |
| 2009/0238602 | A1 | 9/2009 | Iwasaki et al. | |
| 2010/0167193 | A1 | 7/2010 | Nukada et al. | |

FOREIGN PATENT DOCUMENTS

| | | | |
|---|---|---|---|
| EP | 0 710 893 | A1 | 5/1996 |
| EP | 1 211 565 | A1 | 6/2002 |
| EP | 1 600 822 | A2 | 11/2005 |
| EP | 1 808 732 | A1 | 7/2007 |
| EP | 2 202 582 | A1 | 6/2010 |
| EP | 2 233 979 | A1 | 9/2010 |
| JP | A-56-051749 | | 5/1981 |
| JP | A-60-247647 | | 12/1985 |
| JP | A-62-251757 | | 11/1987 |
| JP | A-64-1728 | | 1/1989 |
| JP | A-02-255856 | | 10/1990 |
| JP | A-04-189873 | | 7/1992 |
| JP | A-4-281461 | | 10/1992 |
| JP | A-5-43823 | | 2/1993 |
| JP | A-05-098181 | | 4/1993 |
| JP | A-05-099737 | | 4/1993 |
| JP | A-05-140472 | | 6/1993 |
| JP | A-05-140473 | | 6/1993 |
| JP | A-05-263007 | | 10/1993 |
| JP | A-05-279591 | | 10/1993 |
| JP | A-7-146564 | | 6/1995 |
| JP | A-08-176293 | | 7/1996 |
| JP | A-08-208820 | | 8/1996 |
| JP | A-08-278645 | | 10/1996 |
| JP | A-2000-019749 | | 1/2000 |
| JP | A-2000-066424 | | 3/2000 |
| JP | A-2000-292959 | | 10/2000 |
| JP | A-2001-201876 | | 7/2001 |
| JP | A-2001-255685 | | 9/2001 |
| JP | A-2002-006524 | | 1/2002 |
| JP | A-2002-082469 | | 3/2002 |
| JP | B2-3287678 | | 3/2002 |
| JP | A-2003-084474 | | 3/2003 |
| JP | A-2003-186222 | | 7/2003 |
| JP | A-2003-186234 | | 7/2003 |
| JP | A-2004-004454 | | 1/2004 |
| JP | A-2005-062830 | | 3/2005 |
| JP | A-2005-107401 | | 4/2005 |
| JP | A-2005-195961 | | 7/2005 |
| JP | A-2005-234081 | | 9/2005 |
| JP | A-2005-234140 | | 9/2005 |
| JP | A-2005-234546 | | 9/2005 |
| JP | A-2006-084711 | | 3/2006 |
| JP | 2006276103 | A * | 10/2006 |
| JP | A-2006-267652 | | 10/2006 |
| JP | A-2007-086209 | | 4/2007 |
| JP | A-2007-155874 | | 6/2007 |
| JP | A-2007-188051 | | 7/2007 |

OTHER PUBLICATIONS

European Search Report in European Patent Application No. 10155500.1; dated Oct. 26, 2010.

Jikken Kagaku Kohza (Experimental Chemical Lecture), 4th Edition, vol. 28, pp. 430-431 (w/ translation).

Jul. 6, 2010 Office Action issued in Japanese Patent Application No. 2008-071840 (with Translation).

Apr. 24, 2012 Office Action issued in Chinese Patent Application No. 200910253353.1 (with translation).

Oct. 7, 2011 Search Report issued in European Patent Application No. 10156225.4.

Apr. 13, 2010 Office Action issued in Japanese Patent Application No. 2007-328748 (with translation).

Dec. 3, 2012 Office Action issued in U.S. Appl. No. 12/049,718.

Jun. 12, 2012 Office Action issued in U.S. Appl. No. 12/049,718.

Jan. 13, 2012 Office Action issued in U.S. Appl. No. 12/049,718.

Sep. 12, 2011 Office Action issued in U.S. Appl. No. 12/049,718.

Apr. 26, 2011 Office Action issued in U.S. Appl. No. 12/049,718.

Dec. 10, 2010 Office Action issued in U.S. Appl. No. 12/049,718.

Mar. 9, 2012 Office Action issued in U.S. Appl. No. 12/247,794.

Aug. 30, 2011 Office Action issued in U.S. Appl. No. 12/247,794.

Mar. 29, 2011 Office Action issued in U.S. Appl. No. 12/247,794.

Dec. 3, 2012 Office Action issued in U.S. Appl. No. 12/623,916.

Jun. 21, 2012 Office Action issued in U.S. Appl. No. 12/623,916.

U.S. Appl. No. 12/623,916 in the name of Nakamura et al. filed Nov. 23, 2009.

U.S. Appl. No. 12/247,794 in the name of Iwasaki et al. filed Oct. 8, 2008.

U.S. Appl. No. 12/049,718 filed Mar. 17, 2008 in the name of Nukada et al.

* cited by examiner

ELECTROPHOTOGRAPHIC PHOTORECEPTOR, PROCESS CARTRIDGE, AND IMAGE FORMING APPARATUS

CROSS-REFERENCE TO RELATED APPLICATION

This application is based on and claims priority under 35 USC 119 from Japanese Patent Application No. 2009-152857 filed Jun. 26, 2009.

BACKGROUND

1. Technical Field

The present invention relates to an electrophotographic photoreceptor, a process cartridge, and an image forming apparatus.

2. Related Art

A so-called xerographic image forming apparatus is an image forming apparatus including a charging unit, a light exposure unit, a development unit, a transfer unit and a fixing unit, and the speed and the lifespan thereof have been recently improved by virtue of technical developments in the members or the system of the apparatus. With these developments, demands for each sub-system to adapt to high-speed or to improve reliability thereof have been increased more than ever before. In particular, an electrophotographic photoreceptor that is used to print images undergoes a significant degree of electric and mechanical external force through a charging unit, a development unit, a transfer unit, a cleaning unit, or the like. Therefore, image defects tend to occur due to due to scratch, wear, chipping or the like of the electrophotographic photoreceptor. For this reason, demands for high-speed adaptability and high reliability are even higher.

SUMMARY

According to an aspect of the invention, the present provides an electrophotographic photoreceptor comprising, over an electroconductive substrate, a photosensitive layer and a surface protection layer in this order, the surface protection layer satisfying each of the following requirements (1) to (3):

(1) comprising a crosslinked substance of at least one selected from a compound having a guanamine structure or a compound having a melamine structure, and at least one charge transporting material having at least one substituent selected from —OH, —$OCH_3$, —$NH_2$, —SH or —COOH;

(2) comprising the at least one selected from a compound having a guanamine structure or a compound having a melamine structure in an amount of from about 0.1% by weight to about 5% by weight; and (3) having a universal hardness of from about 180 N/mm$^2$ to about 220 N/mm$^2$ and a creep ratio of from about 5% to about 8%, the universal hardness and the creep ratio being obtained by performing a hardness test by pushing a Vickers quadrangular pyramid diamond indenter against the surface protection layer at a maximum load of 20 mN, in an environment of 25° C. and a relative humidity of 50%.

BRIEF DESCRIPTION OF THE DRAWINGS

Exemplary embodiments of the present invention will be described in detail based on the following figures, wherein.

DETAILED DESCRIPTION OF THE INVENTION

<<Electrophotographic Photoreceptor>>

Figure 1:
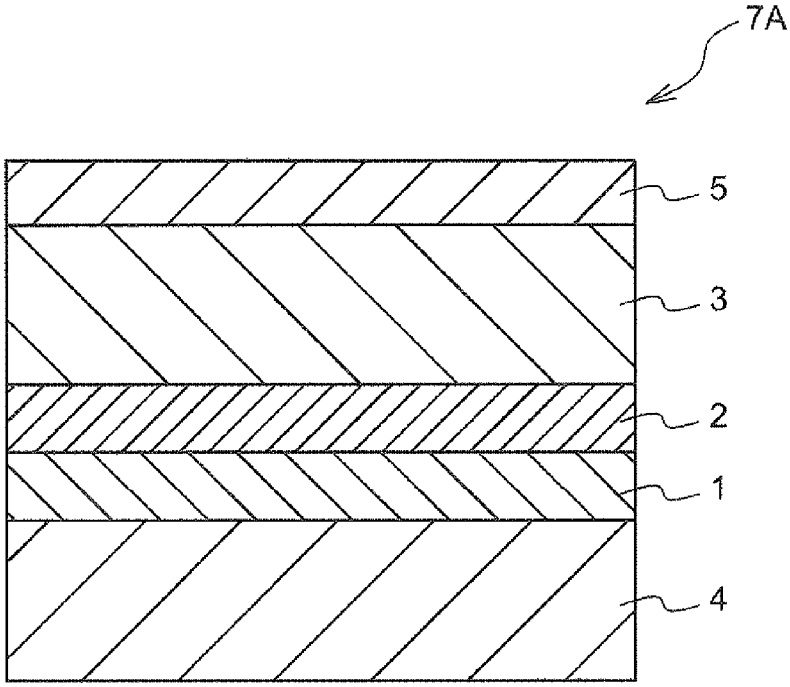
FIG. 1 is a schematic partial sectional view of an exemplary electrophotographic photoreceptor according to an exemplary embodiment of the invention.

The electrophotographic photoreceptor according to an exemplary embodiment of the present invention includes, over an electroconductive substrate, a photosensitive layer and a surface protection layer in this order, the surface protection layer satisfying each of the following requirements (1) to (3):

(1) comprising a crosslinked substance of at least one selected from a compound having a guanamine structure or a compound having a melamine structure, and at least one charge transporting material having at least one substituent selected from —OH, —$OCH_3$, —$NH_2$, —SH or —COOH;

(2) comprising the at least one selected from a compound having a guanamine structure or a compound having a melamine structure in an amount of from 0.1% by weight or about 0.1% by weight to 5% by weight or about 5% by weight; and (3) having a universal hardness of from 180 N/mm$^2$ or about 180 N/mm$^2$ to 220 N/mm$^2$ or about 220 N/mm$^2$, and a creep ratio of from 5% or about 5% to 8% about 8%, the universal hardness and the creep ratio being obtained by performing a hardness test by pushing a Vickers quadrangular pyramid diamond indenter against the surface protection layer at a maximum load of 20 mN, in an environment of 25° C. and a relative humidity of 50%.

In the following, the electrophotographic photoreceptor according to the present exemplary embodiment will be described in detail with reference to the drawings. In the drawings, the same or corresponding members or portions are attached with the same reference numbers, and overlapping descriptions thereof are omitted.

Figure 2:
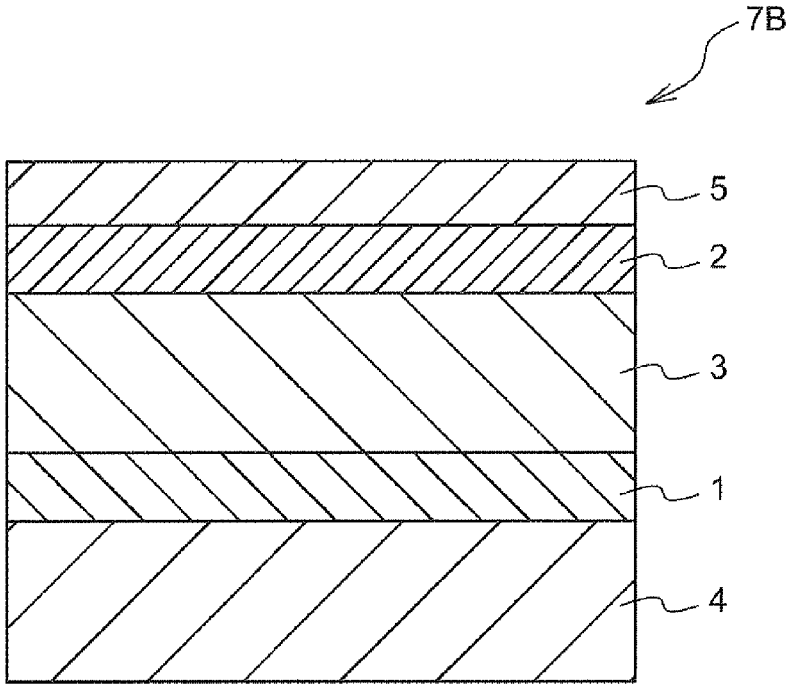
FIG. 2 is a schematic partial sectional view of another exemplary electrophotographic photoreceptor according to an exemplary embodiment of the invention.
Figure 3:
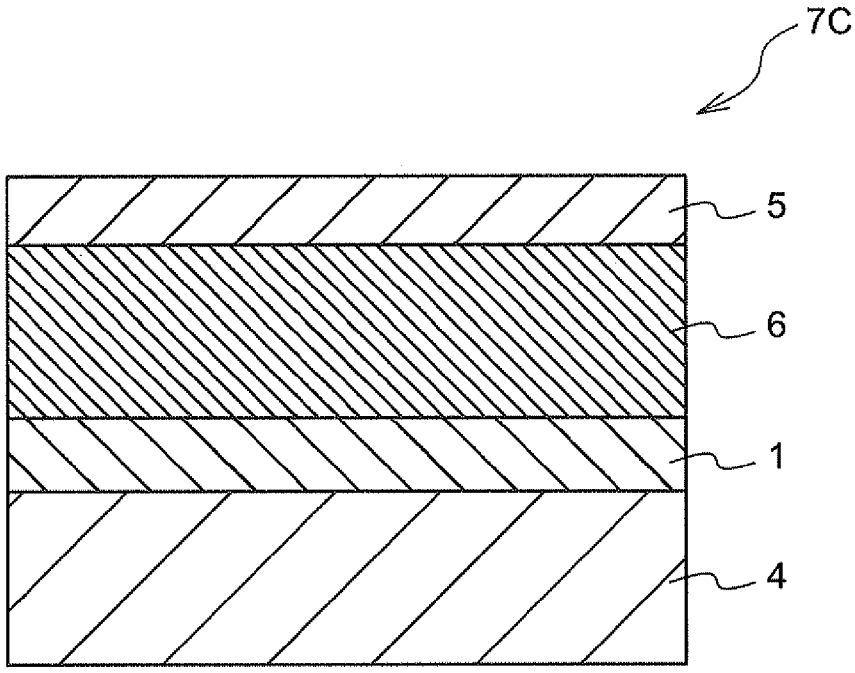
FIG. 3 is a schematic partial sectional view of still another exemplary electrophotographic photoreceptor according to an exemplary embodiment of the invention.

FIG. 1 is a schematic partial sectional view of a preferred example of the electrophotographic photoreceptor according to the exemplary embodiment. FIGS. 2 and 3 are each a schematic partially sectional view of another example of the electrophotographic photoreceptor according to the exemplary embodiment.

An electrophotographic photoreceptor 7A illustrated in FIG. 1 is a so-called function separated-type photoreceptor, and includes, on an electroconductive substrate 4, an undercoating layer 1, a photosensitive layer formed of a charge generating layer 2 and a charge transporting layer 3 in this order, and a surface protection layer 5 formed on the photosensitive layer.

In a similar manner to the electrophotographic photoreceptor 7A illustrated in FIG. 1, an electrophotographic photoreceptor 7B illustrated in FIG. 2 is a function separated-type electrophotographic photoreceptor wherein a charge generating layer 2 and a charge transporting layer 3 separately have different functions, and includes, on an electroconductive substrate 4, an undercoating layer 1, a photosensitive layer formed of a charge transporting layer 3 and a charge generating layer 2 in this order, and a surface protection layer 5 formed on the photosensitive layer.

On the other hand, an electrophotographic photoreceptor 7C illustrated in FIG. 3 has a single layer (charge generating/transporting layer 6) that contains both a charge generating material and a charge transporting material, and includes, on an electroconductive substrate 4, an undercoating layer 1, charge generating/transporting layer 6, and a surface protection layer 5 in this order. Namely, electrophotographic photoreceptor 7C has a photosensitive layer having a monolayer structure (charge generating/transporting layer 6).

In each of the electrophotographic photoreceptors illustrated in FIGS. 1 to 3, the undercoating layer 1 may be included, or may not.

In the following, each component of electrophotographic photoreceptor 7A illustrated in FIG. 1 as a representative structure will be described.

<Surface Protection Layer>

The surface protection layer 5 is an outermost layer of the electrophotographic photoreceptor 7A, and is provided in order to protect the photosensitive layer including the charge generating layer 2 and the charge transporting layer 3. By providing the surface protection layer 6, resistance against abrasion, scratches or the like may be imparted to the surface of the photoreceptor, and also the efficiency of transfer of toner may be improved.

In particular, in the exemplary embodiment, the surface protection layer 5 satisfies each of the following requirements (1) to (3):

(1) comprising a crosslinked substance of at least one selected from a compound having a guanamine structure or a compound having a melamine structure, and at least one charge transporting material having at least one substituent selected from —OH, —$OCH_3$, —$NH_2$, —SH or —COOH;

(2) comprising the at least one selected from a compound having a guanamine structure or a compound having a melamine structure in an amount of from about 0.1% by weight to about 5% by weight; and (3) having a universal hardness of from about 180 N/$mm^2$ to about 220 N/$mm^2$ and a creep ratio of from about 5% to about 8%, the universal hardness and the creep ratio being obtained by performing a hardness test by pushing a Vickers quadrangular pyramid diamond indenter against the surface protection layer at a maximum load of 20 mN, in an environment of 25° C. and a relative humidity of 50%.

In the following, the requirements (1) to (3) will be described.

The surface protection layer 5 includes (1) a crosslinked substance of at least one selected from a guanamine compound or a melamine compound, and at least one specific charge transporting material.

Further, surface protection layer 5 includes (2) the at least one selected from a guanamine compound or a melamine compound in an amount of 0.1% by weight to 5% by weight.

When the surface protection layer 5 satisfies the above requirements (1) and (2), the mechanical strength and the electrical stability of the electrophotographic photoreceptor may be further improved. As a result, higher reliability and longer lifespan of an image forming apparatus may be achieved by employing the electrophotographic photoreceptor according to the exemplary embodiment.

<Guanamine Compound>

The guanamine compound is a compound having a guanamine skeleton (structure), and examples thereof include acetoguanamine, benzoguanamine, formguanamine, steroguanamine, spiroguanamine, and cyclohexylguanamine.

The guanamine compound is preferably at least one of the compound represented by the following formula (A) or a multimer thereof. The multimer is an oligomer obtained by polymerizing a compound represented by the formula (A) as a structural unit, and the polymerization degree thereof is, for example, from 2 to 200 (preferably from 2 to 100). The compound represented by formula (A) may be used alone or in combination of two or more types. In particular, when two or more types of the compound represented by formula (A) are used in the form of a mixture or in the form of a multimer (oligomer) having the two or more types of compound as structural units, solubility of the guanamine compound in a solvent may be improved.

(A)

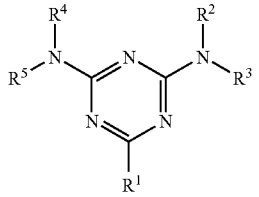

In formula (A), $R^1$ represents a linear or branched alkyl group having 1 to 10 carbon atoms, a substituted or unsubstituted phenyl group having 6 to 10 carbon atoms, or a substituted or unsubstituted alicyclic hydrocarbon group having 4 to 10 carbon atoms; and $R^2$ to $R^5$ each independently represent a hydrogen atom, —$CH_2$—OH, or —$CH_2$—O—$R^6$, wherein $R^6$ represents a linear or branched alkyl group having 1 to 10 carbon atoms.

In formula (A), the alkyl group represented by $R^1$ has 1 to 10 carbon atoms, preferably 1 to 8 carbon atoms, and more preferably 1 to 5. The alkyl group may be linear or branched.

In formula (A), the phenyl group represented by $R^1$ has 6 to 10 carbon atoms, preferably 6 to 8 carbon atoms. Examples of the substituent of the phenyl group include methyl, ethyl and propyl groups.

In formula (A), the alicyclic hydrocarbon group represented by $R^1$ has 4 to 10 carbon atoms, preferably 5 to 8 carbon atoms. Examples of the substituent of the alicyclic hydrocarbon group include methyl, ethyl and propyl groups.

In formula (A), in "—$CH_2$—O—$R^6$" represented by $R^2$ to $R^5$, the alkyl group represented by $R^6$ has 1 to 10 carbon atoms, preferably 1 to 8 carbon atoms, and more preferably 1 to 6 carbon atoms. The alkyl group may be linear or branched. Preferable examples thereof include methyl, ethyl and butyl groups.

The compound represented by formula (A) is particularly preferably a compound wherein $R^1$ represents a substituted or unsubstituted phenyl group having 6 to 10 carbon atoms, and $R^2$ to $R^5$ each independently represent —$CH_2$—O—$R^6$. $R^6$ is preferably selected from methyl and n-butyl groups.

The compound represented by formula (A) may be synthesized by, for example, a known method using guanamine and formaldehyde (see, for example, Jikken Kagaku Kohza (Experimental Chemical Lecture), $4^{th}$ Edition, vol. 28, p. 430).

Specific examples of the compound represented by formula (A) are illustrated below, but the invention is not limited thereto. Although the following specific examples are in the form of a monomer, multimers (oligomers) having these monomers as a structural unit are also applicable.
(A)-1
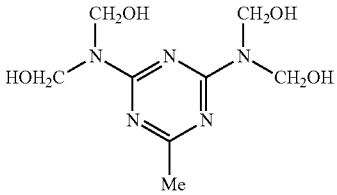
(A)-2
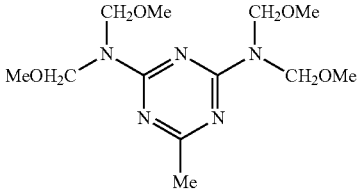
(A)-3
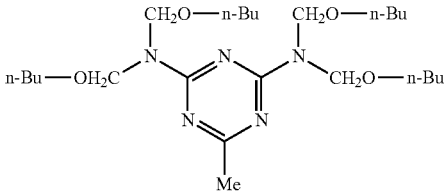
(A)-4
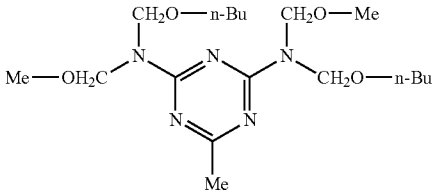
(A)-5
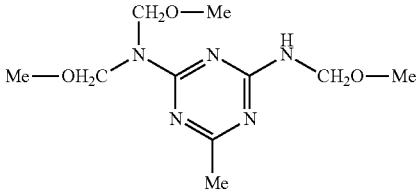
(A)-6
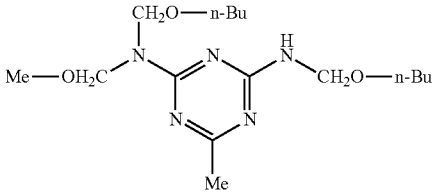
(A)-7
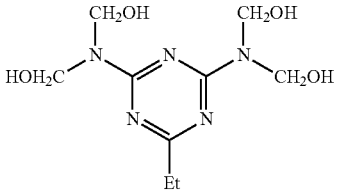
(A)-8
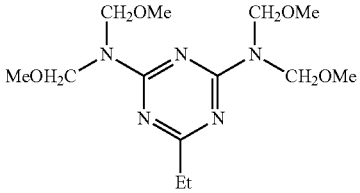
-continued
(A)-9
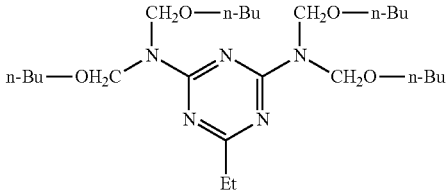
(A)-10
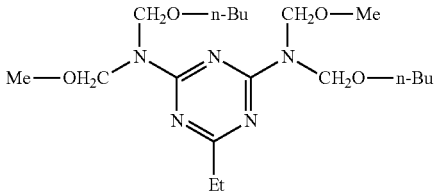
(A)-11
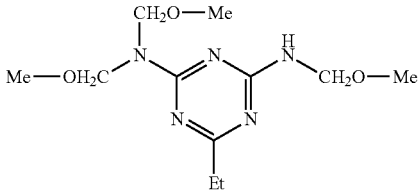
(A)-12
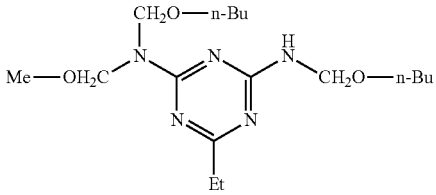
(A)-13
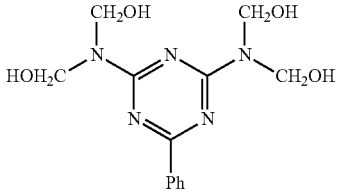
(A)-14
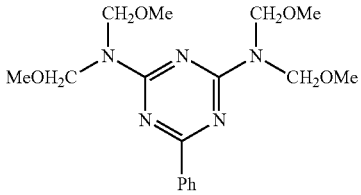
(A)-15
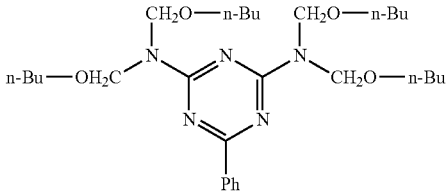
(A)-16
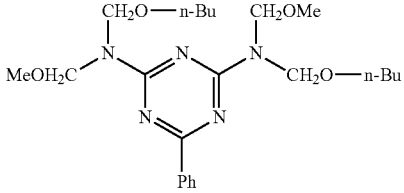

-continued (A)-17

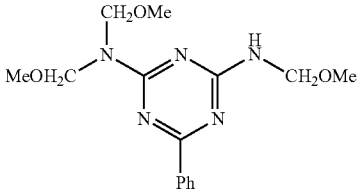

(A)-18

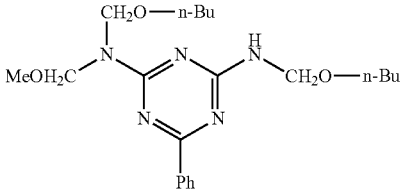

(A)-19

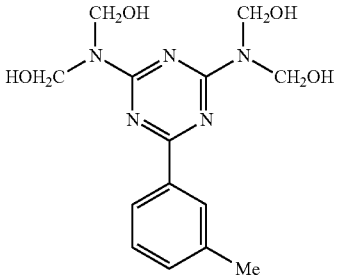

(A)-20

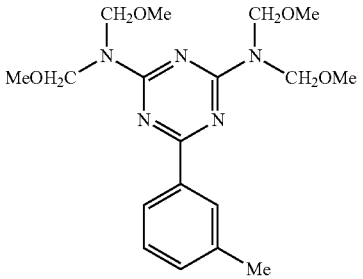

(A)-21

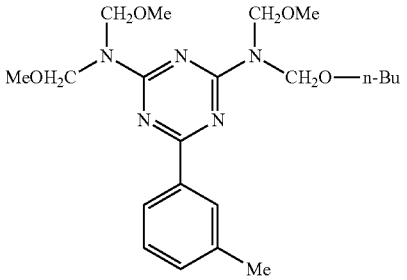

(A)-22

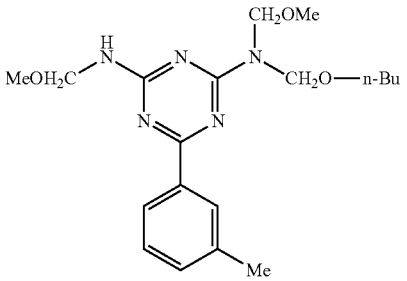

Examples of the commercially available product of the compound represented by formula (A) include the following, which are shown by their trade names: SUPER BECKAMINE (R) L-148-55, SUPER BECKAMINE (R) 13-535, SUPER BECKAMINE (R) L-145-60, and SUPER BECKAMINE (R) TD-126 (manufactured by DIC Corporation); and NIKALAC BL-60, and NIKALAC BX-4000 (manufactured by Sanwa Chemical Co., Ltd.).

The compound represented by formula (A) (including a multimer) may be dissolved in an appropriate solvent such as toluene, xylene or ethyl acetate, and then washed with distilled water, ion exchange water or the like, or may be treated with an ion exchange resin, in order to remove the effect of a remaining catalyst from the compound after synthesizing or purchasing the same.

<Melamine Compound>

The melamine compound has a melamine skeleton (structure), and is particularly preferably at least one of the compound represented by the following formula (B) or a multimer thereof. The multimer refers to an oligomer obtained by polymerizing a compound represented by formula (B) as a structural unit, as with the case of the compound represented by formula (A), and the polymerization degree thereof is, for example, from 2 to 200 (preferably from 2 to 100). The compound represented by formula (B) or a multimer thereof may be used alone or in combination of two or more types. It is also possible to use the compound in combination with a compound represented by formula (A) or a multimer thereof. In particular, when two or more types of the compound represented by formula (B) are used in the form of a mixture, or in the form of a multimer (oligomer) including these compounds as a structural unit, solubility of the compound in a solvent may be improved.

(B)

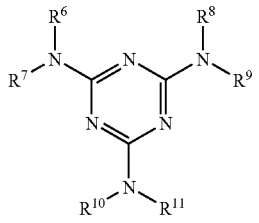

In formula (B), $R^6$ to $R^{11}$ each independently represent a hydrogen atom, —$CH_2$—OH, or —$CH_2$—O—$R^{12}$, wherein $R^{12}$ represents an alkyl group having 1 to 5 carbon atoms that may be linear or branched. Examples of the alkyl group include methyl, ethyl, and butyl groups.

The compound represented by formula (B) may be synthesized by, for example, a known method using melamine and formaldehyde (e.g., in a similar manner to the melamine compound as described in Jikken Kagaku Kohza (Experimental Chemical Lecture), $4^{th}$ Edition, vol. 28, p. 430).

Specific examples of the compound represented by formula (B) are illustrated below, but the invention is not limited thereto. Although the specific examples are in the form of a monomer, multimers (oligomers) having these monomers as a structural unit may also be applicable.

(B)-1

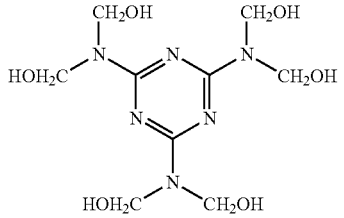

-continued (B)-2

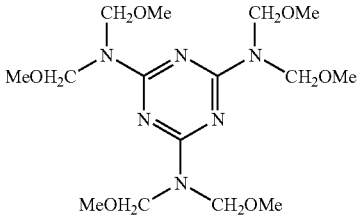

(B)-3

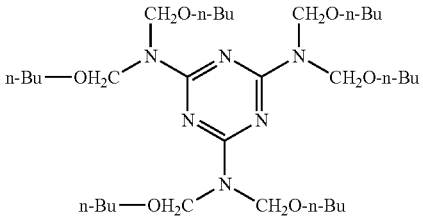

(B)-4

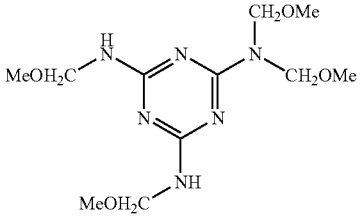

(B)-5

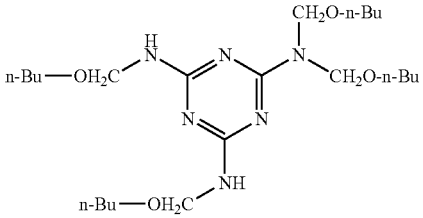

(B)-6

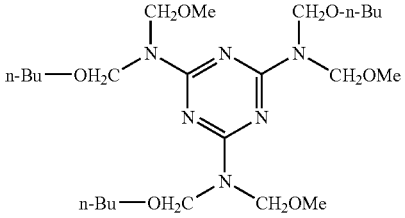

Example of the commercially available products of the compound represented by formula (B) include the following, which are shown by their trade names: SUPER MELAMI No. 90 (manufactured by NOF Corporation); SUPER BECKAMINE (R) TD-139-60 (manufactured by DIC Corporation); U-VAN 2020 (manufactured by Mitsui Chemicals, Inc.); SUMITEX RESIN M-3 (manufactured by Sumitomo Chemical Co., Ltd.); and NIKALAC MW-30 (manufactured by Sanwa Chemical Co., Ltd.)

The compound represented by formula (B) (including a multimer) may be dissolved in an appropriate solvent such as toluene, xylene or ethyl acetate, and then washed with distilled water, ion exchange water or the like, or may be treated with an ion exchange resin, in order to remove the effect of a remaining catalyst from the compound after synthesizing or purchasing the same.

<Specific Charge Transporting Material>

The specific charge transporting material has at least one substituent selected from —OH, —$OCH_3$, —$NH_2$, —SH or —COOH. In particular, the specific charge transporting material preferably has two or more (more preferably three) substituents selected from —OH, —$OCH_3$, —$NH_2$, —SH or —COOH. By increasing the number of reactive functional groups (substituents) in the specific charge transporting material, the crosslinkage density may be increased and an even stronger crosslinked film may be obtained. In particular, the decrease in rotary torque of the electrophotographic photoreceptor when a blade cleaner is used may suppress the damages to the blade or the wear of electrophotographic photoreceptor. Although the details of the above results are not clear; it is thought to be that the increase in the number of reactive functional groups achieves formation of a cured film having a high degree of crosslinkage density, thereby suppressing the molecular movement at the very surface of the electrophotographic photoreceptor and weakening the interaction with the molecules at the surface of the blade member.

The specific charge transporting compound is preferably a compound represented by the following formula (I):

$$F—((—R^{11}—X)_{n1}(R^{12})_{n2}—Y)_{n3} \quad (I)$$

In formula (I), F represents an organic group derived from a compound having a hole transporting capability, each of $R^{11}$ and $R^{12}$ independently represent a linear or branched alkylene group having 1 to 5 carbon atoms, n1 represents 0 or 1, n2 represents 0 or 1, n3 represents an integer of 1 to 4, X represents an oxygen atom, NH, or a sulfur atom, and Y represents —OH, —$OCH_3$, —$NH_2$, —SH or —COOH.

In formula (I), the compound having a hole transporting capability from which the organic group represented by F is derived from is preferably an arylamine derivative. Preferred examples of the arylamine derivative include triphenylamine derivatives and tetraphenylbenzidine derivatives.

A compound represented by formula (I) is preferably a compound represented by the following formula (II). The compound represented by formula (II) has particularly excellent charge mobility, stability against oxidation, or the like.

(II)

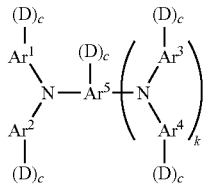

In formula (II), $Ar^1$ to $Ar^4$ each independently represent a substituted or unsubstituted aryl group; $Ar^s$ represents a substituted or unsubstituted aryl group or a substituted or unsubstituted arylene group; each D independently represents —(—$R^{11}$—X)$_{n1}$($R^{12}$)$_{n2}$—Y, wherein $R^{11}$ and $R^{12}$ each independently represent a linear or branched alkylene group having 1 to 5 carbon atoms, n1 represents 0 or 1, n2 represents 0 or 1, X represents an oxygen atom, NH or a sulfur atom, and Y represents —OH, —$OCH_3$, —$NH_2$, —SH or —COOH; each c independently represents 0 or 1; k represents 0 or 1; and the total number of D is from 1 to 4.

In formula (II), "—(—$R^{11}$—X)$_{n1}$($R^{12}$)$_{n2}$—Y" represented by D has the same definitions as in formula (I), and $R^{11}$ and $R^{12}$ each independently represents a linear or branched alkylene group having 1 to 5 carbon atoms. n1 is preferably 1 and n2 is preferably 1. X is preferably an oxygen atom. Y is preferably a hydroxyl group.

In formula (II), the total number of D corresponds to n3 in formula (I), preferably from 2 to 4, more preferably from 3 to 4. When the total number of D in formula (I) or (II) is in a range of from 2 to 4 in a single molecule, more preferably from 3 to 4, the crosslinkage density may be increased and an even stronger crosslinked film may be obtained. In particular, the decrease in rotary torque of the electrophotographic photoreceptor when a blade cleaner is used may suppress the damages to the blade or the wear of electrophotographic photoreceptor. Although the details of the above results are not clear; it is thought to be that the increase in the number of reactive functional groups achieves formation of a cured film having a high degree of crosslinkage density, thereby suppressing the molecular movement at the very surface of the electrophotographic photoreceptor and weakening the interaction with the molecules at the surface of the blade member.

In formula (II), $Ar^1$ to $Ar^4$ each are preferably any one of the following formulae (1) to (7). In the formulae, the "-(D)c", which may be connected to each of $Ar^1$ to $Ar^4$, is described together.

(1)

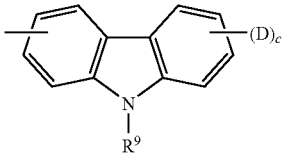

(2)

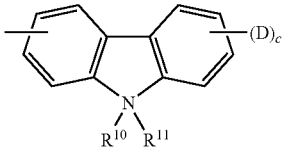

(3)

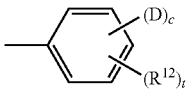

(4)

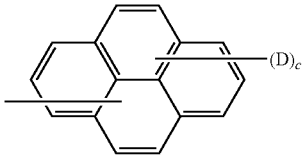

(5)

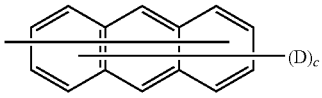

(6)

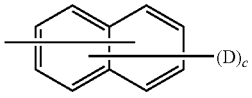

(7)

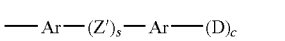

In formulae (1) to (7), $R^9$ represents one selected from the group consisting of a hydrogen atom, an alkyl group having 1 to 4 carbon atoms, a phenyl group substituted by an alkyl group having 1 to 4 carbon atoms or an alkoxy group having 1 to 4 carbon atoms, an unsubstituted phenyl group, and an aralkyl group having 7 to 10 carbon atoms; $R^{10}$, $R^{11}$ and $R^{12}$ each independently are one selected from the group consisting of a hydrogen atom, an alkyl group having 1 to 4 carbon atoms, a phenyl group substituted by an alkyl group having 1 to 4 carbon atoms or an alkoxy group having 1 to 4 carbon atoms, an unsubstituted phenyl group, an aralkyl group having 7 to 10 carbon atoms, and a halogen atom; each of Ar independently represents a substituted or unsubstituted arylene group; D and c have the same definitions as D and c in formula (II); s represents 0 or 1; and t represents an integer of 1 to 3.

In formula (7), each of Ar is preferably a group represented by the following formula (8) or (9).

(8)

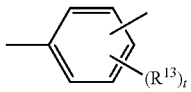

(9)

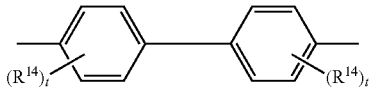

In formula (8) or (9), each of $R^{13}$ and each of $R^{14}$ independently represent one selected from the group consisting of a hydrogen atom, an alkyl group having 1 to 4 carbon atoms, an alkoxy group having 1 to 4 carbon atoms, a phenyl group substituted by an alkoxy group having 1 to 4 carbon atoms, an unsubstituted phenyl group, an aralkyl group having 7 to 10 carbon atoms, and a halogen atom; and each of t independently represents an integer of 1 to 3.

In formula (7), Z' is preferably a group represented by any one of the following formulae (10) to (17).

(10)

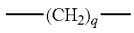

(11)

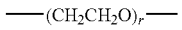

(12)

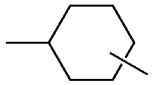

(13)

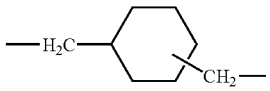

(14)

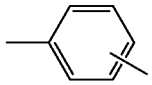

(15)

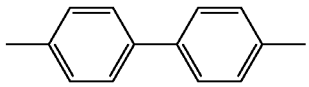

(16)

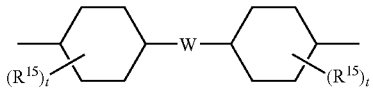

(17)

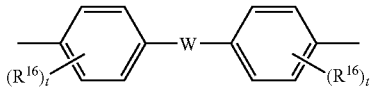

In formulae (10) to (17), each of $R^{15}$ and each of $R^{16}$ independently represent one selected from the group consisting of a hydrogen atom, an alkyl group having 1 to 4 carbon atoms, a phenyl group substituted by an alkyl group having 1 to 4 carbon atoms or by an alkoxy group having 1 to 4 carbon atom, an unsubstituted phenyl group, an aralkyl group having 7 to 10 carbon atoms, and a halogen atom; W represents a bivalent group; q and r each independently represent an integer of 1 to 10; and each of t independently represents an integer of 1 to 3.

In formulae (16) and (17), W is preferably any one of the bivalent groups represented by the following formulae (18) to (26). In formula (25), u represents an integer of 0 to 3.

(18) $-CH_2-$

(19) $-C(CH_3)_2-$

(20) $-O-$

(21) $-S-$

(22) $-C(CF_3)_2-$

(23) $-Si(CH_3)_2-$ (24)

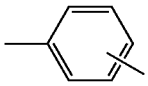

(25)

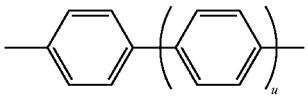

(26)

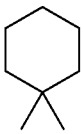

In formula (II), $Ar^5$ is an aryl group represented by any one of formulae (1) to (7) as mentioned above, when k is 0; or an arylene group obtained by removing a predetermined hydrogen atom from an aryl group represented by any one of the formulae (1) to (7), when k is 1.

Specific examples of the compound represented by formula (I) include the following compounds I-1 to I-34, but the invention is not limited thereto.

I-1

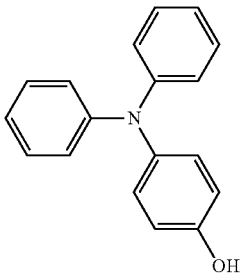

I-2

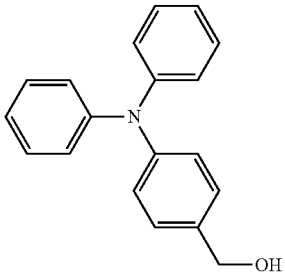

-continued

I-3

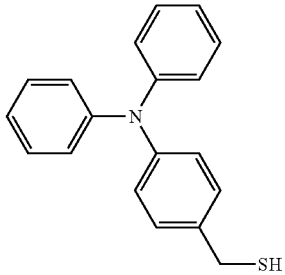

I-4

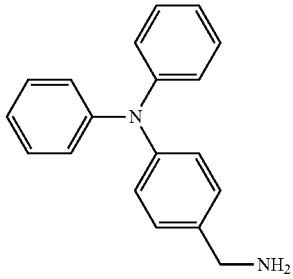

I-5

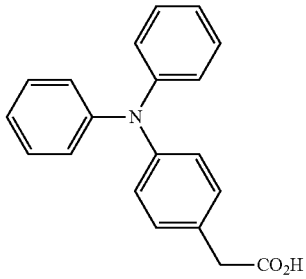

I-6

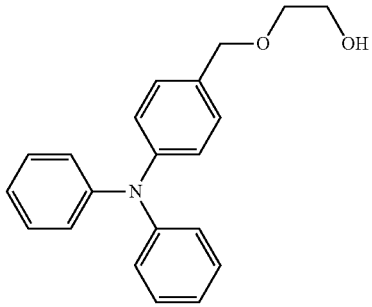

I-7

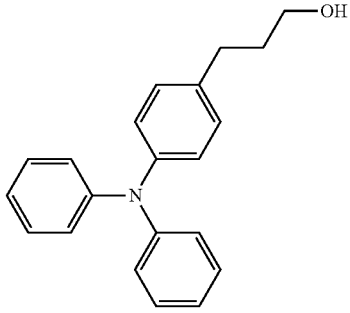

-continued
I-8
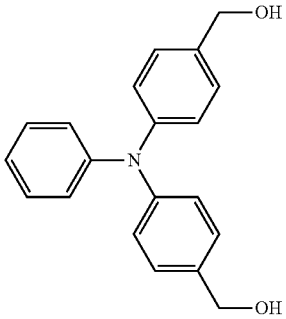
I-9
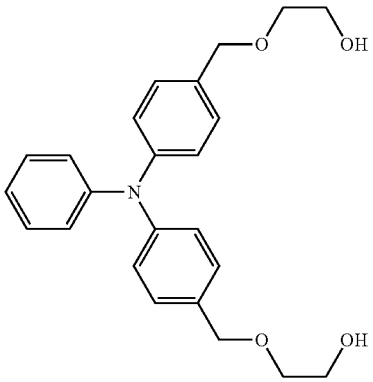
I-10
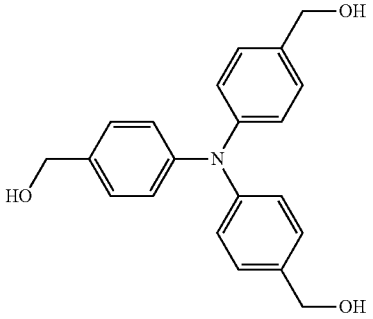
I-11
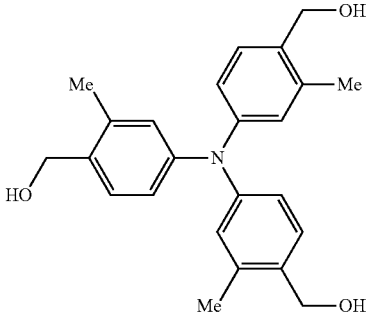
-continued
I-12
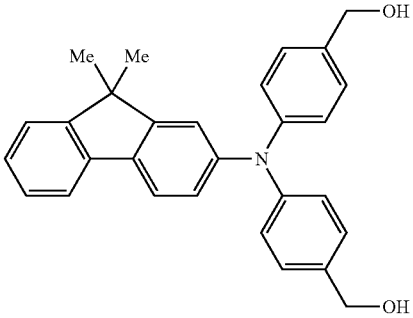
I-13
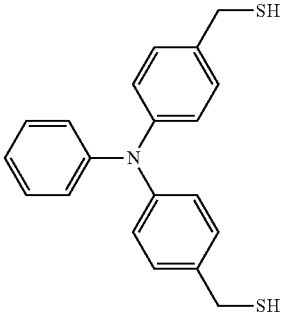
I-14
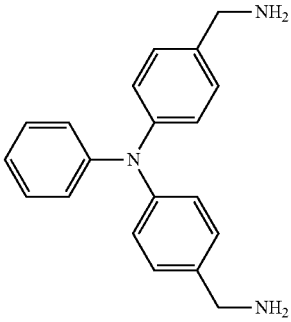
I-15
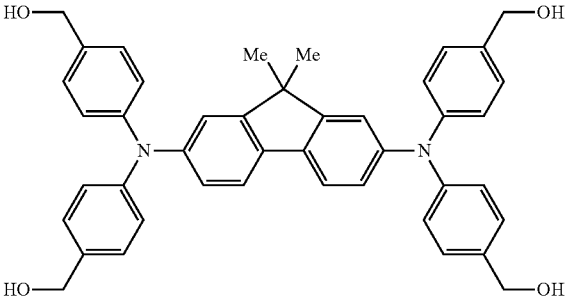
I-16
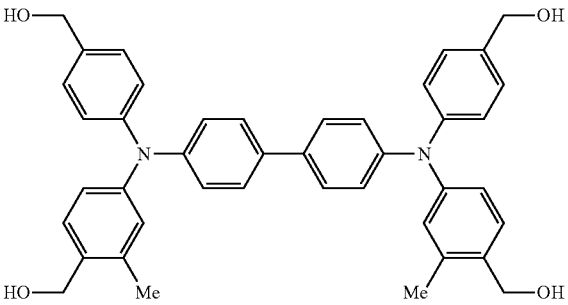

-continued
I-17
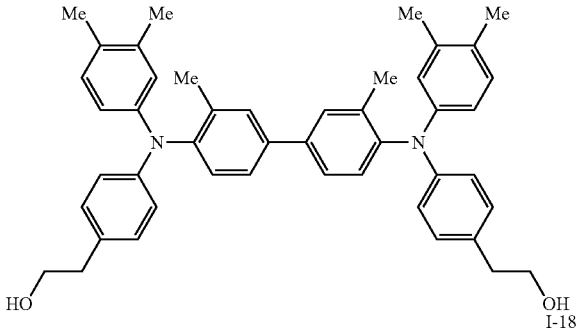
I-18
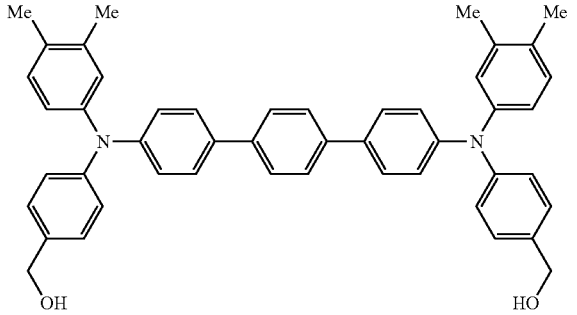
I-19
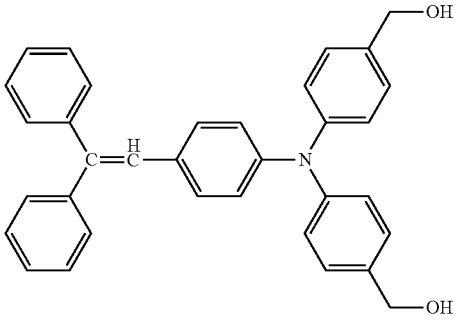
I-20
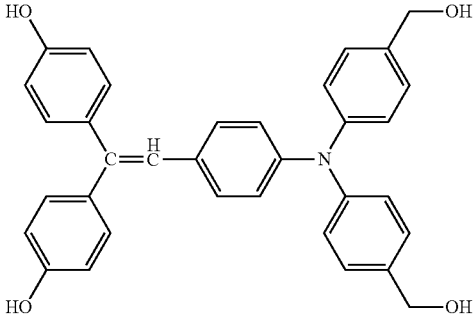
I-21
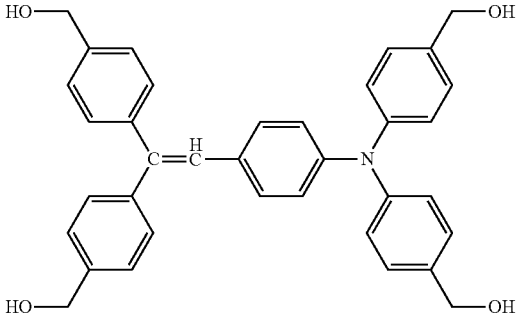
-continued
I-22
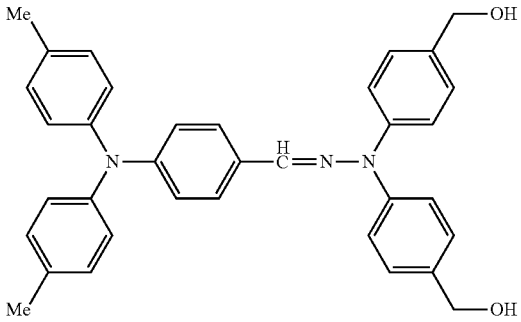
I-23
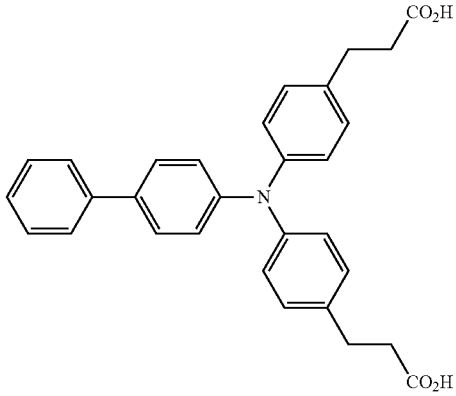
I-24
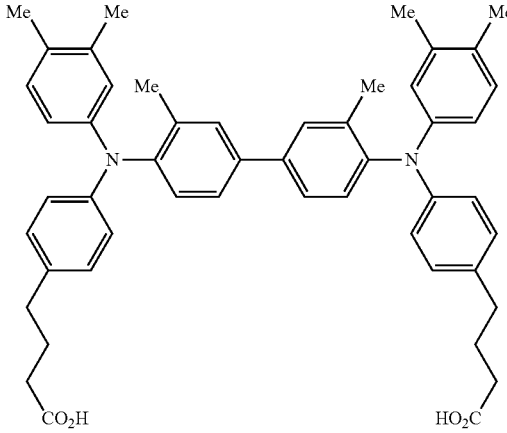
I-25
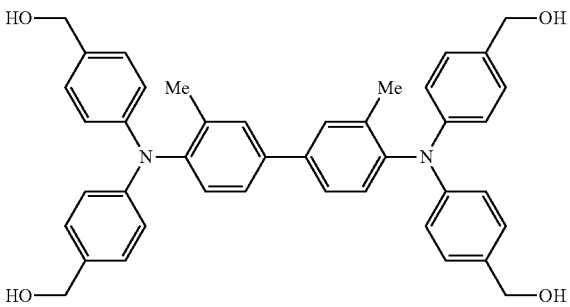

-continued

I-26

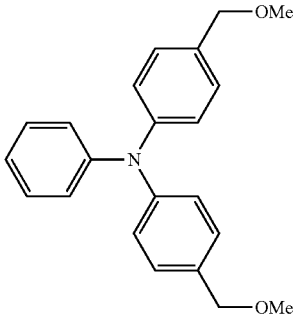

I-27

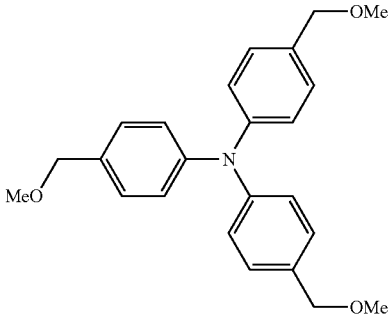

I-28

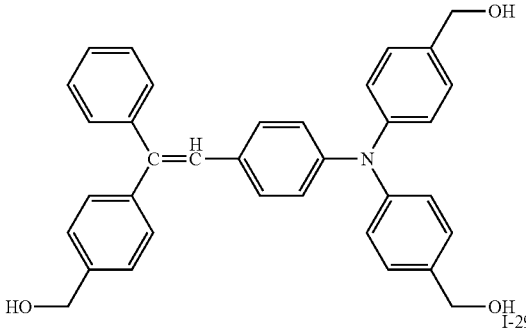

I-29

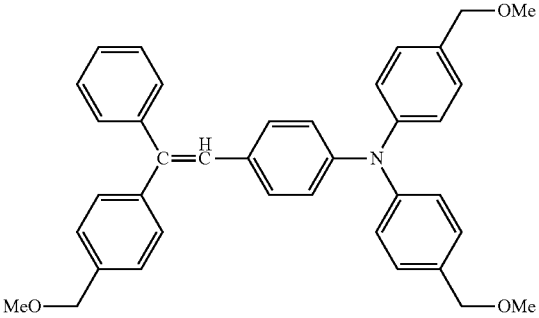

I-30

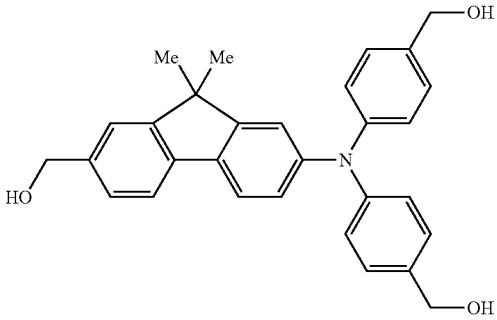

-continued

I-31

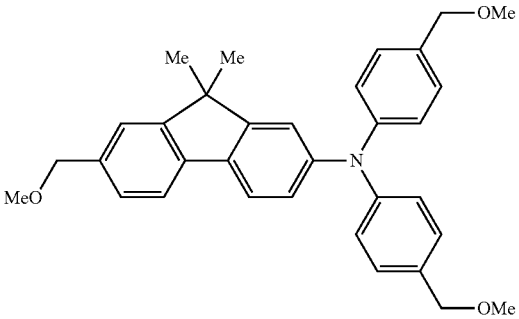

I-32

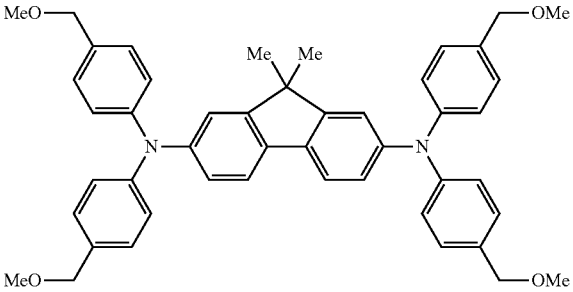

I-33

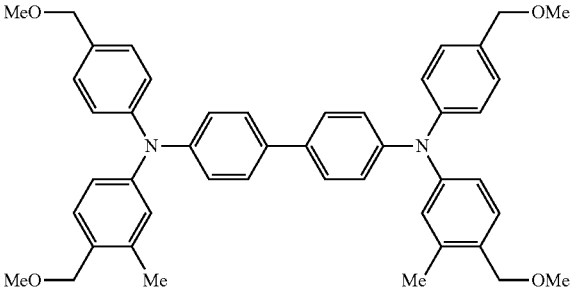

I-34

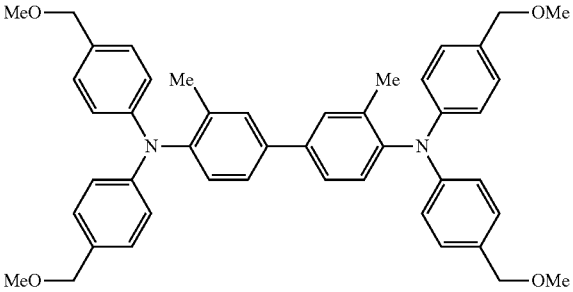

The solid content concentration of at least one specific charge transporting materials in the surface protection layer 5 is preferably 80% or more by weight, more preferably 90% or more by weight, and even more preferably 95% or more by weight. When the solid content concentration is within the above range, resistance of the photoreceptor with respect to externally applied electrical or mechanical stress may be improved. If the solid content concentration is less than the above range, electrical properties of the photoreceptor may not be sufficient, as compared with the case when the concentration is within the same range. The upper limit of the solid content concentration is not limited as far as at least one selected from a guanamine compound (compound represented by formula (A)) or a melamine compound (compound represented by formula (B)) and other additives may function in an effective manner, and the higher solid content concentration is more preferable.

The content of the specific charge transporting material in the surface protection layer 5 may be controlled by adjusting the solid content concentration of the specific charge transporting material in a composition used for the formation of surface protection layer 5.

The solid content concentration of at least one selected from a guanamine compound (compound represented by formula (A)) or a melamine compound (compound represented by formula (B)) in the surface protection layer 5 is, as mentioned above, from about 0.1% by weight to about 5% by weight, and is preferably from 1% by weight to 3% by weight. If the solid content concentration is less than the above range, it may be difficult to obtain a dense film, and a sufficient degree of strength of the film may not be achieved. If the solid content concentration is more than the above range, electrical properties or anti-ghost properties of the electrophotographic photoreceptor may not be sufficient.

The content of the guanamine compound and/or the melamine compound in the surface protection layer 5 may be controlled by adjusting the solid content concentration of the guanamine compound and/or the melamine compound in a composition used for the formation of surface protection layer 5.

In this exemplary embodiment, the surface protection layer 5 satisfies the following requirement (3): having a universal hardness of 180 N/mm$^2$ to 220 N/mm$^2$ and a creep ratio of 5% to 8%, the universal hardness and the creep ratio being obtained by performing a hardness test by pushing a Vickers quadrangular pyramid diamond indenter in the surface protection layer at a maximum load of 20 mN, under an environment of 25° C. and a relative humidity of 50%.

The universal hardness (hereinafter, referred to as "HU" sometimes) of the surface protection layer is preferably from 180 N/mm$^2$ to 200 N/mm$^2$.

The creep ratio (hereinafter, referred to as "CHU" sometimes) of the surface protection layer is preferably from 5% or about 5% to 7% or about 7%, and more preferably from 5.5% or about 5.5% to 7% or about 7%.

In the following, details of the measurement of universal hardness and creep ratio of an electrophotographic photoreceptor is described.

A microhardness tester (trade name: FISHER SCOPE H100V, manufactured by Fischer Instruments K.K.) is used as a unit used for the measurement, and a Vickers quadrangular pyramid diamond indenter having an angle of 136° is used as the intender for the measurement.

The conditions for the measurement are as follows:

Loading conditions: the Vickers intender is pushed against the surface of the surface protection layer of the electrophotographic photoreceptor at a rate of 4 mN/sec.

Loading period: 5 sec.

Retention period: 5 sec.

Load-removing conditions: the load is removed at a rate equal to the loading rate.

The electrophotographic photoreceptor prepared as a sample for measurement is fixed to the microhardness tester, and the Vickers intender is pushed against the surface of the surface protection layer in a perpendicular direction with respect to the surface. The measurement is performed in the order of applying load (5 sec.), retaining the same (5 sec, the ratio of deformation amount during this period corresponds to the creep ratio), and then removing the same.

Figure 4:
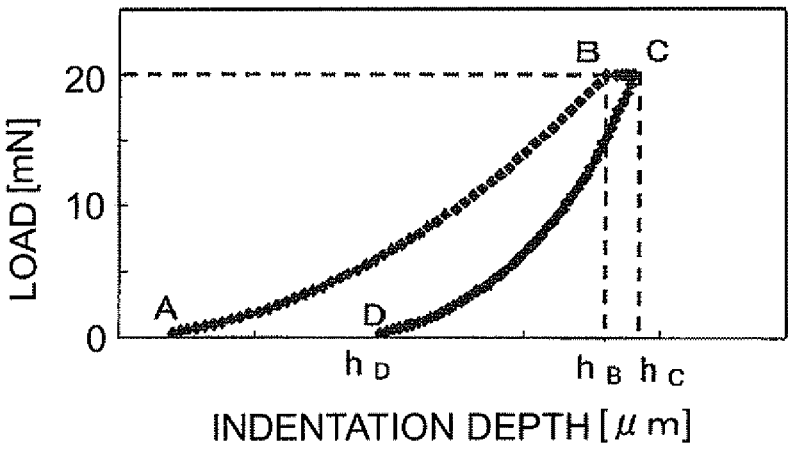
FIG. 4 is a schematic view of an output chart used for measurement of the universal hardness and the creep ratio according to an exemplary embodiment of the invention.

FIG. 4 is a schematic view of an output chart used for the measurement of universal hardness and creep ratio of the surface protection layer according to this exemplary embodiment. FIG. 4 shows a relationship between the pressing-load (unit: mN) of the intender (i.e., the vertical axis) and the displacement (indentation depth h, unit: mm) of the intender (i.e., the transverse axis). Although the graph of FIG. 4 describes the displacement of the intender as measured by "μm", the universal hardness (HU), which will be described later, can be obtained by converting the same to "mm".

The measurement is carried out by increasing the stress applied to the intender pushed against the surface protection layer from 0 to 20 mN, starting from point A in FIG. 4, thereby increasing the displacement (indentation depth h (mm)) of the intender pushed into the surface protection layer up to $h_B$ (mm) (i.e., moving from point A to point B). The load is retained at this level for 5 sec., and the displacement of the intender is increased to $h_C$ (mm) (i.e., from point B to point C). Thereafter, the stress applied to the intender is decreased from 20 mN to 0, and the intender moves back in an amount corresponding to the elastic deformation of the surface protection layer, thereby decreasing the displacement of the intender from $h_C$ (mm) to $h_D$ (mm) (i.e., from point C to point D).

The universal hardness (HU) (N/mm$^2$) is obtained by dividing the value of test load (N) by the value of the surface area of the Vickers intender under test load (mm$^2$). Specifically, the universal hardness (N/mm$^2$) can be calculated from the indentation depth $h_C$ (mm) using the following equation (U).

$$HU(N/\mathrm{mm}^2)=0.006/(26.43\times h_C^2) \quad \text{(U)}$$

Further, the creep ratio (CHU) (%) can be calculated using the following equation (C).

$$CHU(\%)=\{(h_C-h_B)/h_B\}\times 100 \quad \text{(C)}$$

In equation (C), $h_B$ represents the indentation depth (mm) when the load has reached 20 mN (after 5 seconds from the start of applying load), and k represents the indentation depth (mm) after retaining the load at the same level (5 sec.).

It is generally thought that a film having a high degree of hardness exhibits a small deformation with respect to external stress, and that an electrophotographic photoreceptor having a high degree of pencil hardness or Vickers hardness exhibits more endurance against mechanical abrasion.

However, an electrophotographic photoreceptor having a high degree of hardness does not always have an improved endurance against mechanical abrasion. In this regard, the inventors have found that when the values of creep ratio and HU of a surface protection layer of an electrophotographic photoreceptor are within certain ranges, respectively, mechanical deterioration of the surface protection layer may be suppressed.

Specifically, the inventors have found that when an electrophotographic photoreceptor has a surface protection layer having a universal hardness and a creep ratio within the ranges as defined above, degradation in endurance against mechanical abrasion of the surface protection layer may be suppressed, thereby enabling formation of images having an excellent quality, i.e., having reduced image defects due to ghosting or toner passing through the gap between the surface protection layer and the cleaning unit.

Although it is difficult to consider the HU and the creep ratio as entirely independent factors from each other, for example, when the HU is over 220 N/mm$^2$, the hardness of the surface protection layer may be too high and the electrophotographic photoreceptor may not be able to follow a transfer unit while being rubbed against the unit. As a result, deep scratches may be formed on the electrophotographic photoreceptor, whereby passing through of toner or filming due to the toner or other external additives rubbed against the scratches may easily occur. Therefore, increasing the HU does not always result in an electrophotographic photoreceptor having excellent properties.

Even though the HU is within the range of 180 N/mm$^2$ to 220 N/mm$^2$, a satisfactory surface protection layer may not be obtained when the creep ratio is less than 5%, since the deformation thereof is too small with respect to the hardness thereof. As a result, defects such as filming or passing through of toner due to increased stress against the cleaning blade may easily occur. Further, even though the HU is within the range of 180 N/mm$^2$ to 220 N/mm$^2$, a satisfactory surface protection layer may not be obtained when the creep ratio is greater than 8%, since the deformation thereof is too large with respect to the hardness thereof. As a result, the absolute amount of abrasion or the difference in the amount of abrasion between an imaging portion and a non-imaging portion may increase, thereby resulting in the shorter lifespan of the electrophotographic photoreceptor than expected.

Furthermore, even though the creep ratio is from 5% to 8%, an electrophotographic photoreceptor having an insufficient hardness may be obtained when the HU is less than 180 N/mm$^2$. As a result, scratches due to a cleaning blade or a contact-type charging roller may be formed, or passing of toner at the cleaning portion may occur.

In view of the above, the electrophotographic photoreceptor of this exemplary embodiment having a surface protection layer that satisfies the values of HU and creep ratio within the ranges as defined may achieve suppressed formation of scratches, as well as improved endurance against mechanical abrasion.

In this exemplary embodiment, the values of HU and creep ratio of the surface protection layer may be controlled by selecting the type or the amount of the specific charge transporting material, the guanamine compound and/or the melamine compound, adjusting the temperature or the time period for drying for the formation of surface protection layer, adjusting the film thickness of the surface protection layer, or the like.

In particular, although it is not always the case, the HU tends to decrease while the creep ratio tends increase when the amount of the specific charge transporting amount. Further, the HU tends to increase while the creep ratio decrease when the drying temperature is increased or the drying time is extended. By adjusting these parameters in consideration of the above, the values of HU and creep ratio of the surface protection layer may be controlled in a more effective manner.

<Surface Protection Layer 5>

Surface protection layer 5 may include a phenol resin, a melamine resin, a urea resin, an alkyd resin or the like, together with the crosslinked substance of at least one selected from a guanamine compound (compound represented by formula (A)) and a melamine compound (compound represented by formula (B), and at least one specific charge transporting material (compound represented by formula (I)). From the viewpoint of improving the strength, it is effective to copolymerize a compound having more functional groups in the molecule, such as a spiroacetal based guanamine resin (for example, CTU-GUANAMINE, trade name, manufactured by Ajinomoto Fine-Techno Co., Inc.), with the materials of the crosslinked substance.

In order that a gas generated by electric discharge is not adsorbed to the surface protection layer 5 too much, and for the purpose of suppressing oxidization due to the gas generated by electric discharge effectively, the surface protection layer 5 may include a further thermosetting resin such as a phenol resin, a melamine resin or a benzoguanamine resin.

A surfactant is preferably added to the surface protection layer 5. The surfactant is not particularly limited as far as the surfactant contains at least one structure selected from a fluorine atom-containing structure, an alkylene oxide structure, or a silicone structure. The surfactant preferably has two or more of the above structures, since such a surfactant has a high degree of affinity and compatibility with a charge transporting organic compound, thereby improving the film-formation properties of a coating liquid for forming the surface protection layer, and suppressing the formation of wrinkles or unevenness of the surface protection layer 5.

There are various kinds of surfactant including fluorine atoms. Specific examples of a surfactant having a fluorine atom-containing structure and an acrylic structure include POLYFLOW KL600 (trade name, manufactured by Kyoeisha Chemical Co., Ltd.) and EFTOP EF-351, EF-352, EF-801, EF-802, and EF-601 (trade name, manufactured by Mitsubishi Materials Electronic Chemicals Co., Ltd.) Main examples of a surfactant having an acrylic structure include polymers obtained by polymerizing or copolymerizing a monomer such as an acrylic or methacrylic compound.

Examples of the surfactant having a fluorine atom-containing structure include a surfactant having a perfluoroalkyl group. Specific and preferred examples thereof include perfluoroalkylsulfonic acids (such as perfluorobutanesulfonic acid and perfluorooctanesulfonic acid), perfluoroalkylcarboxylic acids (such as perfluorobutanecarboxylic acid and perfluorooctanecarboxylic acid), and perfluoroalkyl group-containing phosphates. Perfluoroalkylsulfonic acids and perfluoroalkylcarboxylic acids may be salts thereof or amide-modified products thereof. Examples of the commercially available products of perfluoroalkylsulfonic acids include MEGAFAC F-114 (trade name, manufactured by DIC Corporation), EFTOP EF-101, EF-102, EF-103, EF-104, EF-105, EF-112, EF-121, EF-122A, EF-122B, EF-122C, and EF-123A (manufactured by Mitsubishi Materials Electronic Chemicals Co., Ltd.), and FUTERGENT A-K and 501 (manufactured by Neos Co., Ltd.).

Examples of commercially available products of perfluoroalkylcarboxylic acids include MEGAFAC F-410 (trade name, manufactured by DIC Corporation) and EFTOP EF-201 and EF-204 (trade name, manufactured by Mitsubishi Materials Electronic Chemicals Co., Ltd.)

Examples of commercially available products of the perfluoroalkyl group-containing phosphates include MEGAFAC F-493 and F-494 (manufactured by DIC Corporation) and EFTOP EF-123A, EF-123B, EF-125M, and EF-132 (manufactured by Mitsubishi Materials Electronic Chemicals Co., Ltd.)

Examples of the surfactant having an alkylene oxide structure include polyethylene glycol, a polyether antifoamer, and polyether-modified silicone oil. The polyethylene glycol preferably has a number-average molecular weight of 2000 or less, and examples thereof include polyethylene glycol 2000 (number-average molecular weight: 2000), polyethylene glycol 600 (number-average molecular weight: 600), polyethylene glycol 400 (number-average molecular weight: 400), and polyethylene glycol 200 (number-average molecular weight: 200).

Examples of commercially available products of the polyether antifoamer include PE-M and PE-L (trade name, manufactured by Wako Pure Chemical Industries, Ltd.) and SHOHOZAI Nos. 1 and 5 (trade name, manufactured by Kao Corporation).

Examples of the surfactant having a silicone structure include common silicone oils, such as dimethylsilicone, methylphenylsilicone and diphenylsilicon, and derivatives thereof.

Examples of the surfactant having both of a fluorine atom-containing structure and an alkylene oxide structure include those having an alkylene oxide structure or a polyalkylene oxide structure in its side chain(s), or those having an alkylene oxide structure or a polyalkylene oxide structure substituted by a fluorine-containing substituent. Specific examples of commercially available products of the surfactant having an alkylene oxide structure include MEGAFAC F-443, F-444, F-445, and F-446 (trade name, manufactured by DIC Corporation), and POLY FOX PF636, PF6320, PF6520 and PF656 (trade name, manufactured by Kitamura Chemicals Co., Ltd.)

Examples of commercially available products of the surfactant having both of an alkylene oxide structure and a silicone structure include KF 351(A), KF352 (A), KF353 (A), KF354 (A), KF355 (A), KF615 (A), KF618, KF945 (A), and KF6004 (trade name, manufactured by Shin-Etsu Chemical Co., Ltd.), TSF4440, TSF4445, TSF4450, TSF4446, TSF4452, TSF4453, and TSF4460 (trade name, manufactured by GE Toshiba Silicones Co., Ltd.), BYK-300, 302, 306, 307, 310, 315, 320, 322, 323, 325, 330, 331, 333, 337, 341, 344, 345, 346, 347, 370, 375, 377 and 378, UV3500, UV3510, and UV3570 (trade name, manufactured by BYK Japan K.K.)

The content of the surfactant is preferably from 0.01% by weight to 1% by weight of the total solid content concentration of the surface protection layer 5, more preferably from 0.02% by weight to 0.5% by weight thereof. When the content of the surfactant is 0.01% by weight or more, generation of defects such as wrinkles or unevenness in the film may be further suppressed. When the content of the surfactant is 1% by weight or less, separation of the surfactant and the cured resin is less likely caused, and the strength of the resultant cured product tends to be maintained.

The surface protection layer 5 may include a coupling agent or a fluorine compound, in order to adjust the properties of the film, such as film formation properties, flexibility, lubricity, or adhesiveness. Examples of these compounds include various silane coupling agents and commercially available silicone-based hard coating agents.

Examples of the silane coupling agent include vinyltrichlorosilane, vinyltrimethoxysilane, vinyltriethoxysilane, γ-glycidoxypropylmethyldiethoxysilane, γ-glycidoxypropyltrimethoxysilane, γ-aminopropyltriethoxysilane, γ-aminopropyltrimethoxysilane, γ-aminopropylmethyldimethoxysilane, N-β-(aminoethyl)-γ-aminopropyltriethoxysilane, tetramethoxysilane, methyltrimethoxysilane, and dimethyldimethoxysilane. Examples of the commercially available silicone-based hard coating agent include KP-85, X-40-9740, and X-8239 (trade name, manufactured by Shin-Etsu Chemical Co., Ltd.), and AY42-440, AY42-441, and AY49-208 (trade name, manufactured by Dow Corning Toray Co., Ltd.)

In order to impart water repellency to the surface protection layer 5, a fluorine-containing compound may be added therein, and examples thereof include (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane, and 1H,1H,2H,2H-perfluorooctyltriethoxysilane. The silane coupling agent may be used in an arbitrary amount, but the fluorine-containing compound is preferably used in an amount of not more than 0.25 times by weight the amount of fluorine-free compounds. If the amount of fluorine-containing compound is more than this upper limit, problems in the film formation properties of the crosslinked film may occur.

An alcohol-soluble resin may be added to the surface protection layer 5 for the purpose of improving properties of the layer such as resistance against electric discharge gas, mechanical strength, scratch resistance or particle dispersibility, as well as controlling the viscosity, decreasing the torque, controlling the abrasion amount, extending the pot life, and the like.

The alcohol-soluble resin here refers to a resin that dissolves in an alcohol having 5 or less carbon atoms, in an amount of 1% or less by weight of the resin. Examples of the alcohol-soluble resin include a polyvinyl butyral resin, a polyvinyl formal resin, a partially-acetalized polyvinyl acetal resin, including those obtained by modifying part of butyral with formal or acetal (for example, S-LEC B and S-LEC K (trade name, manufactured by Sekisui Chemical Co., Ltd.), a polyimide resin, a cellulose resin, and a polyvinyl phenol resin. From the viewpoint of electrical property, a polyvinyl acetal resins and a polyvinyl phenol resin are particularly preferred. The weight-average molecular weight of the alcohol-soluble resin is preferably from 2,000 to 100,000, more preferably from 5,000 to 50,000. If the molecular weight of the resin is less than 2,000, the advantageous effects achieved by the addition of the resin may not be sufficient. If the molecular weight is more than 100,000, the solubility may decrease and the possible addition amount may be limited, and further defective film formation may occur during the application of the composition. The addition amount of the resin is preferably from 1% by weight to 40% by weight, more preferably from 1% by weight to 30% by weight, and even more preferably from 5% by weight to 20% by weight. If the addition amount of the resin is less than 1% by weight, advantageous effects achieved by the addition of the resin may not be sufficient. If the amount is more than 40% by weight, obscure images tend to be formed at high temperature and high humidity (for example, at 28° C. and 85% RH).

It is preferred to add an antioxidant to the surface protection layer 5 to prevent a deterioration thereof by effect of an oxidizing gas generated in the charging unit, such as ozone. As the mechanical strength of the surface of the electrophotographic photoreceptor is increased and the lifespan thereof is extended, the electrophotographic photoreceptor contacts an oxidizing gas for a longer time. Therefore, the electrophotographic photoreceptor needs to have an anti-oxidation property that is higher than that of prior art. The antioxidant is preferably a hindered phenol or a hindered amine antioxidant. Other applicable known antioxidants include organic sulfur antioxidants, phosphite antioxidants, dithiocarbamate antioxidants, thiourea antioxidants, and benzimidazole antioxidants. The addition amount of the antioxidant is preferably 20% by weight or less, more preferably 10% by weight or less.

Examples of the hindered phenol antioxidant include 2,6-di-t-butyl-4-methylphenol, 2,5-di-t-butylhydroquinone, N,N'-hexamethylenebis(3,5-di-t-butyl-4-hydroxyhydrocinnamide), diethyl-3,5-di-t-butyl-4-hydroxy-benzylphosphate, 2,4-bis[(octylthio)methyl]-o-cresol, 2,6-di-t-butyl-4-ethylphenol, 2,2'-methylenebis(4-methyl-6-t-butylphenol), 2,2'-methylenebis(4-ethyl-6-t-butylphenol), 4,4'-butylidenebis(3-methyl-6-t-butylphenol), 2,5-di-t-amylhydroquinone, 2-t-butyl-6-(3-butyl-2-hydroxy-5-methylbenzyl)-4-methylphenyl acrylate, and 4,4'-butylidenebis(3-methyl-6-t-butylphenol).

Examples of commercially available products of the hindered phenol antioxidant include IRGANOX 1076, IRGA- NOX 1010, IRGANOX 1098, IRGANOX 245, IRGANOX 1330, IRGANOX 3114, IRGANOX 1076 (trade name, manufactured by Ciba Japan, K.K.), and 3,5-di-t-butyl-4-hydroxybiphenyl.

Examples of commercially available products of the hindered amine antioxidant include SANOL LS2626, SANOL LS765, SANOL LS770, SANOL LS744 (trade name, manufactured by Ciba Japan, K.K.), TINUVIN 144, TINUVIN 622LD (trade name, manufactured by Ciba Japan, K.K.), MARK LA57, MARK LA67, MARK LA62, MARK LA68, and MARK LA63 (trade name, manufactured by Adeka Corporation). Examples of commercially available products of the thioether antioxidant include SUMILIZER TPS and SUMILIZER TP-D (trade name, manufactured by Sumitomo Chemical Co., Ltd.). Examples of commercially available products of the phosphite antioxidants include MARK 2112, MARK PEP-8, MARK PEP-24G, MARK PEP-36, MARK 329K, and MARK HP-10 (trade name, manufactured by Adeka Corporation).

The surface protection layer 5 may include particles of various kinds for the purpose of lowering the residual potential or improving the strength thereof. One examples of such particles is silicon-containing particles. The silicon-containing particles are particles that contain silicon as a constituting element thereof. Specific examples the silicon-containing particles include colloidal silica and silicone particles. The colloidal silica used as the silicon-containing particles may be selected from those produced by dispersing silica having an average particle size of 1 nm to 100 nm, preferably 10 nm to 30 nm, in an acidic or alkaline aqueous solution or an organic solvent such as alcohol, ketone or ester. Commercially available products may be used as the colloidal silica. The solid content concentration of the colloidal silica in the surface protection layer 5 is not particularly limited, and is from 0.1% by weight to 50% by weight, preferably from 0.1% by weight to 30% by weight, of the total solid content in the surface protection layer 5, from the viewpoint of film-forming properties, electrical properties or strength.

The silicone particles used as the silicon-containing particles may be selected from silicone resin particles, silicone rubber particles, or silicone surface-treated silica particles, and commercially available products thereof are also applicable. These silicone particles have a spherical shape, and the average particle size thereof is preferably from 1 nm to 500 nm, more preferably from 10 nm to 100 nm. The silicone particles are fine particles that are chemically inactive and have an excellent dispersibility in resin. Furthermore, since the content thereof for obtaining sufficient properties is small, these particles can improve the surface characteristics of the electrophotographic photoreceptor without hindering the crosslinking reaction. In other words, the particles can improve lubricity and water repellency of the electrophotographic photoreceptor surface while being evenly included in the strong crosslinked structure, thereby maintaining favorable abrasion resistance and resistance against the adhesion of contaminants. The content of the silicone particles in the surface protection layer 5 is preferably from 0.1% by weight to 30% by weight of the total solid content of the surface protection layer 5, more preferably from 0.5% by weight to 10% by weight thereof.

Other exemplary particles include fluorine-based particles made of ethylene tetrafluoride, ethylene trifluoride, propylene hexafluoride, vinyl fluoride, vinylidene fluoride or the like; particles made of a copolymer of a fluorine-containing resin and a monomer having a hydroxyl group, such as those described in "the 8$^{th}$ Polymer Material Forum, Lecture Proceedings, pp. 89-90"; and particles made of a semiconductive metal oxide, such as $ZnO—Al_2O_3$, $SnO_2—Sb_2O_3$, $In_2O_3—SnO_2$, $ZnO_2—TiO_2$, $ZnO—TiO_2$, $MgO—Al_2O_3$, $FeO—TiO_2$, $TiO_2$, $SnO_2$, $In_2O_3$, ZnO, or MgO. For a similar purpose, an oil such as a silicone oil may be added to the surface protection layer 5. Examples of the silicon oil include dimethylpolysiloxane, diphenylpolysiloxane, and phenylmethylsiloxane, as well as reactive silicone oils such as amino-modified polysiloxane, epoxy-modified polysiloxane, carboxyl-modified polysiloxane, carbinol-modified polysiloxane, methacryloyl-modified polysiloxane, mercapto-modified polysiloxane, and phenol-modified polysiloxane; cyclic dimethylcyclosiloxanes such as hexamethylcyclotrisiloxane, octamethylcyclotetrasiloxane, decamethylcyclopentasiloxane, and dodecamethylcyclohexasiloxane; cyclic methylphenylsiloxane such as 1,3,5-trimethyl-1,3,5-triphenylcyclotrisiloxane, 1,3,5,7-tetramethyl-1,3,5,7-tetraphenylcyclotetrasiloxane, and 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes such as (3,3,3-trifluoropropyl)methylcyclotrisiloxane; hydrosilyl group-containing cyclosiloxanes such as a methylhydrosiloxane mixture, pentamethylcyclopentasiloxane, and phenylhydrocyclosiloxane; and vinyl group-containing cyclosiloxanes such as pentavinylpentamethylcyclopentasiloxane.

Metal, metal oxide, carbon black, or the like may be added to the surface protection layer 5. Examples of the metal include aluminum, zinc, copper, chromium, nickel, silver, stainless steel, and plastic particles on which the above metal is evaporated. Examples of the metal oxide include zinc oxide, titanium oxide, tin oxide, antimony oxide, indium oxide, bismuth oxide, indium oxide doped with tin, tin oxide doped with antimony or tantalum, and zirconium oxide doped with antimony. These metals or metal oxides may be used alone or in combination of two or more kinds thereof. When two or more kinds are used in combination, these two may be simply mixed or form a solid solution, or may be fused together. The average particle size of the electroconductive particles is preferably 0.3 μm or less, particularly preferably 0.1 μm or less, from the viewpoint of transparency of the surface protection layer.

In the surface protection layer 5, a curing catalyst may be used to promote the curing of the guanamine compound (compound represented by formula (A)) and/or the melamine compound (compound represented by formula (B)), or the specific charge transporting material. An acid-based curing catalyst is preferably used as the curing catalyst. Examples of the acid-based catalyst include aliphatic carboxylic acids such as acetic acid, chloroacetic acid, trichloroacetic acid, trifluoroacetic acid, oxalic acid, maleic acid, malonic acid, and lactic acid; aromatic carboxylic acids such as benzoic acid, phthalic acid, terephthalic acid, and trimellitic acid; and aliphatic or aromatic sulfonic acids such as methanesulfonic acid, dodecylsulfonic acid, benzenesulfonic acid, dodecylbenzenesulfonic acid, and naphthalenesulfonic acid. A sulfur-containing material is preferably used as the curing catalyst.

When a sulfur-containing material is used as the curing catalyst, this sulfur-containing material exhibits excellent functions as a curing catalyst with respect to the guanamine compound (compound represented by formula (A)) and/or the melamine compound (compound represented by formula (B)), or the specific charge transporting material. As a result, the mechanical strength of the resultant surface protection layer 5 can be further improved by the promoted curing reaction. Moreover, when a compound represented by formula (I) (including formula (II)) is used as the charge transporting material, the sulfur-containing material also exhibits excellent functions as a dopant for the charge transporting material, thereby further improving the electrical properties of the resultant functional layer. As a result, an electrophotographic photoreceptor having excellent mechanical strength, film-formability and electrical properties may be obtained.

The sulfur-containing material that may be used as the curing catalyst is preferably a material that exhibits acidity at room temperature (for example, at 25° C.) or after being heated, and an organic sulfonic acid or a derivative thereof is particularly preferred from the viewpoint of adhesiveness, anti-ghost properties or electrical properties. The presence of the catalyst in the surface protection layer 5 may be readily determined by XPS or the like.

Examples of the organic sulfonic acid or the derivative thereof include p-toluenesulfonic acid, dinonylnaphthalenesulfonic acid (DNNSA), dinonylnaphthalenedisulfonic acid (DNNDSA), dodecylbenzenesulfonic acid, and phenolsulfonic acid. Among these compounds, p-toluenesulfonic acid and dodecylbenzenesulfonic acid are preferable from the viewpoint of catalytic power or film formation properties. A salt of an organic sulfonic acid may also be used, as far as the salt is dissociated to some degree in the curable resin composition.

Further, in the case of using a so-called thermally latent catalyst, which increases its catalytic power upon application of heat of a certain degree, the catalytic power remains low at a temperature for storing the composition, while being high at the time of curing. Therefore, reduction in curing temperature and improvement in storage stability can be achieved at the same time.

Examples of the thermally latent catalyst include microcapsules including an organic sulfonic compound or the like in the form of particles, a porous material such as zeolite to which an acid or the like is adsorbed, a thermally latent protonic acid catalyst in which the protonic acid and/or a derivative thereof is blocked with a base, a catalyst in which a protonic acid and/or a derivative thereof is esterified with a primary or secondary alcohol, a catalyst in which a protonic acid and/or a protonic acid derivative is blocked with a vinyl ether and/or a vinyl thioether, a monoethylamine complex of boron trifluoride, or a pyridine complex of boron trifluoride.

Among these thermally latent catalysts, a catalyst in which a protonic acid and/or a derivative thereof is blocked with a base is preferred, from the viewpoint of catalytic power, storage stability, availability, cost or the like.

Examples of the protonic acid of the thermally latent protonic acid catalyst include sulfuric acid, hydrochloric acid, acetic acid, formic acid, nitric acid, phosphoric acid, sulfonic acid, monocarboxylic acids, polycarboxylic acids, propionic acid, oxalic acid, benzoic acid, acrylic acid, methacrylic acid, itaconic acid, fumaric acid, maleic acid, benzenesulfonic acid, o, m and p-toluenesulfonic acids, styrenesulfonic acid, dinonylnaphthalenesulfonic acid, dinonylnaphthalenedisulfonic acid, decylbenzenesulfonic acid, undecylbenzenesulfonic acid, tridecylbenzenesulfonic acid, tetradecylbenzenesulfonic acid, and dodecylbenzenesulfonic acid. Examples of the protonic acid derivative include a neutralized product of an alkali metal salt, an alkaline earth metal salt or the like of a protonic acid such as sulfonic acid or phosphoric acid, and a polymer compound having a polymer chain to which a protonic acid skeleton is introduced (such as polyvinylsulfonic acid). Examples of the base that blocks the protonic acid include amines.

Amines include primary amines, secondary amities and tertiary amines, and any of these may be without being particularly limited.

Examples of the primary amine include methylamine, ethylamine, propylamine, isopropylamine, n-butylamine, isobutylamine, t-buytlamine, hexylamine, 2-ethylhexylamine, sec-butylamine, allylamine, and methylhexylamine.

Examples of the secondary amine include dimethylamine, diethylamine, di-n-propylamine, diisopropylamine, di-n-butylamine, diisobutylamine, di-t-buytlamine, dihexylamine, di(2-ethylhexyl)amine, N-isopropyl-N-isobutylamine, di(2-ethylhexyl)amine, di-sec-butylamine, diallylamine, N-methylhexylamine, 3-pipecoline, 4-pipecoline, 2,4-lupetidine, 2,6-lupetidine, 3,5-lupetidine, morpholine, and N-methylbenzylamine.

Examples of the tertiary amine include trimethylamine, triethylamine, tri-n-propylamine, triisopropylamine, tri-n-butylamine, triisobutylamine, tri-t-butylamine, trihexylamine, tri(2-ethylhexyl)amine, N-methylmorpholine, N,N-dimethylallylamine, N-methyldiallylamine, triallylamine, N,N-dimethylallylamine, N,N,N',N'-tetramethyl-1,2-diaminoethane, N,N,N',N'-tetramethyl-1,3-diaminopropane, N,N,N','-tetraallyl-1,4-diaminobutane, N-methylpiperidine, pyridine, 4-ethylpyridine, N-propyldiallylamine, 3-dimethylaminopropanol, 2-ethylpyrazine, 2,3-dimethylpyrazine, 2,5-dimethylpyrazine, 2,4-lutidine, 2,5-lutidine, 3,4-lutidine, 3,5-lutidine, 2,4,6-collidine, 2-methyl-4-ethylpyridine, 2-methyl-5-ethylpyridine, N,N,N',N'-tetramethylhexamethylenediamine, N-ethyl-3-hydroxypiperidine, 3-methyl-4-ethylpyridine, 3-ethyl-4-methylpyridine, 4-(5-nonyl)pyridine, imidazole, and N-methylpiperazine.

Examples of commercially available products of the thermally latent catalyst include NACURE 2501 (p-toluenesulfonic acid dissociation, solvent: methanol/isopropanol, pH: 6.0 to 7.2, dissociation temperature: 80° C.), NACURE 2107 (p-toluenesulfonic acid dissociation, solvent: isopropanol, pH: 8.0 to 9.0, dissociation temperature: 90° C.), NACURE 2500 (p-toluenesulfonic acid dissociation, solvent: isopropanol, pH: 6.0 to 7.0, dissociation temperature: 65° C.), NACURE 2530 (p-toluenesulfonic acid dissociation, solvent: methanol/isopropanol, pH: 5.7 to 6.5, dissociation temperature: 65° C.), NACURE 2547 (p-toluenesulfonic acid dissociation, solvent: water, pH: 8.0 to 9.0, dissociation temperature: 107° C., NACURE 2558 (p-toluenesulfonic acid dissociation, solvent: ethylene glycol, pH: 3.5 to 4.5, dissociation temperature: 80° C.), NACURE XP-357 (p-toluenesulfonic acid dissociation, solvent: methanol, pH: 2.0 to 4.0, dissociation temperature: 65° C.), NACURE XP-386 (p-toluenesulfonic acid dissociation, solvent: water, pH: 6.1 to 6.4, dissociation temperature: 80° C., NACURE XC-2211 (p-toluenesulfonic acid dissociation, pH: 7.2 to 8.5, dissociation temperature: 80° C.), NACURE 5225 (dodecylbenzenesulfonic acid dissociation, solvent: isopropanol, pH: 6.0 to 7.0, dissociation temperature: 120° C., NACURE 5414 (dodecylbenzenesulfonic acid dissociation, solvent: xylene, dissociation temperature: 120° C.), NACURE 5528 (dodecylbenzenesulfonic acid dissociation, solvent: isopropanol, pH: 7.0 to 8.0, dissociation temperature: 120° C., NACURE 5925 (dodecylbenzenesulfonic acid dissociation, pH: 7.0 to 7.5, dissociation temperature: 130° C., NACURE 1323 (dinonylnaphthalenesulfonic acid dissociation, solvent: xylene, pH: 6.8 to 7.5, dissociation temperature: 150° C., NACURE 1419 (dinonylnaphthalenesulfonic acid dissociation, solvent: xylene/methyl isobutyl ketone, dissociation temperature: 150° C., NACURE 1557 (dinonylnaphthalenesulfonic acid dissociation, solvent: butanol/2-butoxyethane, pH: 6.5 to 7.5, dissociation temperature: 150° C.), NACURE 49-110 (dinonylnaphthalenedisulfonic acid dissociation, solvent: isobutanol/isopropanol, pH: 6.5 to 7.5, dissociation temperature: 90° C., NACURE 3525 (dinonylnaphthalenedisulfonic acid dissociation, solvent: isobutanol/isopropanol, pH: 7.0 to 8.5, dissociation temperature: 120° C.), NACURE XP-383 (dinonylnaphthalenedisulfonic acid dissociation, solvent: xylene, dissociation temperature: 120° C.), NACURE 3327 (dinonylnaphthalenedisulfonic acid dissociation, solvent: isobutanol/isopropanol, pH: 6.5 to 7.5, dissociation temperature: 150° C.), NACURE 4167" (phosphoric acid dissociation, solvent: isopropanol/isobutanol, pH: 6.8 to 7.3, dissociation temperature: 80° C.), NACURE XP-297 (phosphoric acid dissociation, solvent: water/isoptropanol, pH: 6.5 to 7.5, dissociation temperature: 90° C.), and NACURE 4575 (phosphoric acid dissociation, pH: 7.0 to 8.0, dissociation temperature: 110° C.). The above products are described by trade names, and are manufactured by King Industries, Inc. These thermally latent catalysts may be used alone or in combination of two or more thereof.

The blend proportion of the catalyst is preferably from 0.1% by weight to 50% by weight of the amount (solid content) of at least one selected from a guanamine compound (compound represented by formula (A)) and a melamine compound (a compound represented by formula (B)), particularly preferably from 10% by weight to 30% by weight thereof. When this blend proportion is less than the above range, the catalyst activity may be too low. If the blend proportion is more than the above range, the light resistance may not be sufficient. The light resistance refers to resistance against reduction in image density at a portion of the photosensitive layer exposed to light from outside, such as indoor light. Although the reason for this is not clear, it is presumed to be due to occurrence of a phenomenon similar to an optical memory effect, as discussed in JP-A No. 5-099737.

The surface protection layer 5 having the above-mentioned structure is formed by use of a coating liquid for forming the surface protection layer that contains, as essential components, at least one selected from a guanamine compound (compound represented by formula (A)) and a melamine compound (compound represented by formula (B)), and at least one specific charge transporting material. As necessary, the composition for forming the surface protection layer 5 may include a further component that constitutes the surface protection layer 5.

The composition for forming the surface protection layer 5 may be prepared without using a solvent, or may be prepared using a solvent, for example, an alcohol such as methanol, ethanol, propanol or butanol, a ketone such as acetone or methyl ethyl ketone, or an ether such as tetrahydrofuran, diethylether or dioxane. These solvents may be used alone or in combination of two or more kinds. The solvent is preferably a solvent having a boiling point of not more than 100° C. It is particularly advisable to use, as the solvent, at least one solvent having a hydroxyl group (for example, an alcohol).

The amount of the solvent may be set at an arbitrary value, but if the amount is too small, the guanamine compound (compound represented by formula (A)) and/or the melamine compound (compound represented by formula (B)) tend to precipitate. Thus, the amount of the solvent is preferably from 0.5 parts by weight to 30 parts by weight, more preferably from 1 part by weight to 20 parts by weight, with respect to 1 part by weight of the guanamine compound and/or the melamine compound.

When the coating composition is obtained by allowing the above components to react with each other, the components may be simply mixed with each other and dissolved in the reaction system. The components may be heated to a range of from room temperature (for example, 25° C.) to 100° C., preferably from 30° C. to 80° C. for 10 minutes to 100 hours, preferably 1 hour to 50 hours. It is also preferable to apply ultrasonic waves thereto at this time. In this way, it is presumed that partial reaction proceeds, thereby facilitating the formation of a film having less defects or less unevenness in thickness.

The coating composition for surface protection layer is then applied onto the charge transporting layer 3 by an ordinary method, such as blade coating, Meyer bar coating, spray coating, dip coating, bead coating, air knife coating or curtain coating and, as necessary, the resultant is heated to cure at a temperature of 100° C. to 170° C., for example. The surface protection layer 5 is thus obtained.

The film thickness of the surface protection layer 5 is preferably from 1 μm to 15 μm, more preferably from 3 μm to 10 μM.

<Electroconductive Substrate>

Examples of the material for the electroconductive substrate 4 include a metallic plate, a metallic drum or a metallic belt made of a metal, such as aluminum, copper, zinc, stainless steel, chromium, nickel, molybdenum, vanadium, indium, gold or platinum, or an alloy of these metals, a paper sheet, a plastic film or a belt onto which the following material is painted, evaporated or laminated: an electroconductive compound such as an electroconductive polymer or indium oxide, a metal such as aluminum, palladium or gold, or an alloy of these metals. The term "electroconductive" here refers to having a volume resistivity of less than $10^{13}$ Ωcm.

When the electrophotographic photoreceptor 1A is used in a laser printer, it is preferred to roughen the surface of the electroconductive substrate 4 to have a centerline average roughness Ra of 0.04 μm to 0.5 μM, in order to prevent interference fringes generated upon irradiation with laser beam. If Ra is less than 0.04 μm, effects of preventing interference may not be sufficient due to the surface being close to a mirror surface. If Ra is more than 0.5 μm, the image texture may be coarse even when a coating film is formed thereon. When incoherent light is used as the light source, there is no particular need to roughen the surface in order to prevent occurrence of interference fringes. Therefore, formation of defects due to the irregularities on the surface of the electroconductive substrate 4 may be suppressed, and the lifespan thereof may be further extended.

Preferred examples of the roughening method include wet honing, which is performed by blowing a suspension including an abrasive agent suspended in water onto the electroconductive substrate 4 surface, centerless grinding, which is performed by pressing the substrate (support) against a rotating grinding stone to perform a polishing process in a continuous manner, and anodic oxidation.

Other preferred examples thereof include a method of dispersing electroconductive or semiconductive powder in a resin, and forming a layer therefrom on the electroconductive substrate, without roughening the surface of the electroconductive substrate 4 surface by itself.

The surface roughening treatment employing anodic oxidation is performed by forming an oxide film on an aluminum surface, by using the aluminum as an anode to perform anodic oxidation in an electrolytic solution. Examples of the electrolytic solution include a sulfuric acid solution and an oxalic acid solution. However, since the anodic oxide film formed by anodic oxidation having a porous structure is chemically active as it is, it is easily contaminated and the resistance thereof is variable depending on the surrounding environment. Therefore, the film is preferably subjected to a pore-closing treatment for closing the fine pores formed in the anodic oxide film by means of volume expansion due to hydration reaction in pressured water vapor or boiling water (a metal salt of nickel or the like may be added therein), thereby converting the oxide to a more stable hydrated oxide.

The film thickness of the anodic oxide film is preferably from 0.3 μm to 15 μm. If this film thickness is less than 0.3 μm, the barrier performances against injection may be poor and a sufficient effect may not be achieved. On the other hand, if the thickness is more than 15 μm, the remaining potential tends to increase as a result of repetitive use of the electrophotographic photoreceptor.

The electroconductive substrate 4 may be subjected to treatment with an acidic aqueous solution or a boehmite treatment. The treatment with an acidic aqueous solution may be, for example, a treatment with an acidic treatment liquid containing phosphoric acid, chromic acid, hydrofluoric acid. The treatment with an acidic treating liquid containing phosphoric acid, chromic acid, hydrofluoric acid is conducted in the following manner. First, the acidic treatment liquid is prepared. The concentrations of phosphoric acid, chromic acid and hydrofluoric acid in the acidic treatment liquid are preferably from 10% by weight to 11% by weight, from 3% by weight to 5% by weight, and from 0.5% by weight to 2% by weight, respectively, and the total concentration of these acids is preferably from 13.5% by weight to 18% by weight. The treatment temperature is preferably from 42° C. to 48° C. By maintaining the treatment temperature at a higher level, a thicker film may be formed faster as compared with the case where the treatment temperature is lower. The thickness of the film is preferably from 0.3 μm to 15 μm. If the thickness is less than 0.3 μm, the barrier performance against injection may be poor and sufficient effects may not be achieved. On the other hand, if the thickness is more than 15 μm, the remaining potential tends to increase due to the repetitive use of the electrophotographic photoreceptor.

The boehmite treatment may be conducted by immersing the substrate 4 in pure water of 90° C. to 100° C. for 5 minutes to 60 minutes, or by contacting the substrate 4 with heated water vapor of from 90° C. to 120° C. for 5 minutes to 60 minutes. The thickness of the film is preferably from 0.1 μm to 5 μm. The film may be further subjected to an anodic oxidation treatment using a solution of an electrolyte having a relatively lower ability of dissolving the film, such as adipic acid, boric acid, a borate, a phosphate, a phthalate, a maleate, a benzoate, a tartarate, a citrate, or the like.

<Undercoating Layer>

The undercoating layer 1 may be formed from, for example, a binder resin containing inorganic particles. The inorganic particles preferably have a powder resistance (volume resistivity) of $10^2$ Ωcm to $10^{11}$ Ωcm, since the undercoating layer 1 needs to have a resistance that is appropriate for gaining leakage resistance and carrier-blocking performances. If the value of resistance of the inorganic particles is lower than the above range, sufficient leakage resistance may not be obtained. If the value of resistance is higher than the above range, increase in the residual potential may be caused.

The inorganic particles having a resistance value within the above range are preferably inorganic particles made of tin oxide, titanium oxide, zinc oxide or zirconia oxide (electroconductive metal oxide), and are particularly preferably zinc oxide particles.

The inorganic particles may be surface-treated particles, or may be a mixture of two or more kinds of particles which are subjected to different surface treatments or have different particle sizes. The volume-average particle size of the inorganic particles is preferably from 50 nm to 2000 nm, more preferably from 60 μm to 1000 nm.

The inorganic particles preferably have a specific surface area according to a BET method of 10 $m^2/g$ or more. Inorganic particles having a specific surface area of less than 10 $m^2/g$ may easily cause reduction in chargeability, so it may be difficult to obtain favorable electrophotographic properties.

Further, by including an acceptor compound together with the inorganic particles in the binder resin, an undercoating layer having electrical properties or carrier-blocking performances that remain stable for a long period of time.

The acceptor compound may be any acceptor compound as long as it achieves preferred characteristics. Preferable examples thereof include electron transporting materials, including quinone compounds such as chloranil and bromoanil, tetracyanoquinodimetane compounds, fluorenone compounds such as 2,4,7-trinitrofluorenone and 2,4,5,7-tetranitro-9-fluorenone, oxadiazole compounds such as 2-(4-biphenyl)-5-(4-t-butylphenyl)-1,3,4-oxadiazole, 2,5-bis(4-naphthyl)-1,3,4-oxadiazole and 2,5-bis(4-diethylarsinophenyl)-1,3,4-oxadiazole, xanthone compounds, thiophene compounds, and diphenoquinone compounds such as 3,3',5,5'-tetra-t-butyldiphenoquinone. In particular, compounds having an anthraquinone structure are preferable. Furthermore, acceptor compound having an anthraquinone structure are preferably used, and examples thereof include hydroxyanthraquinone compounds, aminoanthraquinone compounds, and aminohydroxyanthraquinone compounds. Specific examples thereof include anthraquinone, alizarin, quinizarin, anthrarufin, and purpurin.

The content of the acceptor compound may be arbitrarily set as far as the preferred characteristics can be obtained, but is preferably from 0.01% by weight to 20% by weight with respect to the inorganic particles. In order to prevent the accumulation of charges and the aggregation of the inorganic particles, the above content is preferably from 0.05% by weight to 10% by weight. The aggregation of the inorganic particles may cause uneven formation of electroconductive paths, which may result in deterioration in maintainability such as increased residual potential upon repeated use, or may easily cause image defects such as black spots.

The acceptor compound may be added to the composition for forming the undercoating layer at the time of applying the same, or may be previously attached to the surface of inorganic particle. The method for attaching the acceptor compound to the surface of inorganic particle may be either a dry method or a wet method.

When the surface treatment is conducted by a dry method, the acceptor compound, by itself or dissolved in an organic solvent, is dropped and sprayed onto the inorganic particles with a dry air or a nitrogen gas, while the inorganic particles are stirred by a mixer or the like having a large sharing force. The dropping or spraying is preferably performed at a temperature lower than the boiling point of the solvent. If the spraying is performed at a temperature of not less than the boiling point of the solvent, the solvent may evaporate before the particles are evenly stirred, and it may be difficult to uniformly perform the treatment due to the local solidification of the acceptor compound. After the dropping or spraying, the particles may be baked at a temperature of 100° C. or higher. The time and temperature for the baking may be arbitrarily selected, as far as the preferred electrophotographic properties can be obtained.

When the surface treatment is performed by a wet method, the inorganic particles are stirred in a solvent and dispersed using a sand mill, an attritor, or a ball mill or the like, adding the acceptor compound therein and further stirring or dispersing, and then removing the solvent. In this way, the treatment can be uniformly performed. The solvent can be removed by filtration or distillation. After the removal of the solvent, the inorganic particles may be baked at a temperature of 100° C. or higher. The time and temperature for the baking may be arbitrarily selected, as far as the preferred electrophotographic properties can be obtained. In the wet method, the moisture contained in the inorganic particles may be removed prior to adding the surface treatment agent, for example, by heating the inorganic particles while stirring in the solvent used for the surface treatment, or by performing azeotropic removal with the solvent.

The inorganic particles may be subjected to the surface treatment prior to the addition of the acceptor compound. The surface treatment agent may be selected from known materials as far as the preferred characteristics can be obtained, and examples thereof include silane coupling agents, titanium-based coupling agents, aluminum-based coupling agents, and surfactants. In particular, a silane coupling agent is preferable since it imparts favorable electrophotographic properties to the inorganic particles. A silane coupling agent having an amino group is preferably used since it imparts a favorable blocking performance to the undercoating layer 1.

The silane coupling agent having an amino group may be any agent as far as it can impart preferred electrophotographic properties to the inorganic particles. Specific examples thereof include, but not limited thereto, γ-aminopropyltriethoxysilane, N-β-(aminoethyl)-γ-aminopropyltrimethoxysilane, N-β-(aminoethyl)-γ-aminopropylmethylmethoxysilane, and N,N-bis(β-hydroxyethyl)-γ-aminopropyltriethoxysilane. The silane coupling agent may be used in combination of two or more kinds thereof. Examples of the silane coupling agent that may be used together with the silane coupling agent having an amino group include vinyltrimethoxysilane, γ-methacryloxypropyltris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane. However, the invention is not limited thereto.

The surface treatment using the aforementioned surface treatment agent may be conducted by any known method, preferably by a dry method or a wet method. The addition of the acceptor compound and the surface treatment using the coupling agent or the like may be simultaneously conducted.

The amount of the silane coupling agent with respect to the inorganic particles in the undercoating layer 1 may be arbitrarily selected, as far as the preferred electrophotographic properties can be obtained, but is preferably from 0.5% by weight to 10% by weight with respect to the inorganic particles, from the viewpoint of improving the dispersibility of the particles.

The binder resin contained in the undercoating layer 1 may be any known binder resin that forms a film of favorable quality, and imparts the preferred characteristics thereto. Examples of the binder resin include polymeric resin compounds, including acetal resins such as polyvinyl butyral resin, polyvinyl alcohol resin, casein, polyamide resin, cellulose resin, gelatin, polyurethane resin, polyester resin, methacrylic resin, acrylic resin, polyvinyl chloride resin, polyvinyl acetate resin, vinyl chloride/vinyl acetate/maleic anhydride resin, silicone resin, silicone-alkyd resin, phenol resin, phenol/formaldehyde resin, melamine resin and urethane resin; charge transporting resins having a charge transporting group; and electroconductive resins such as polyaniline. Among these resins, those insoluble in the composition for forming the layer formed on the undercoating layer 1 are preferred, and phenol resin, phenol/formaldehyde resin, melamine resin, urethane resin, epoxy resin, and the like are particularly preferably used. When these resins are used in combination of two or more kinds, the blend ratio thereof may be selected as necessary.

The quantity ratio between the inorganic particles treated with the acceptor compound (metal oxide imparted with an acceptor property) to the binder resin, or the quantity ratio of the inorganic particles to the binder resin, may be arbitrarily selected as far as the preferred electrophotographic photoreceptor characteristics can be obtained.

Various kinds of additive may be used in the undercoating layer 1, for the purpose of improving the electrical properties, environment stability, and image quality. The additives may be any known material such as an electron transporting pigment of polycondensed ring type or azo type, a zirconium chelate compound, a titanium chelate compound, an aluminum chelate compound, a titanium alkoxide compound, an organic titanium compound, and a silane coupling agent. A silane coupling may be further added to the composition for forming the undercoating layer as an additive, in addition to using the same for surface treatment of the inorganic particles, as described above.

Specific examples of the silane coupling agent that may be used as an additive include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane.

Examples of the zirconium chelate compound include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compound include tetraisopropyl titanate, tetra-n-butyl titanate, butyl titanate dimer, tetra(2-ethylhexyl)titanate, titanium acetylacetonate, polytitanium acetyl acetonate, titanium octylene glycolate, an ammonium salt of titanium lactate, titanium lactate, an ethyl ester of titanium lactate, titanium triethanol aminate, and polyhydroxytitanium stearate.

Examples of the aluminum chelate compound include aluminum isopropylate, monobutoxy aluminum diopropylate, aluminum butylate, ethyl acetoacetate aluminum diisopropylate, and aluminum tris(ethyl acetoacetate).

These compounds may be used alone, or in the form of a mixture of two or more kinds, or in the form of a polycondensation product formed from two or more kinds.

The solvent for preparing the coating composition for forming the undercoating layer may be arbitrarily selected from known organic solvents, such as alcohol solvents, aromatic solvents, halogenated hydrocarbon solvents, ketone solvents, ketone alcohol solvents, ether solvents, and ester solvents. The solvent may be an ordinary organic solvent, and specific examples thereof include methanol, ethanol, n-propanol, iso-propanol, n-butanol, benzyl alcohol, methylcellosolve, ethylcellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

These solvents may be used alone or in the form of a mixture of two or more kinds. When two or more kinds of solvent are used in combination, the solvents may be arbitrarily selected as long as the mixture thereof can dissolve the binder resin.

During the preparation of the composition for forming the undercoating layer, the inorganic particles can be dispersed by a known method using a roll mill, a ball mill, a vibration ball mill, an attriter, a sand mill, a colloid mill, a paint shaker, or the like.

The coating for forming the undercoating layer 1 may be conducted by any ordinary method, such as blade coating, wire bar coating, spray coating, dip coating, bead coating, air-knife coating, or curtain coating.

The undercoating layer 1 is formed on the electroconductive substrate by using the coating composition for forming the undercoating layer as prepared above.

The Vickers hardness of the undercoating layer 1 is preferably 35 or more.

The thickness of the undercoating layer 1 may be arbitrarily selected as far as the preferred characteristics can be obtained. The thickness is preferably 15 μm or more, more preferably from 15 μm to 50 μm.

If the thickness of the undercoating layer 1 is less than 15 μm, a sufficient leakage resistance may not be obtained. On the other hand, if the thickness is more than 50 μm, the residual potential tends to remain when the photoreceptor is used over a long period of time, thereby causing troubles in image density.

The surface roughness (ten-point average roughness) of the undercoating layer 1 is adjusted to the range of from $\frac{1}{4}\times n\times\lambda$ of the wavelength $\lambda$ of a used laser (n is a refractive index of the layer formed on the undercoating layer 1) to $\frac{1}{2}\times\lambda$, in order to prevent Moire fringes.

Particles made of a resin or the like may be added to the undercoating layer for the purpose of adjusting the surface roughness. Examples of the resin particles include silicon resin particles, and crosslinked polymethyl methacrylate resin particles.

Preferably, the undercoating layer includes a binder resin and an electroconductive metal oxide, and has a light transmittance with respect to light having a wavelength of 950 nm of 40% or less (preferably from 10% to 35%, more preferably from 15% to 30%) at a thickness of 20 μm. In order to extend the life span of an electrophotographic photoreceptor, a high degree of image quality needs to be maintained in a stable manner. Similar properties are preferred also in the case of using a crosslinked outermost layer (i.e., the surface protection layer in the present exemplary embodiment). When a crosslinked outermost layer is used, an acid catalyst is often used for the purpose of curing the layer. The larger the amount of the acid catalyst used with respect to the solid content concentration of the outermost layer, the stronger the obtained film can be, thereby improving the printing resistance thereof and extending the lifespan thereof. On the other hand, the acid catalyst remaining in the bulk may serve as a trap site for charges, thereby lowering the resistance to light fatigue and causing irregularities in image density as a result of exposure to light during maintenance or the like. This resistance (light fatigue resistance) may be improved to a tolerable level for practical applications, by optimizing the amounts of the materials (in particular, the charge transporting material and the acid catalyst), however, it may not be sufficient with respect to exposure to light in an environment brighter than ordinary offices, such as showrooms, or with respect to exposure to highly bright light over a long period of time, for example, during inspection for alien substances adhered to the surface of the electrophotographic photoreceptor. Therefore, while there is a need to increase the amount of the curing catalyst in order to increase the film strength, a sufficient light resistance may not be achieved. In this regard, by providing an undercoating layer having a light transmittance that is as low as that as specified above, the undercoating layer absorbs light to which the electrophotographic photoreceptor is exposed, and an image having a favorable resistance against light with high intensity can be obtained in a stable manner, over a long term. In other words, since the light reflected on the surface of the electroconductive substrate is decreased, the photoreceptor having a resistance (light fatigue resistance) with respect to exposure to highly bright light over a long period can be obtained, and the lifespan thereof can be extended even when the strength of the outermost layer (surface protection layer) is increased to improve the printing resistance by increasing the amount of curing catalyst.

The light transmittance of the undercoating layer can be measured as follows. A coating composition for forming the undercoating layer is applied onto a glass plate to form a film having a thickness of 20 μm (after being dried). After drying the film, the light transmittance of the same at a wavelength of 950 nm is measured using a spectrophotometer (trade name: SPECTROPHOTOMETER U-2000, manufactured by Hitachi Ltd.)

The light transmittance of the undercoating layer may be controlled by adjusting the time period for dispersing the particles using a roll mill, a ball mill, a vibration ball mill, an attriter, a sand mill, a colloid mill, a paint shaker, or the like. The time period for dispersing is not particularly limited, but is preferably selected from 5 minutes to 1,000 hours, more preferably from 30 minutes to 10 hours. As the time period for dispersing is increased, the light transmittance tends to be decreased.

The undercoating layer surface may be polished to adjust the surface roughness thereof. The polishing may be performed by buff polishing, sandblast treatment, wet honing, grinding treatment, or the like.

The undercoating layer 1 can be obtained by applying the aforementioned composition for forming the undercoating layer onto the electroconductive substrate 4, and then drying the same. The drying is typically conducted at a temperature at which a film can be formed and the solvent can evaporate.

<Charge Generating Layer>

The charge generating layer 2 includes a charge generating material and a binder resin.

Examples of the charge generating material include azo pigments such as bisazo and trisazo pigments, aromatic condensed ring pigments such as dibromoanthanthrone, perylene pigments, pyrrolopyrrole pigments, phthalocyanine pigments, zinc oxide, and trigonal selenium. Among these materials, metal or metal-free phthalocyanine pigments are preferable with respect to exposure to near-infrared laser beam. More preferable are hydroxygalliumphthalocyanines disclosed in JP-A No. 5-263007, JP-A No. 5-279591, or the like, chlorogalliumphthalocyanines disclosed in JP-A No. 5-98181 or the like, dichlorotinphthalocyanines disclosed in JP-A No. 5-140472, JP-A No. 5-140473, or the like, and titanylphthalocyanines disclosed in JP-A No. 4-189873, or the like. With respect to exposure to near-ultraviolet laser beam, aromatic condensed ring pigments such as dibromoanthanthrone, thioindigo pigments, porphyrazine compounds, zinc oxide, trigonal selenium, and the like are preferable.

When a light source of a wavelength in a range of 380 nm to 500 μm is used, an inorganic pigment is preferable. When a light source of a wavelength in a range of 700 nm to 800 nm is used, a metal or metal-free phthalocyanine pigment is preferable.

It is preferable to use, as the charge generating material, a hydroxygalliumphthalocyanine pigment having a maximum peak wavelength in the range of 810 nm to 839 μm in its spectroscopic absorption spectrum over the wavelength region of 600 nm to 900 nm. The hydroxygalliumphthalocyanine pigment of this kind differs from other conventional V-type hydroxygalliumphthalocyanine pigments in that it exhibits a superior dispersibility. By shifting the maximum peak wavelength in the spectroscopic absorption spectrum to the shorter side as compared with that of conventional V-type hydroxygalliumphthalocyanine pigments, a hydroxygalliumphthalocyanine pigment having a fine structure with an appropriately controlled crystalline alignment can be obtained. By using such a pigment as a material of the electrophotographic photoreceptor, excellent dispersibility and sufficient sensitivity, chargeability and dark decay property can be obtained.

The hydroxygalliumphthalocyanine pigment having a maximum peak wavelength in the range of 810 nm to 839 nm preferably has an average particle size within a specified range, and a BET specific surface area within a specified range. Specifically, the above average particle size is preferably 0.20 μm or less, more preferably from 0.01 μm to 0.15 μm. The BET specific surface area is preferably 45 $m^2/g$ or more, more preferably 50 $m^2/g$ or more, and particularly preferably from 55 $m^2/g$ to 120 $m^2/g$. The average particle size here refers to a volume average particle size (d50 average particle size) as measured by using a laser diffraction scattering particle size distribution meter (trade name: LA-700, manufactured by Horiba Ltd.) The BET specific surface area here is measured by using a BET specific surface area meter (trade name: FLOWSORB II2300, manufactured by Shimadzu Corp.) by a nitrogen-substitution method.

If the average particle size is larger than 0.20 μm or the BET specific surface area is less than 45 $m^2/g$, it indicates that coarse pigment particles are formed or an aggregation of the pigment particles is formed. As a result, defects in dispersibility when used as a material for the electrophotographic photoreceptor, sensitivity, chargeability or dark decay property tend to occur, thereby easily impairing image quality.

The maximum particle size (i.e., the maximum primary particle size) of the above hydroxygalliumphthalocyanine pigment is preferably 1.2 μm or less, more preferably 1.0 μm or less, and even more preferably 0.3 μm or less. If the maximum particle size is greater than the above range, fine black spots tend to be formed.

In order to suppress the irregular density due to exposure to a fluorescent lamp or the like more effectively, the hydroxygalliumphthalocyanine pigment preferably has an average particle size of 0.2 μm or less, a maximum particle size of 1.2 μm or less, and a BET specific surface area of 45 $m^2/g$ or more.

The hydroxygalliumphthalocyanine pigment preferably has diffraction peaks at Bragg angles (2θ±0.2°) of 7.5°, 9.9°, 12.5°, 16.3°, 18.6°, 25.1° and 28.3°, in its X-ray diffraction spectrum obtained from CuKα characteristic X-rays.

Further, the above hydroxygalliumphthalocyanine pigment preferably has a thermogravimetric loss ratio while increasing the temperature from 25° C. to 400° C. of from 2.0% to 4.0%, more preferably from 2.5% to 3.8%. The thermogravimetric loss ratio can be measured by using a thermobalance or the like. If the thermogravimetric loss ratio is more than 4.0%, impurities contained in the hydroxygalliumphthalocyanine pigment may affect the electrophotographic photoreceptor to cause degradation in sensitivity, potential stability during repeated use, or image quality. If the above ratio is less than 2.0%, degradation in sensitivity may occur. The reason for this is thought to be that the hydroxygalliumphthalocyanine pigment interacts with a trace amount of molecules of the solvent contained in the crystal, and exhibits a sensitizing effect.

The above hydroxygalliumphthalocyanine pigment, when used as a charge generating material of the electrophotographic photoreceptor, is particularly effective in that an optimal sensitivity and excellent photoelectrical properties of the photoreceptor can be obtained, and that the charge generating material exhibits excellent dispersibility in the binder resin in the photoreceptor layer, thereby achieving excellent image quality.

It has been known that by specifying the average particle size and the BET specific surface area of a hydroxygalliumphthalocyanine pigment, generation of fogging or black dots can be suppressed; however, there has been a problem in that fogging or black dots occurs after the use for a long time. In this regard, by using a surface protection layer that satisfies each of the above requirements (1) to (3) as an outermost layer, generation of fogging or black dots due to the long-term use can be suppressed as compared with the case in which a conventional outermost layer and a charge generating are used in combination. The reason for this is thought to be that the use of the protection layer suppresses abrasion of the film or decrease in chargeability due to long-term use. Further, the use of the protection layer is effective in suppressing generation of fogging or black dots that may be caused by the reduction in thickness of the charge transporting layer, which is effective in improving electrical characteristics (reducing residual potential).

The binder resin used in the charge generating layer 2 may be selected from various insulating resins, including organic photoconductive polymers such as poly-N-vinylcarbazole, polyvinylanthracene, polyvinylpyrene, and polysilane. Preferred examples of the binder resin include polyvinyl butyral resin, polyarylate (such as a polycondensed product of a bisphenol and an aromatic bivalent carboxylic acid), polycarbonate resin, polyester resin, phenoxy resin, vinyl chloride/vinyl acetate copolymer, polyamide resin, acrylic resin, polyacrylamide resin, polyvinyl pyridine resin, cellulose resin, urethane resin, epoxy resin, casein, polyvinyl alcohol resin, and polyvinyl pyrrolidone resin. These resins may be used alone or in combination of two or more kinds. The blend ratio by weight of the charge generating material to the binder resin is preferably from 10/1 to 1/10. The word "insulating" here refers to having a volume resistivity of $10^{13}$ Ωcm or more.

The charge generating layer 2 is formed by using a coating composition in which the charge generating material and the binder resin are dispersed in a suitable solvent.

Examples of the solvent used to disperse these materials include methanol, ethanol, n-propanol, n-butanol, benzyl alcohol, methylcellosolve, ethylcellosolve, acetone, methyl ethyl ketone, cyclohexanone, methyl acetate, n-butyl acetate, dioxane, tetrahydrofuran, methylene chloride, chloroform, chlorobenzene, and toluene. The solvent may be used alone or in combination of two or more kinds.

The charge generating material and the binder resin may be dispersed by an ordinary method using a ball mill, an attriter, a sand mill or the like. By conducting the dispersion by the above method, changes in the crystal form of the charge generating material caused during the dispersion may be prevented. Further, it is advantageous to use the charge generating material having an average particle diameter of 0.5 μm or less, preferably 0.3 μm or less, more preferably 0.15 μm or less, at the time of conducting the dispersion.

The charge generating layer 2 may be formed by an ordinary method such as blade coating, Meyer bar coating, spray coating, dip coating, bead coating, air knife coating, or curtain coating.

The thickness of the obtained charge generating layer 2 is preferably from 0.1 μm to 5.0 μm, more preferably from 0.2 μm to 2.0 μm.

<Charge Transporting Layer>

The charge transporting layer 3 includes a charge transporting material and a binder resin, or includes a polymeric charge transporting material.

Examples of the charge transporting material include electron transporting compounds, such as quinone compounds such as p-benzoquinone, chloranil, bromanil and anthraquinone, tetracyanoquinodimethane compounds, fluorenone compounds such as 2,4,7-trinitrofluorenone, xanthone compounds, benzophenone compounds, cyanovinyl compounds, and ethylene compounds; and hole transporting compounds, such as triarylamine compounds, benzidine compounds, arylalkane compounds, aryl-substituted ethylene compounds, stilbene compounds, anthracene compounds, and hydrazone compounds. These charge transporting materials may be used alone or in combination of two or more kinds.

In view of the charge mobility, the charge transporting material is preferably a triarylamine derivative represented by the following formula (a-1), or a benzidine derivative represented by the following formula (a-2).

(a-1)

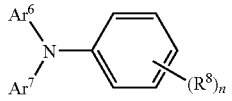

In formula (a-1), $R^8$ represents a hydrogen atom or a methyl group; n represents 1 or 2; $Ar^6$ and $Ar^7$ each independently represent a substituted or unsubstituted aryl group, $—C_6H_4—C(R^9)═C(R^{10})(R^{11})$ or $—C_6H_4—CH═CH—CH═C(R^{12})(R^{13})$, wherein $R^9$ to $R^{13}$ each independently represent a hydrogen atom, a substituted or unsubstituted alkyl group, or a substituted or unsubstituted aryl group. The substituent is a halogen atom, an alkyl group having 1 to 5 carbon atoms, an alkoxy group having 1 to 5 carbon atoms, or a substituted amino group substituted by an alkyl group having 1 to 3 carbon atoms.

(a-2)

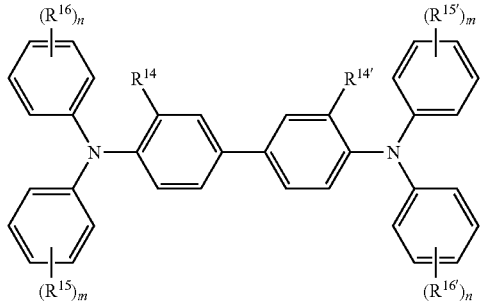

In formula (a-2), $R^{14}$ and $R^{14'}$ each independently represent a hydrogen atom, a halogen atom, an alkyl group having 1 to 5 carbon atoms, an alkoxy group having 1 to 5 carbon atoms; $R^{15}$, $R^{15'}$, $R^{16}$ and $R^{16'}$ each independently represent a hydrogen atom, a halogen atom, an alkyl group having 1 to 5 carbon atoms, an alkoxy group having 1 to 5 carbon atoms, an amino group substituted by an alkyl group having 1 or 2 carbon atoms, a substituted or unsubstituted aryl group, $—C(R^{17})═C(R^{18})(R^{19})$, or $—CH═CH—CH═C(R^{20})(R^{21})$, wherein $R^{17}$ to $R^{21}$ each independently represent a hydrogen atom, a substituted or unsubstituted alkyl group, or a substituted or unsubstituted aryl group; and m and n each independently represent an integer of 0 to 2.

The triarylamine derivative represented by formula (a-1) and the benzidine derivative represented by formula (a-2) are preferably a triarylamine derivative having $—C_6H_4—CH═CH—CH═C(R^{12})(R^{13})$ and a benzidine derivative having) $—CH═CH—CH═C(R^{20})(R^{21})$, respectively, in view of the charge mobility, adhesiveness to the surface protection layer, or suppressing the formation of an afterimage due to the remaining history of the previous image (hereinafter, also referred to as "ghost" sometimes).

Examples of the binder resin used in the charge transporting layer 3 include polycarbonate resin, polyester resin, polyarylate resin, methacrylic resin, acrylic resin, polyvinyl chloride resin, polyvinylidene chloride resin, polystyrene resin, polyvinyl acetate resin, styrene/butadiene resin, vinylidene chloride/acrylonitrile copolymer, vinyl chloride/vinyl acetate resin, vinyl chloride/vinyl acetate/maleic anhydride copolymer, silicone resin, silicone alkyd resin, phenol/formaldehyde resin, styrene-alkyd resin, poly-N-vinylcarbazole resin, and polysilane. As described above, it is also possible to use a polymeric charge transporting material, such as the polyester polymeric charge transporting materials disclosed in JP-A No. 8-176293 or 8-208820. These binder resins may be used alone or in combination of two or more kinds. The ratio by weight of the charge transporting material to the binder resin is preferably from 10/1 to 1/5.

The binder resin is not particularly limited, but preferably includes at least one of a polycarbonate resin having a viscosity-average molecular weight of 50,000 to 80,000 or a polyarylate resin having a viscosity-average molecular weight of 50,000 to 80,000, in view of obtaining a film having a favorable quality.

A polymeric charge transporting material may be used as the charge transporting material. The polymeric charge transporting material may be a known polymer having a charge transporting characteristic, such as poly-N-vinylcarbazole or polysilane. In particular, polyester polymeric charge transporting materials, such as those disclosed in JP-A No. 8-176293 or 8-208820, are preferable since these materials have a charge transporting characteristic higher than that of the other species. The polymeric charge transporting material may be used alone to form a film, or may be used in combination with a further binder resin as mentioned below.

The charge transporting layer 3 is formed by using a coating composition for forming the charge transporting layer including the above-mentioned components. The solvent used in the coating composition for forming the charge transporting layer may be one or more ordinary organic solvents, and examples thereof include aromatic hydrocarbons such as benzene, toluene, xylene and chlorobenzene, ketones such as acetone and 2-butanone, halogenated aliphatic hydrocarbons such as methylene chloride, chloroform and ethylene chloride, and cyclic or linear ethers such as tetrahydrofuran and ethyl ether. The above components may be dispersed in the solvent by a known method.

The coating composition for forming the charge transporting layer may be applied onto the charge generating layer 2 by an ordinary method, such as blade coating, Meyer bar coating, spray coating, dip coating, bead coating, air knife coating, or curtain coating.

The thickness of the charge transporting layer 3 is preferably from 5 μm to 50 μm, more preferably from 10 μm to 30 μm.

The exemplary embodiment as explained above has a photosensitive layer of function-separated type, such as that of the electrophotographic photoreceptor 7A shown in FIG. 1.

In the case of a photosensitive layer having a monolayer structure, such as that of the electrophotographic photoreceptor 7C shown in FIG. 3, the content of the charge generating material is from about 10% by weight to 85% by weight, preferably from 20% by weight to 50% by weight, while the content of the charge transporting material therein is preferably from 5% by weight to 50% by weight. The monolayered photosensitive layer 6 can be formed in a similar manner to the charge generating layer 2 or the charge transporting layer 3. The thickness of the monolayered photosensitive layer 6 is preferably from about 5 μm to 50 μm, more preferably from 10 μm to 40 μm.

Each of the layers constituting the photosensitive layer of the electrophotographic photoreceptors 7A to 7C shown in FIGS. 1 to 3 may include a further additive, such as an antioxidant, a light stabilizer or a heat stabilizer, in order to suppress the deterioration of the photoreceptor due to ozone or an oxidizing gas generated in an image forming apparatus, light, or heat. Examples of the antioxidant include hindered phenols, hindered amines, p-phenylenediamine, arylalkanes, hydroquinone, spirocoumarone and spiroindane; derivatives thereof; organic sulfur compounds; and organic phosphorus compounds.

Examples of the light stabilizer include benzophenone, benzotriazole, dithiocarbamate and tetramethylpiperidine; and derivatives thereof. For the purpose of improving the sensitivity, reducing the residual potential, reducing the fatigue due to the repeated use of the electrophotographic photoreceptor, or the like, one or more electron acceptable materials may be incorporated in the layers. Examples of the electron acceptable material include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, phthalic acid, and a compound represented by the aforementioned formula (2). Among these materials, fluorenone compounds, quinone compounds, and benzene derivatives having an electron withdrawing group such as Cl—, CN— or $NO_2$— are particularly preferable.

Moreover, it is preferable to treat the surface protection layer 5 of the electrophotographic photoreceptor with an aqueous dispersion containing a fluorine-containing resin, for the purpose of further reducing the torque and improving the transfer efficiency.

<Image Forming Apparatus and Process Cartridge>

Figure 5:
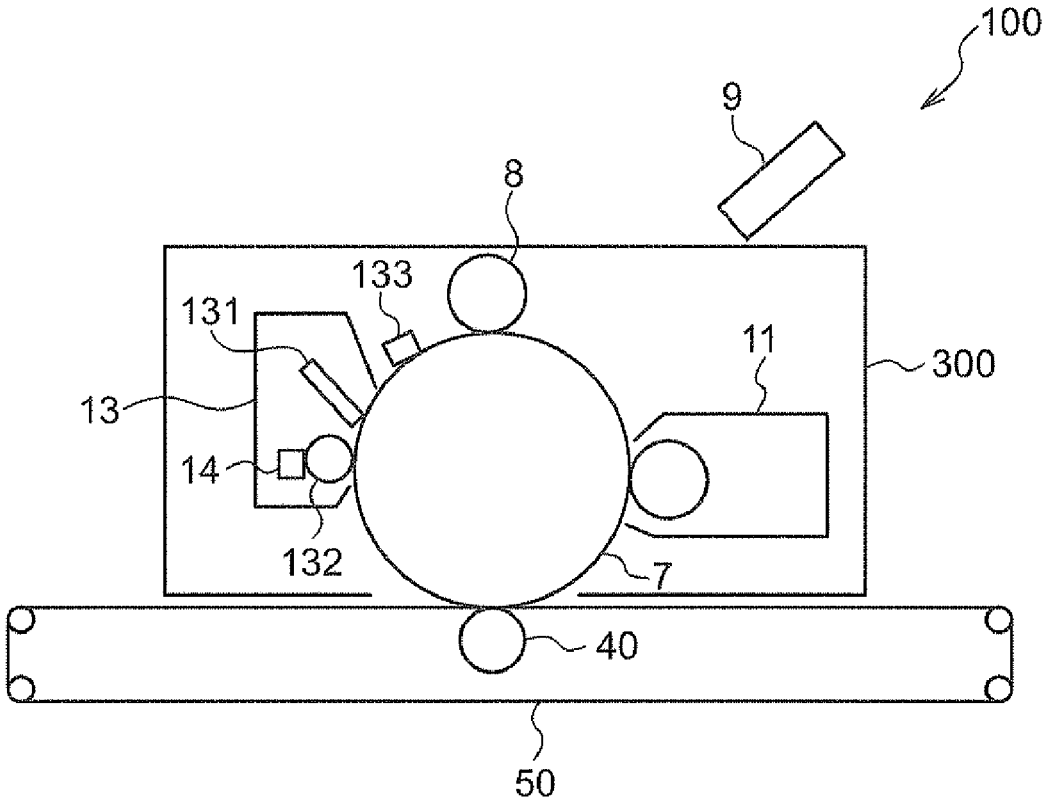
FIG. 5 is a schematic view illustrating an image forming apparatus according to an exemplary embodiment of the invention.

FIG. 5 is a structural view illustrating an image forming apparatus according to an exemplary embodiment of the invention. As illustrated in FIG. 5, an image forming apparatus 100 is equipped with a process cartridge 300 provided with an electrophotographic photoreceptor 7, an exposure unit 9, a transfer unit 40, and an intermediate transfer medium 50. In the image forming apparatus 100, the exposure unit 9 is located so as to be able to irradiate the electrophotographic photoreceptor 7 with light through an opening formed in the process cartridge 300. The transfer unit 40 is located opposite to the electrophotographic photoreceptor 7 via the intermediate transfer medium 50. The intermediate transfer medium 50 is located so that a portion thereof contacts the electrophotographic photoreceptor 7.

The electrophotographic photoreceptor 7 that constitutes a part of the image forming apparatus 100, as well as the process cartridge 300, is the electrophotographic photoreceptor according to the above-mentioned exemplary embodiment.

The process cartridge 300 in FIG. 5 supports, in its housing, the electrophotographic photoreceptor 7, a charging unit 8, a development unit 11, and a cleaning unit 13 in an integrated manner.

The process cartridge of the exemplary embodiment is not limited to the above configuration, as long as it includes the electrophotographic photoreceptor 7 and at least one of the charging unit 8, the development unit 11, or the cleaning unit 13.

The cleaning unit 13 has a cleaning blade 131 that is located so as to contact the surface of the electrophotographic photoreceptor 7.

One example of the cleaning unit 13 is a combination of a fibrous member 132 in the form of a roller that supplies a lubricant 14 to the surface of the electrophotographic photoreceptor 7 and a fibrous member 133 in the form of a flat brush that assists the cleaning, but these members are used as appropriate according to usage.

The cleaning unit 13 is not limited to the above-mentioned structure, and may be any know cleaning unit, such as a unit that contacts a brush formed from an electroconductive plastic or the like to the surface of the electrophotographic photoreceptor 7.

Examples of the charging unit 8 include a contact-type charging unit employing an electroconductive or semiconductive charging roller, a charging brush, a charging film, a charging rubber blade, a charging tube, or the like. The charging unit 8 may also be a known charging unit, such as a non contact-type roller-shaped charging unit, or a scorotron or corotron charging unit employing a corona discharge.

Although not illustrated, a heating unit that increases the temperature of the electrophotographic photoreceptor 7 so as to decrease the relative temperature may be provided around the electrophotographic photoreceptor 7, in order to improve the stability of the images.

One example of the exposure unit 9 may be an optical unit that irradiates the surface of the electrophotographic photoreceptor 7 with light such as semiconductor laser beams, LED beams, or light thorough a liquid crystal shutter, in the form of a desired image. The wavelength of the light is within a range corresponding to the spectral sensitivity region of the electrophotographic photoreceptor. The wavelength of the semiconductor laser is typically within a near-infrared range having an oscillation wavelength at around 780 nm. However, oscillation wavelength of the semiconductor laser is not limited to the above range, and may be selected from lasers having an oscillation wavelength in the in order of 600 nm, or blue lasers having an oscillation wavelength in the range of from about 400 nm to about 450 nm. It is also possible to use a plane-emission laser light source capable of multibeam output, for the formation of a color image.

Examples of the development unit 11 include an ordinary development unit that develops an electrostatic latent image by contacting the same with a developer, which may be magnetic or nonmagnetic, or may be one or two-component developer, or other kinds of the developer. The development unit is not particularly limited as far as the unit has the above-mentioned function, and may be selected as appropriate according to usage. Examples of the development unit 11 include known development units having a function of contacting a developer such as those as mentioned above to the surface of electrophotographic photoreceptor 7 using a brush, a roller or the like. Among these, the development unit 11 preferably uses a development roller that retains the developer on the surface thereof.

In the following, the developer and the toner used in the development unit 11 will be described in detail.

The toner used in the image forming apparatus according to the exemplary embodiment is preferably a toner for developing an electrostatic latent image, which is in the form of particles (hereinafter, referred to as "toner mother particles" sometimes) including at least a binder resin and a colorant, and having an external additive added thereto.

In the following, the term "toner" refers to the toner particles including the external additive added thereto.

In the present exemplary embodiment, the average shape factor of the toner is preferably from 100 to 150, more preferably from 105 to 145, and even more preferably from 110 to 140.

The average shape factor here refers to the number average value of the shape factors obtained from the toner particles. The shape factor of each toner particle can be obtained by taking the image of the same observed with an optical microscope into an image analyzer (for example, LUZEX III (trade name), manufactured by Nireco Corporation), measuring the circle-equivalent size of the same, and then calculating the shape factor from the maximum length and the projected area of the same in accordance with the following equation (i). When the toner particle has a completely sphere shape, $ML^2/A$ is 100.

$$(ML^2/A)=(\text{maximum length})^2\times\pi\times100/[4\times(\text{projected area})]$$

The average shape factor can be calculated from the shape factors obtained from 100 randomly selected toner particles.

By using a toner having a shape factor ($ML^2/A$) represented by the equation (i) of from 100 to 150, a so-called spherical toner, the developability and transfer property can be achieved at high levels, and high quality images can be obtained.

—Binder Resin—

The binder resin that mainly constitutes the toner mother particles is not particularly limited, and may be selected from known resin materials. The binder resins include a crystalline resin and a non-crystalline resin. In order to obtain a low-temperature fixability of the toner, a crystalline resin having a sharp melting property may be advantageously used.

The crystalline resin is preferably used in an amount of 5% by weight to 30% by weight with respect to the total components of the tone mother particles, more preferably from 8% by weight to 20% by weight. If the proportion of the crystalline resin is more than 30% by weight, the phase-separation structure in the fixed image may not be even, even though a favorable fixability may be achieved. As a result, the strength, especially the scratch resistance, of the fixed image may not be sufficient. On the other hand, if the proportion of the crystalline resin is less than 5% by weight, a favorable sharp melting property originating from the crystalline resin may not be obtained, thereby simply leading to the plasticization of the non-crystalline resin. As a result, it may not be possible to maintain the toner blocking resistance and image storability while securing a favorable low-temperature fixability.

The term "crystalline resin" here refers to a resin that exhibits a distinct endothermic peak in differential scanning calorimetry (DSC), rather than a stepwise change in the endothermic quantity. The term "crystalline" here refers to a characteristic of exhibiting a distinct endothermic peak in differential scanning calorimetry (DSC), rather than a stepwise change in the endothermic quantity. Specifically, the term refers to a characteristic of exhibiting an endothermic peak having a half band width of not more than 6° C., at a temperature increase rate of 10° C./min.

On the other hand, resins that exhibit an endothermic peak having a half band width of more than 6° C. or resins that do not exhibit a distinct endothermic peak are referred to as a non-crystalline resin. In the present exemplary embodiment, a resin that does not exhibit a distinct endothermic peak is preferably used as the non-crystalline resin that may be included in the toner.

The crystalline resin is not particularly limited as far as the resin has the aforementioned characteristic, and specific examples thereof include a crystalline polyester resin and a crystalline vinyl resin. The crystalline resin is preferably a crystalline polyester resin, from the viewpoint of achieving a favorable fixability to paper upon fixation or chargeability, or adjusting the melting point to a preferred range. The crystalline resin is more preferably an aliphatic crystalline polyester resin having a melting point in an appropriate range.

The crystalline polyester resin may be obtained by purchasing a commercially available product, or by synthesizing the same as appropriate.

The crystalline polyester resin is typically synthesized from a polyvalent carboxylic acid component and a polyhydric alcohol component.

Examples of the polyvalent carboxylic acid component include aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid and 1,18-octadecanedicarboxylic acid; aromatic dicarboxylic acids including diprotic acids such as phthalic acid, isophthalic acid, terephthalic acid, naphthalene-2,6-dicarboxylic acid, malonic acid, and mesaconic acid; and anhydrides or lower alkyl esters thereof. However, the invention is not limited thereto.

Examples of a trivalent or higher-valent carboxylic acid include 1,2,4-benzenetricarboxylic acid, 1,2,5-benzenetricarboxylic acid, and 1,2,4-naphthalenetricarboxylic acid; and anhydrides or lower alkyl esters thereof. These carboxylic acids may be used alone or in combination of two or more kinds.

The polyvalent carboxylic acid component preferably includes, in addition to an aliphatic dicarboxylic acid or an aromatic dicarboxylic acid, a dicarboxylic acid having a sulfonic group. The inclusion of a dicarboxylic acid component having a sulfonic group is advantageous in view of improving the dispersibility of a colorant, such as a pigment. Further, when the sulfonic group is present, preparation of an emulsion or suspension of the resin with water can be carried out without using a surfactant during the production of toner particles, as described later.

Examples of the dicarboxylic acid having a sulfonic group include sodium 2-sulfoterephthalate, sodium 5-sulfoisophthalate, and sodium sulfosuccinate, but the invention is not limited thereto. Lower alkyl esters or anhydrides thereof are also applicable. The content of the divalent or higher-valent carboxylic acid having a sulfonic acid group is preferably from 0% by mole to 20% by mole with respect to the total amount of carboxylic acid components that constitutes the polyester, more preferably from 0.5% by mole to 10% by mole. If the content of the dicarboxylic acid having a sulfonic group is less than 0.5% by mole, stability of the emulsified particles over time may deteriorate. On the other hand, if the content of the dicarboxylic acid having a sulfonic group is more than 10% by mole, crystallinity of the polyester resin may decrease. Moreover, when the toner particles are produced by an aggregation-coalescence method, which will be detailed later, troubles may occur during the process of coalescing the particles after the aggregation, thereby making it difficult to regulate the toner size.

It is more preferable that the crystalline polyester resin contains a dicarboxylic acid component having a double bond, other than the aliphatic dicarboxylic acid or aromatic dicarboxylic acid, in order to prevent hot-offset of the toner upon fixation, by forming a radical crosslinkage through the double bond thereof. Examples of the dicarboxylic acid include maleic acid, fumaric acid, 3-hexenedioic acid, and 3-octenedioic acid. However, the dicarboxylic acid is not limited thereto. Other examples thereof include lower esters or anhydrides thereof. Among these, fumaric acid and maleic acid are preferable from the viewpoint of costs.

The polyhydric alcohol component is preferably an aliphatic diol, more preferably a linear aliphatic diol having a main chain having 7 to 20 carbon atoms. If the aliphatic diol has a branched structure, the crystallinity of the polyester resin declines and the melting point decreases. As a result, toner-blocking resistance, image storability, and low-temperature fixability may deteriorate. If the number of carbon atoms in the main chain is less than 7, when the diol is polycondensed with an aromatic dicarboxylic acid, the resultant may have a high melting point and it may be difficult to perform the fixation at low temperature. On the other hand, if the number of carbon atoms is more than 20, the materials may not be easily available for practical use. The number of carbon atoms is more preferably 14 or less.

Specific examples of the aliphatic diol suitably used in the synthesis of crystalline polyester include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosadecanediol. However, the diol is not limited thereto. Among these, 1,8-octanediol, 1,9-nonanediol and 1,10-decanediol are preferable, considering the availability thereof.

Examples of the trihydric or higher-hydric alcohol include glycerin, trimethylolethane, trimethylopropane, and pentaerythritol. These may be used alone or in combination of two or more kinds.

The content of the aliphatic diol component in the polyhydric alcohol component is preferably 80% by mole or more, more preferably 90% by mole or more. If the content the aliphatic diol component is less than 80% by mole, crystallinity of the polyester declines and the melting point decreases. As a result, toner-blocking resistance, image storability and low-temperature fixability may deteriorate.

It is also possible to use a monovalent acid, such as acetic acid or benzoic acid, or a monohydric alcohol, such as cyclohexanol or benzyl alcohol, in order to adjust the acid value or the hydroxyl value, as necessary.

The method for producing the crystalline polyester resin is not particularly limited, and may be an ordinary polyester polymerizing method of allowing an acid component and an alcohol component to react with each other, such as direct polycondensation and transesterification, which may be selected as appropriate according to usage.

The crystalline polyester resin may be produced at a polymerization temperature of 180° C. to 230° C., by reducing the pressure in the reaction system as necessary, and reacting the raw materials while removing water or alcohol generated upon polycondensation. When the monomers are not dissolved or phase-dissolved with each other at the reaction temperature, a solvent having a high boiling point may be added thereto as a dissolution aid, in order to dissolve the monomers. The polycondensation reaction is conducted while distilling off the dissolution aid. When a monomer having a poor compatibility is present in the copolymerization reaction, the reaction may be carried out by previously condensing the monomer with the acid or alcohol, and then performing the polycondensation reaction with the main component.

A dispersion of the crystalline polyester resin particles may be prepared by emulsifying and dispersing the particles by adjusting the acid value of the resin or using an ionic surfactant or the like.

In the production of the crystalline polyester resin, a catalyst may be used, and examples thereof include compounds of an alkali metal such as sodium or lithium; compounds of an alkaline earth metal such as magnesium, or calcium; compounds of a metal such as zinc, manganese, antimony, titanium, tin, zirconium, or germanium; phosphorous acid compounds; phosphoric acid compounds; and amine compounds.

Specific examples thereof include sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenylantimony, tributylantimony, tin formate, tin oxalate, tetraphenyltin, dibutyltin dichloride, dibutyltin oxide, diphenyltin oxide, zirconium tetrabutoxide, zirconium naphthenate, zirconyl carbonate, zirconyl acetate, zirconyl stearate, zirconyl octylate, germanium oxide, triphenylphosphite, tris(2,4-t-butylphenyl)phosphite, ethyltriphenylphosphonium bromide, triethylamine, and triphenylamine.

Examples of the crystalline vinyl resin include a vinyl resin produced by using a long-chain alkyl or alkenyl (meth)acrylate, such as amyl (meth)acrylate, hexyl (meth)acrylate, heptyl (meth)acrylate, octyl (meth)acrylate, nonyl (meth)acrylate, decyl (meth)acrylate, undecyl (meth)acrylate, tridecyl (meth)acrylate, myristyl (meth)acrylate, cetyl (meth)acrylate, stearyl (meth)acrylate, oleyl (meth)acrylate, and behenyl (meth)acrylate. In the specification, the term "(meth)acrylate" refers to both acrylate and methacrylate.

The melting point of the crystalline resin is preferably from 50° C. to 100° C., more preferably 60° C. to 80° C. If the melting point is lower than 50° C., there may be a problem in storability of the toner or the fixed image formed from the toner. If the melting point is higher than 100° C., a sufficient level of low-temperature fixability may not be obtained as compared with the conventional toners. In the present invention, when the crystalline resin exhibits plural melting peaks, the maximum peak is regarded as the melting point.

The non-crystalline resin may be a known resin material, but particularly preferably a non-crystal polyester resin. The non-crystal polyester resin is typically obtained by performing polycondensation of a polyvalent carboxylic acid and a polyhydric alcohol.

When a non-crystal polyester resin is used, it is advantageous to perform emulsification and dispersion by adjusting the acid value of the resin or using an ionic surfactant or the like, in view of readily preparing the resin particle dispersion.

Examples of the polyvalent carboxylic acid include aromatic polyvalent carboxylic acids such as terephthalic acid, isophthalic acid, phthalic anhydride, trimellitic anhydride, pyromellitic acid, and naphthalenedicarboxylic acid; aliphatic polyvalent carboxylic acids such as maleic anhydride, fumaric acid, succinic acid, alkenylsuccinic anhydride, and adipic acid; and alicyclic polyvalent carboxylic acids such as cyclohexanedicarboxylic acid. These polyvalent carboxylic acids may be used alone or in combination of two or more kinds. Among the polyvalent carboxylic acids, aromatic carboxylic acids are preferable. Further, in order that the toner particles have a crosslinked or branched structure to ensure a favorable fixability, a trivalent or higher-valent carboxylic acid (such as trimellitic acid or an anhydride thereof) is preferably used in combination with a dicarboxylic acid.

Examples of the polyhydric alcohol include aliphatic diols such as ethylene glycol, diethylene glycol, triethylene glycol, propylene glycol, butanediol, hexanediol, neopentyl glycol, and glycerin; alicyclic diols such as cyclohexanediol, cyclohexanedimethanol, and hydrogenated bisphenol A; and aromatic dials such as an ethylene oxide adduct of bisphenol A, and a propylene oxide adduct of bisphenol A. These polyhydric alcohols may be used alone or in combination of two or more kinds. Among these polyhydric alcohols, aromatic dials and alicyclic dials are preferred, and aromatic diols are more preferred. In order that the toner particles have a crosslinked or branched structure to ensure a favorable fixability, a trihydric or higher-hydric alcohol (such as glycerin, trimethylolpropane, or pentaerythritol) may be used in combination with a diol. The acid value of the polyester resin may be adjusted by esterifying a terminal hydroxyl group and/or a carboxyl group by further adding a monocarboxylic acid and/or a monoalcohol. Examples of the monocarboxylic acid include acetic acid, acetic anhydride, benzoic acid, trichloroacetic acid, trifluoroacetic acid, and propionic anhydride. Examples of the monoalcohol include methanol, ethanol, propanol, octanol, 2-ethylhexanol, trifluoroethanol, trichloroethanol, hexafluoroisopropanol, and phenol.

The non-crystalline polyester resin is produced by performing polycondensation of a polyhydric alcohol and a polyvalent carboxylic acid in accordance with an ordinary process. For example, the resin is produced by charging a polyhydric alcohol, a polyvalent carboxylic acid and an optional catalyst into a reaction vessel equipped with a thermostat, a stirrer, and a downward-flow-type condenser, and heating the components in the presence of an inert gas (such as a nitrogen gas) at a temperature of 150° C. to 250° C. while removing the low-molecular-weight compounds generated as byproducts from the system, terminating the reaction when the acid value reaches a target value, and then cooling the system and taking out the target reaction product therefrom.

Examples of the catalyst that may be used for the synthesis of the non-crystalline polyester resin include an esterification catalyst, for example, an organic metal such as dibutyltin dilaurate or dibutyltin oxide, or a metal alkoxide such as tetrabutyl titanate. The addition amount of the catalyst is preferably from 0.01% by weight to 1.00% by weight with respect to the total amount of the raw materials.

The weight-average molecular weight (Mw) of the non-crystalline resin is preferably from 5,000 to 100,000, more preferably from 7,000 to 500,000; the number-average molecular weight (Mn) is preferably from 2,000 to 10,000; and the molecular weight distribution (Mw/Mn) is preferably from 1.5 to 100, more preferably from 2 to 60. The above values are obtained by measuring the molecular weight of a component soluble in tetrahydrofuran (THF) by gel permeation chromatography (GPC).

If the weight-average molecular weight and the number-average molecular weight are less than the above ranges, although a favorable effect can be achieved in terms of low-temperature-fixability, the anti-hot-offset property may significantly deteriorate and the storability of the toner may be adversely affected (such as blocking) due to the lowed glass transition temperature of the toner. On the other hand, if the weight-average molecular weight and the number-average molecular weight are more than the above ranges, although a sufficient level of anti-hot-offset property may be achieved, the low-temperature-fixability may deteriorate and the storability of the documents may be adversely affected due to the suppressed amount of bleeding of the crystalline polyester phase in the toner. Accordingly, satisfying the above requirements makes it easier to achieve each of the low-temperature fixability, the anti-hot-offset property, and the document storability.

In the present specification, the molecular weight of a resin is obtained by measuring a component soluble in THF by using a GPC measurement device (trade name: HLC-8120, manufactured by Tosoh Corporation) and a column (trade name: TSK gel SUPER HM-M (15 cm), manufactured by Tosoh Corporation), with THF as a solvent, and then calculating the molecular weight using a molecular weight calibration curve prepared from a monodispersive polystyrene standard sample.

The acid value of a polyester resin (the weight of KOH (mg) necessary for neutralizing 1 g of the resin) is preferably from 1 mgKOH/g to 30 mgKOH/g, in view of making it easier to obtain the aforementioned molecular weight distribution, secure the particle-forming property of the toner particles in an emulsification-dispersion method, and maintain a favorable environmental stability (stability in chargeability against the changes in temperature/humidity) of the resultant toner. The acid value of the polyester resin can be adjusted by controlling the terminal carboxyl groups through the blend ratio and the reaction rate of the polyvalent carboxylic acid and the polyhydric alcohol as the starting materials.

A styrene acrylic resin may also be used as the non-crystalline resin. Examples of a monomer usable in this case include styrenes such as styrene, p-chlorostyrene, and α-methylstyrene; esters having a vinyl group such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; vinylnitriles such as acrylonitrile and methacrylonitrile; vinyl ethers such as vinyl methyl ether and vinyl isobutyl ether; vinyl ketones such as vinyl methyl ketone, vinyl ethyl ketone, and vinyl isopropenyl ketone; and olefins such as ethylene, propylene, and butadiene. A copolymer and a mixture made from two or more of these monomers are also applicable.

Further examples of the non-crystalline resin include epoxy resin, polyester resin, polyurethane resin, polyamide resin, cellulose resin, polyether resin, non-vinyl-condensed resin, a mixture of the above resin and the above vinyl resin, and a graft polymer obtained by polymerizing a vinyl monomer in the coexistence of the above resin.

The glass transition temperature of the non-crystalline resin is preferably from 35° C. to 100° C., more preferably from 50° C. to 80° C., in view of the balance between the storage stability and the fixability of the toners. If the glass transition temperature is lower than 35° C., blocking of the toner (a phenomenon that the toner particles aggregate to form a mass) tends to occur during storage or in a development unit. On the other hand, if the glass transition temperature is higher than 100° C., the temperature for fixing the toner may increase.

The softening point of the non-crystalline resin is preferably from 80° C. to 130° C., more preferably from 90° C. to 120° C. If the softening point is lower than 80° C., stability of the toner or the image formed from the toner after fixation or during storage may significantly deteriorate. If the softening point is higher than 130° C., the low-temperature fixability of the toner may deteriorate.

The softening point of a non-crystalline resin refers to the intermediate temperature between the temperature at which the resin starts to melt and the temperature at which the melting starts and the temperature at which the melting ends, as measured with a flow tester (trade name: CFT-500C, manufactured by Shimadzu Corp.) under the conditions of preheating: 80° C./300 sec, plunger pressure: 0.980665 MPa, die size: 1 mm in diameter×1 mm, and temperature increase rate: 3.0° C./min.

—Releasing Agent—

The toner mother particles may include a releasing agent.

The releasing agent is preferably a material having a principal maximum peak as measured in accordance with ASTM D 3418-8 in the range of from 50° C. to 140° C. If the principal maximum peak is lower than 50° C., offset may easily occur upon fixation of the toner. If the principal maximum peak is higher than 140° C., the fixation temperature is increased and the gloss of the image may be impaired due to the insufficient smoothness of the image surface.

The measurement of the principal maximum peak may be conducted by using, for example, a measurement device (trade name: DSC-7, manufactured by Perkin Elmer Inc). The correction of the temperature at a detection portion of this device is performed by using the melting temperatures of indium and zinc, and the correction of amount of heat is performed by using the heat of fusion of indium. The measurement is conducted at a temperature increase rate of 10° C./min, using an aluminum pan as a sample and an empty pan as a control.

The viscosity $\eta\mathbf{1}$ at 160° C. of the releasing agent is preferably from 20 mPa·s to 600 mPa·s. If the viscosity $\eta\mathbf{1}$ is less than 20 mPa·s, hot offset may easily occur. If the viscosity $\eta\mathbf{1}$ is more than 600 mPa·s, cold offset may occur upon fixation of the toner.

The ratio of the viscosity $\eta\mathbf{2}$ at 200° C. of the releasing agent to the viscosity $\eta\mathbf{2}$ at 160° C. thereof, ($\eta\mathbf{2}/\eta\mathbf{1}$), is preferably from 0.5 to 0.7. If the ratio $\eta\mathbf{2}/\eta\mathbf{1}$ is less than 0.5, the amount of bleeding may not be enough when performing fixation at low temperature. If the ratio is more than 0.7, the amount of bleeding may be too much when performing fixation at high temperature, thereby causing not only wax offset but also problems in release stability.

Specific examples of the release agent include low-molecular-weight polyolefins such as polyethylene, polypropylene, and polybutene; silicones that softens when heated; aliphatic amides such as oleic amide, erucic amide, ricinoleic amide, and stearic amide; plant waxes such as carnauba wax, rice wax, candelilla wax, Japan wax (Japan tallow) and jojoba oil; animal waxes such as beeswax; mineral or petroleum waxes such as montan wax, ozocerite, ceresin, paraffin wax, microcrystalline wax, and Fisher Tropsch wax; and modified products thereof.

—Colorant—

The colorant included in the toner mother particles is not particularly limited, and may be selected from any known colorants as appropriate according to purposes.

Examples of the colorant include the following pigments:

Black pigments, including carbon black, and magnetic powder;

yellow pigments, including Hansa Yellow, Hansa Yellow 10G, Benzidine Yellow G, Benzidine Yellow GR, Threne Yellow, Quinoline Yellow, and Permanent yellow NCG, red pigments, including red iron oxide, Watchung Red, Permanent Red 4R, Lithol Red, Brilliant Carmine 3B, Brilliant Carmine 6B, Du Pont Oil Red, Pyrazolone Red, Rhodamine B Lake, Lake Red C, rose bengal, Eosin Red, and Alizarin Lake, and blue pigments, including ultramarine, cobalt blue, Alkali Blue Lake, Victoria Blue Lake, Fast Sky Blue, Indanthrene Blue BC, Aniline Blue, ultramarine blue, Calco Oil Blue, Methylene Blue Chloride, Phthalocyanine Blue, Phthalocyanine Green, and Malachite Green Oxalate.

These pigments may be used as a mixture thereof, or may be used in the form of a solid solution.

The colorant may be dispersed by a known method using, for example, a rotary shearing homogenizer, a disperser using a medium such as a ball mill, a sand mill or an attriter, or a high-pressure counter-collision dispersing machine.

A colorant particle dispersion may be prepared by dispersing the above colorant in an aqueous medium with an ionic surfactant having a polarity, by using a homogenizer as mentioned above.

—External Additive—

The toner used in the image forming apparatus according to the exemplary embodiment may include an external additive, and inorganic particles are used as the external additive.

Examples of the inorganic particles include those of silica, aluminum oxide, zinc oxide, titanium oxide, tin oxide, and iron oxide. Among these, silica is particularly preferable, since silica has a high degree of chargeability which makes it easier to adhere to the electrophotographic photoreceptor even in the state of being free; and has an appropriately high degree of electric resistance which makes it less likely to be transferred. As a result, supply of the toner to a cleaning portion can be facilitated by the use of silica, thereby achieving the effects of the invention more remarkably.

The silica used as an external additive in the invention preferably has a volume-average particle size of from 80 nm to 1,000 nm. If the volume-average particle size is less than 80 nm, the silica may not effectively function to reduce the non-electrostatic adhesive force, as compared with the case of silica having a larger particle size. In particular, the silica having a volume-average particle size of less than 80 nm may be easily buried in the toner particles by the stress generated inside the image forming apparatus, and thus the silica may not become free from the toner. On the other hand, if the volume-average particle size is more than 1,000 nm, the silica may detach from the toner particles more easily as compared with the case of silica having a smaller particle size, and thus the silica, although being in a free state, may not readily attach to the toner remaining on the electrophotographic photoreceptor before forming a toner dam. The volume-average particle size of the silica is more preferably from 80 nm to 500 nm, even more preferably from 150 nm to 300 nm.

The particle size of less than 2 μm, such as that of external additives such as silica, can be measured by using a laser diffraction particle size distribution meter (trade name: LA-700, manufactured by Horiba Ltd.) In the measurement, a sample in the form of a dispersion is prepared so that the solid content thereof is about 2 g, and ion exchange water is added thereto so that the amount of the sample is about 40 mL. This is charged in a cell until an appropriate concentration is achieved, and then the cell is allowed to stand still for about 2 minutes. The measurement is conducted when the concentration in the cell becomes stable. The volume-average particle sizes obtained at each of the channels are accumulated from the smaller side, and the value at an accumulation of 50% is determined as the volume-average particle size.

In the present exemplary embodiment, the toner mother particles may further include an antistatic agent, in addition to the above-mentioned components.

—Process for Producing the Toner—

The following is a preferred example of the process for producing the toner.

The toner particles (toner mother particles) included in the toner are preferably obtained by a wet method, the method including an aggregation step of forming aggregated particles in a dispersion in which at least resin particles and colorant particles are dispersed, and a fusing step of fusing the aggregated particles to coalesce by heating, in view of obtaining a color toner having a small diameter and a sharp particle size distribution, as well as being capable of forming a high quality full-color image.

In the aggregation step, aggregated particles are formed by mixing a resin particle dispersion including a binder resin, a colorant particle dispersion including a colorant, and an optional release agent dispersion or other components; adding an aggregation agent thereto; and heating the mixture while stirring to allow the resin particles, colorant or the like to aggregate.

The volume-average particle size of the aggregate particles is preferably from 2 μm to 9 μm. A coating layer may be formed on the aggregate particles by adding further resin particles (additional particles) to the surface of the aggregate particles (adhesion step). The additional particles may not be the same as the resin particles used in the aggregation step.

The particle size of the aggregate particles may be measured by means of, for example, a laser diffraction particle size distribution meter (trade name: LA-700, manufactured by Horiba Ltd.)

The resin used in the aggregation step or the adhesion step preferably includes a resin having a relatively high molecular weight, in order that the external additives may easily become free from the toner particles. Specifically, the resin preferably includes a resin having a Z-average molecular weight Mz of from 100,000 to 500,000.

In the fusing step, the aggregate particles are fused by heating, for example, at a temperature of not lower than the glass transition temperature of the resin, typically from 70° C. to 120° C., thereby obtaining a dispersion including toner particles (toner particle dispersion).

Next, the resultant toner particle dispersion is subjected to a centrifugal treatment or a suction filtration treatment to separate the toner particles from the liquid. The particles are washed with ion exchange water one to three times. At this time, the effect of washing may be enhanced by adjusting the value of pH. Thereafter, the toner particles are collected by filtration, and are then washed with ion exchange water one to three times, and dried. The toner particles for the toner used in the present exemplary embodiment are thus obtained.

The toner used in the present exemplary embodiment is preferably a toner formed by adding an external additive to toner mother particles.

The addition amount of the external additive to the toner mother particles is preferably from 0.3% by weight to 15% by weight, more preferably from 1% by weight to 10% by weight.

The addition of the external additive to the toner mother particles may be performed by mixing the toner mother particles with the external additive using a Henschel mixer, a V blender or the like. When the toner mother particles are produced by a wet process, the external additive may be externally added in the wet process.

The toner used in the present exemplary embodiment may be a magnetic toner that includes a magnetic material, or a non-magnetic toner that includes no magnetic material.

—Carrier—

As described above, in the development unit 11, a developer is used, and this developer is a mixture of a toner and a carrier.

The carrier may be an iron powder, glass beads, a ferrite powder or a nickel powder, or those coated with a resin.

The blend ratio between the toner and the carrier may be arbitrarily determined.

The transfer unit 40 may be a known transfer charging unit, such as a contact type transfer charging unit using a belt, a roller, a film, a rubber blade or the like, or a scorotron transfer charging unit or corotron transfer charging unit employing a corona discharge.

The intermediate transfer medium 50 may be a belt (intermediate transfer belt) made of polyimide, polyamideimide, polycarbonate, polyarylate, polyester, rubber or the like to which semiconductivity is imparted. Other examples of the shape of the intermediate transfer medium 50 include a drum.

The image forming apparatus 100 may further include, for example, an optical charge removal unit that optically removes charges from the electrophotographic photoreceptor 7.

Figure 6:
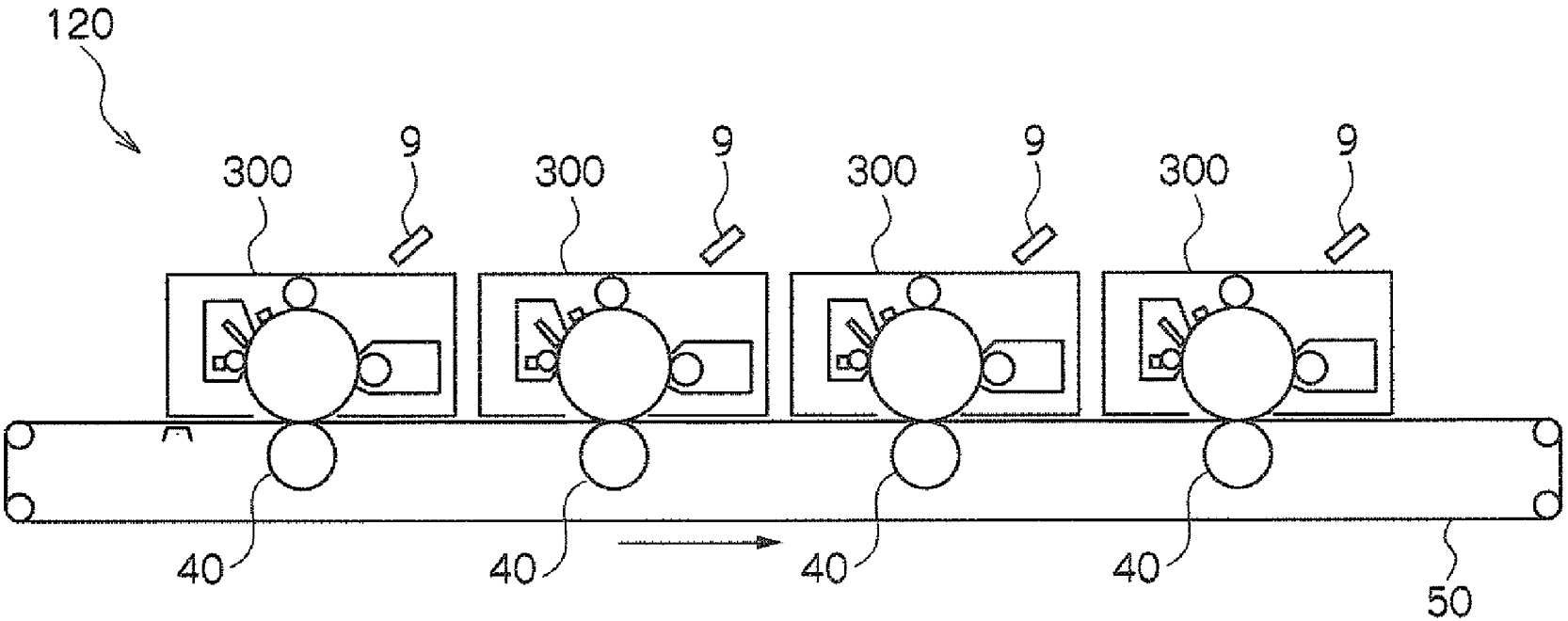
FIG. 6 is a schematic view illustrating an image forming apparatus according to another exemplary embodiment of the invention.

FIG. 6 is a schematic sectional view illustrating an image forming apparatus according to another exemplary embodiment of the invention. As illustrated in FIG. 6, an image forming apparatus 120 is a tandem-form full color image forming apparatus including four process cartridges 300. In the image forming apparatus 120, the four process cartridges 300 are arranged in parallel to each other over an intermediate transfer medium 50. Each of the electrophotographic photoreceptors 300 is used for each single color. The image forming apparatus 120 has a similar structure to the image forming apparatus 100, except that the apparatus 120 has a tandem form.

When electrophotographic photoreceptors of the invention are used as the four electrophotographic photoreceptors of the image forming apparatus in the tandem form, the electric properties of each of the four photoreceptors can be stabilized, and thus an image having an excellent color balance can be formed over the long term.

In the image forming apparatus (or in the process cartridges) according to the exemplary embodiment, the development unit preferably includes a storage unit that includes a developer, the developer being a two-component developer containing a magnetic carrier and a toner. In this case, a color image with an even higher quality can be obtained for a longer period of time, as compared with the case of using a one-component developer, especially a non-magnetic one-component developer.

In the image forming apparatus according to the present exemplary embodiment, when the velocity of rotation of the electrophotographic photoreceptor 7 (i.e., the velocity of movement of the outer surface of the electrophotographic photoreceptor) is represented by v1 (mm/s), and the velocity of rotation of the intermediate transfer medium 50 is represented by v2 (mm/s), the velocity difference Δv represented by the following expression (a) is preferably from 1.5% or about 1.5% to 5% or about 5%, more preferably from 2% or about 2% to 4% or about 4%.

$$\Delta v = |v2 - v1| / v1 \times 100 \quad \text{(a)}$$

The range of the velocity difference Δv as determined above is greater than that of ordinary image forming apparatuses. However, even with a velocity difference Δv within the above range, the electrophotographic photoreceptor according to the present exemplary embodiment can suppress the amount of attrition of the surface protection layer and suppress the amount of scratches or abrasion irregularities due to the surface protection layer being highly endurable with respect to mechanical abrasions. Therefore, passing of the toner through a gap between the surface protection layer and a cleaning unit can be effectively suppressed even when a spherical toner is used, and a favorable cleaning property can be maintained. Moreover, the occurrence of filming of the electrophotographic photoreceptor due to an external additive or the like can be suppressed. As a result, a high quality image can be formed over a long period of time.

EXAMPLES

The invention will be described in more detail by way of the following Examples, but the invention is not limited thereto.

<Production of Electrophotographic Photoreceptor 1>

An electrophotographic photoreceptor is formed as follows:

(Formation of Undercoating Layer)

100 parts by weight of zinc oxide (manufactured by Tayca Corporation, average particle size: 70 nm, specific surface area: 15 $m^2/g$) and 500 parts by weight of toluene are mixed while stirring, and 1.3 parts by weight of a silane coupling agent (trade name: KBM 503, manufactured by Shin-Etsu Chemical Co., Ltd.) are added thereto. The mixture is stirred for 2 hours. Thereafter, toluene is distilled off under reduced pressure. The resultant is baked at 120° C. for 3 hours to obtain a zinc oxide having a surface treated with the silane coupling agent.

110 parts by weight of the above surface-treated zinc oxide and 500 parts by weight of tetrahydrofuran are mixed while stirring, and a solution in which 0.6 parts by weight of alizarin is dissolved in 50 parts by weight of tetrahydrofuran is added thereto. The solution is stirred at 50° C. for 5 hours. Thereafter, the alizarin-added zinc oxide is collected by performing filtration under reduced pressure. The resultant zinc oxide is dried at 60° C. under reduced pressure, thereby obtaining an alizarin-added zinc oxide.

The following components are mixed and dispersed using glass beads having a diameter of 1 mm in a sand mill for 2 hours, thereby obtaining a dispersion.

Alizarin-added zinc oxide (prepared above) 60 parts by weight

Curing agent (blocked isocyanate, trade name: SUMIDULE 3175, manufactured by Sumitomo Bayer Urethane Co., Ltd.) 13.5 parts by weight Solution dissolving 15 parts by weight of butyral resin (trade name: S-LEC BM-1, manufactured by Sekisui Chemical Co., Ltd.) in 85 parts by weight of methyl ethyl ketone 38 parts by weight Methyl ethyl ketone 25 parts by weight To the resultant dispersion, 0.005 parts by weight of dioctyltin dilaurate as a catalyst, and 40 parts by weight of silicone resin particles (trade name: TOSPEARL 145, manufactured by Momentive Performance Materials Inc.) are added to obtain a coating composition for undercoating layer. This coating composition is applied to an aluminum substrate having the size of 30 mm in diameter, 404 mm in length and 1 mm in thickness, by dip coating. The resultant is dried and cured at 170° C. for 40 minutes, thereby forming an undercoating layer of 21 μm in thickness.

(Formation of Charge Generating Layer)

A coating composition for charge generating layer is prepared by adding 1 part by weight of hydroxygalliumphthalocyanine crystal (having diffraction peaks at positions where the Bragg angle (2θ±0.2°) in its X-ray diffraction spectrum obtained by using a CuKα characteristic X-ray are 7.4°, 16.6°, 25.5° and 28.3°) and 1 part by weight of a polyvinyl butyral resin (trade name: S-LEC BM-S, manufactured by Sekisui Chemical Co., Ltd.) in 100 parts by weight of butyl acetate, and then dispersing the same with glass beads in a paint shaker for 1 hour. Thereafter, the coating composition for charge generating layer is applied onto the undercoating layer by dip coating, and heated and dried at 100° C. for 10 minutes to form a charge generating layer of 0.2 μm in thickness.

(Formation of Charge Transporting Layer)

A coating composition for charge transporting layer is prepared by dissolving 2 parts by weight of the compound 1 having the following structure and 3 parts by weight of a polymeric compound represented by the following structural formula 1 (viscosity-average molecular weight: 39,000) in 10 parts by weight of tetrahydrofuran and 5 parts by weight of toluene. The coating composition is applied onto the charge generating layer by dip coating, and is heated and dried at 135° C. for 35 minutes, thereby forming a charge transporting layer of 22 μm in thickness.

compound 1

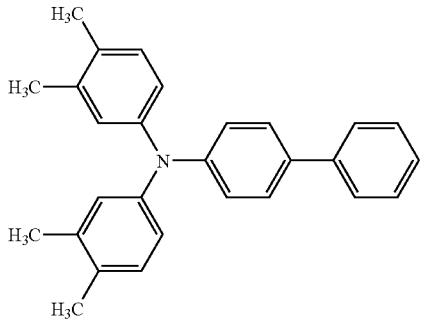

structural formula 1

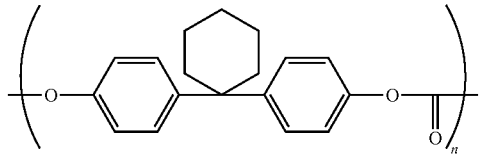

(Formation of Surface Protection Layer)

9.7 parts by weight of a compound 2 having the following structure, 35 parts by weight of cyclopentanol, 9 parts by weight of tetrahydrofuran, and 0.9 parts by weight of distilled water are mixed, and 0.5 parts by weight of an ion exchange resin (trade name: AMBERLYST 15E, manufactured by Dow Chemical Company) is added thereto. The mixture is stirred at room temperature to conduct hydrolysis for 2 hours. Further, 0.3 parts by weight of a methylated melamine resin (trade name: NICALAC MW-30HM, manufactured by Sanwa Chemical Co., Ltd.), 0.1 parts by weight of dimethylpolysiloxane (trade name: GLANOL 450, manufactured by Kyoeisha Chemical Co., Ltd.) and 0.02 parts by weight of a curing agent (trade name: NACURE 2500, manufactured by King Industries, Inc.) are added thereto, thereby obtaining a coating composition for surface protection layer. This composition is applied onto the charge transporting layer by dip coating, and is then dried at 155° C. for 45 minutes, thereby forming a surface protection layer of about 6.5 μm in thickness. The content of the melamine compound in the surface protection layer is in the range of 0.1% by weight to 5% by weight. The electrophotographic photoreceptor 1 is thus obtained.

compound 2

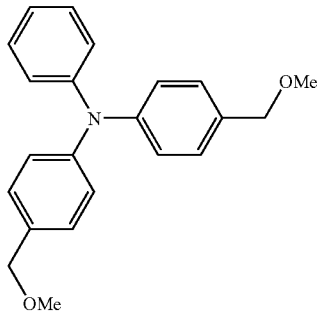

<Formation of Electrophotographic Photoreceptor 2>

Electrophotographic photoreceptor 2 is obtained in a similar manner to electrophotographic photoreceptor 1, except that the amount of the compound 2 in the coating composition for surface protection layer is changed to 9.9 parts by weight, and the amount of the methylated melamine resin (trade name: NICALAC MW-30HM, manufactured by Sanwa Chemical Co., Ltd.) is changed to 0.1 parts by weight. The content of the melamine compound in the surface protection layer is within the range of from 0.1% by weight to 5% by weight.

<Formation of Electrophotographic Photoreceptor 3>

Electrophotographic photoreceptor 3 is obtained in a similar manner to electrophotographic photoreceptor 1, except that the amount of the compound 2 in the coating composition for surface protection layer is changed to 9.5 parts by weight, and the amount of the methylated melamine resin (trade name: NICALAC MW-30HM, manufactured by Sanwa Chemical Co., Ltd.) is changed to 0.5 parts by weight. The content of the melamine compound in the surface protection layer is within the range of from 0.1% by weight to 5% by weight.

<Formation of Electrophotographic Photoreceptor 4>

Electrophotographic photoreceptor 4 is obtained in a similar manner to electrophotographic photoreceptor, 1 except that the compound 2 in the coating composition for surface protection layer is changed to a compound 3 having the following structure, and the amount of the methylated melamine resin (trade name: NICALAC MW-30HM, manufactured by Sanwa Chemical Co., Ltd.) is changed to 0.3 parts by weight. The content of the melamine compound in the surface protection layer is within the range of from 0.1% by weight to 5% by weight.

compound 3

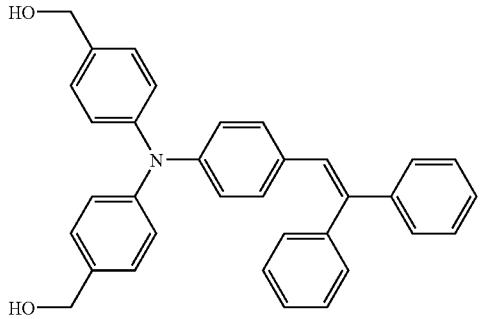

<Formation of Electrophotographic Photoreceptor 5>

Electrophotographic photoreceptor 5 is obtained in a similar manner to electrophotographic photoreceptor 1, except that the methylated melamine resin (trade name: NICALAC MW-30HM, manufactured by Sanwa Chemical Co., Ltd.) in the coating composition for surface protection layer coating liquid is changed to a benzoguanamine resin (trade name: NICALAC BL-60, manufactured by Sanwa Chemical Co., Ltd.). The content of the benzoguanamine compound in the surface protection layer is within the range of from 0.1% by weight to 5% by weight.

<Formation of Electrophotographic Photoreceptor 6>

Electrophotographic photoreceptor 6 is obtained in a similar manner to electrophotographic photoreceptor 5, except that the amount of the compound 2 in the coating composition for surface protection layer is changed to 9.5 parts by weight, and the amount of the benzoguanamine resin (trade name: NICALAC BL-60, manufactured by Sanwa Chemical Co., Ltd.) is changed to 0.5 parts by weight. The content of the benzoguanamine compound in the surface protection layer is within the range of from 0.1% by weight to 5% by weight.

<Formation of Electrophotographic Photoreceptor 7>

Electrophotographic photoreceptor 7 is obtained in a similar manner to electrophotographic photoreceptor 4, except that the amount of the compound 3 in the coating composition for surface protection layer is changed to 9.7 parts by weight, and the methylated melamine resin (trade name: NICALAC MW-30HM, manufactured by Sanwa Chemical Co., Ltd.) is changed to a benzoguanamine resin (trade name: NICALAC BL-60, manufactured by Sanwa Chemical Co., Ltd.) The content of the benzoguanamine compound in the surface protection layer is within the range of from 0.1% by weight to 5% by weight.

<Formation of Electrophotographic Photoreceptor 8>

Electrophotographic photoreceptor 8 is obtained in a similar manner to electrophotographic photoreceptor 1, except that the amount of the compound 2 in the coating composition for surface protection layer is changed to 8.5 parts by weight, and the amount of the methylated melamine resin (trade name: NICALAC MW-30HM, manufactured by Sanwa Chemical Co., Ltd.) is changed to 1.5 parts by weight. The content of the melamine compound in the surface protection layer is outside the range of from 0.1% by weight to 5% by weight.

<Formation of Electrophotographic Photoreceptor 9>

Electrophotographic photoreceptor 9 is obtained in a similar manner to electrophotographic photoreceptor 1, except that the amount of the compound 2 in the coating composition for surface protection layer is changed to 9.2 parts by weight, and the amount of the methylated melamine resin (trade name: NICALAC MW-30HM, manufactured by Sanwa Chemical Co., Ltd.) is changed to 0.8 parts by weight. The content of the melamine compound in the surface protection layer is outside the range of from 0.1% by weight to 5% by weight.

<Formation of Electrophotographic Photoreceptor 10>

Electrophotographic photoreceptor 10 is obtained in a similar manner to electrophotographic photoreceptor 3, except that the coating composition for surface protection layer is applied onto the charge transporting layer, and then the applied composition is dried at 170° C. for 45 minutes to form a surface protection layer. The content of the melamine compound in the surface protection layer is within the range of from 0.1% by weight to 5% by weight.

<Formation of Electrophotographic Photoreceptor 11>

Electrophotographic photoreceptor 11 is obtained in a similar manner to electrophotographic photoreceptor 3, except that the coating composition for surface protection layer is applied onto the charge transporting layer, and then the applied composition is dried at 140° C. for 45 minutes to form a surface protection layer. The content of the melamine compound in the surface protection layer is within the range of from 0.1% by weight to 5% by weight.

<Formation of Electrophotographic Photoreceptor 12>

Electrophotographic photoreceptor 12 is obtained in a similar manner to electrophotographic photoreceptor 1, except that the surface protection layer is formed in the following manner.

The following components are dissolved in 5 parts by weight of isopropyl alcohol, 3 parts by weight of tetrahydrofuran, and 0.3 parts by weight of distilled water. Then, 0.5 parts by weight of an ion exchange resin (trade name: AMBERLYST 15E) is added thereto, and the mixture is stirred at room temperature to conduct hydrolysis for 24 hours.

| | |
|---|---|
| Compound 4 having the following structure: | 2 parts by weight |
| Methyltrimethoxysilane: | 2 parts by weight |
| Tetramethoxysilane: | 0.5 parts by weight |
| Colloidal silica: | 0.3 parts by weight |

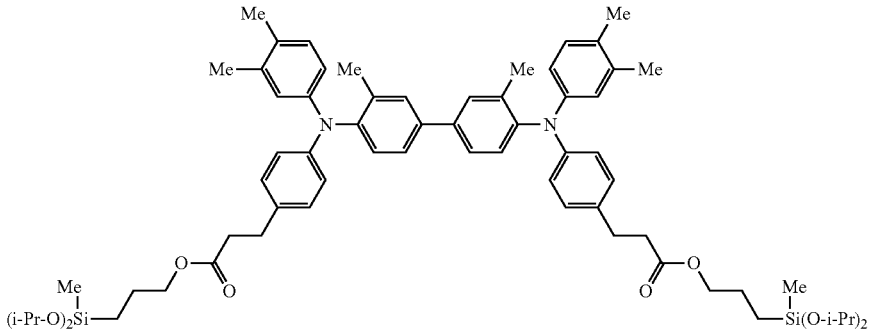

compound 4

After separating the ion exchange resin from the resultant, 0.1 parts by weight of aluminum triacetyl acetonate ($Al(aqaq)_3$) and 0.4 parts by weight of 3,5-di-t-butyl-4-hydroxytoluene (BHT) are added thereto. This is applied onto the charge transporting layer by ring-type dip coating, and is air-dried at room temperature for 30 minutes. Thereafter, the resultant is cured by performing a heat treatment at 170° C. for 1 hour, thereby obtaining a surface protection layer of 7 μm in thickness.

<Formation of Electrophotographic Photoreceptor 13>

Electrophotographic photoreceptor 13 is obtained in a similar manner to electrophotographic photoreceptor 1, except that the surface protection layer is not formed so that the charge transporting layer is positioned at the outermost surface.

<Formation of Electrophotographic Photoreceptor 14>

Electrophotographic photoreceptor 14 is obtained in a similar manner to electrophotographic photoreceptor 3, except that the surface protection layer is formed by applying the coating composition onto the charge transporting layer, and then drying the same at 160° C. for 45 minutes. The content by percentage of the melamine compound in the formed surface protection layer is within the range of from 0.1% by weight to 5% by weight.

Examples 1 to 9 and Comparative Examples 1 to 7

Image Formation Test

Image formation test is conducted using the electrophotographic photoreceptors 1 to 14 as prepared above.

A printing machine (trade name: DOCUCENTRE COLOR a450, manufactured by Fuji Xerox Co., Ltd.) is used in the test. The test is conducted in an environment of high temperature and high humidity (28° C. and 80% relative humidity), by forming 100,000 full-color images having an image density of 5%. The image is formed while moving an A4 sheet in a short-side direction. The velocity difference Δv (%) between the velocity of rotation of electrophotographic photoreceptor v1 in the testing machine and the velocity of rotation of intermediate transfer medium v2 is shown in Table 1.

The toner and the developer as prepared in the following manner is used for the image formation test and the evaluation thereof.

<Toner Particle Size Distribution>

A particle size distribution meter (trade name: MULTISIZER, manufactured by Nikkaki (transliterated) Co.) wherein the diameter of apertures is 100 μm is used to make a measurement.

<Average Shape Factor ($ML^2/A$) of Toner Particles>

Toner particles are observed with an optical microscope, and the circle-equivalent diameter of each toner particle is measured from the image thereof using an image analyzer (trade name: LUZEX III, manufactured by Nireco Corp.) Then, the value of shape factor $ML^2/A$ of each of 100 toner particles is calculated from the maximum length and the projected area thereof, in accordance with the following equation.

$$(ML^2/A)=(\text{maximum length})^2\times\pi\times100/[4\times(\text{projected area})] \quad (i)$$

The number-average value of thereof $ML^2/A$ is calculated from the values of 100 toner particles.

(Developer 1)

Production of Toner Mother Particles

<Preparation of Resin Particle Dispersed Liquid>

The following solution A and solution B are mixed and subjected to emulsification-polymerization in a flask. While slowly stirring the mixture for 10 minutes, 50 g of ion exchange water dissolving 4 g of ammonium persulfate therein is added thereto. The flask is purged with nitrogen. Thereafter, the mixture is heated while stirring in an oil bath to increase the temperature of the mixture to 70° C., and the emulsification-polymerization is continued at this temperature for 5 hours. As a result, a resin particle dispersion, in which resin particles having an average particle size of 150 nm, a glass transition temperature (Tg) of 58° C. and a weight-average molecular weight (Mw) of 11,500 are dispersed, is obtained. The solid content concentration of this dispersion is 40% by weight.

Solution A: a mixture of 370 g of styrene, 30 g of n-butyl acrylate, 8 g of acrylic acid, 24 g of dodecanethiol, and 4 g of carbon tetrabromide.

Solution B: a mixture of 6 g of a nonionic surfactant (trade name: NONIPOL 400, manufactured by Sanyo Chemical Industries, Ltd.) and 10 g of an anionic surfactant (trade name: NEOGEN SC, manufactured by Dai-ichi Kogyo Seiyaku Co., Ltd.) dissolved in 550 g of ion exchange water.

<Preparation of Colorant Dispersion 1>

60 g of carbon black (trade name: MOGUL L, manufactured by Cabot Corp.), 6 g of a nonionic surfactant (trade name: NONIPOL 400, manufactured by Sanyo Chemical Industries, Ltd.), and 240 g of ion exchange water are mixed and dispersed using a homogenizer (trade name: ULTRA TURRAX T50, manufactured by IKA Japan K.K.) for 10 minutes. Thereafter, the resultant is further dispersed using an ultimizer, thereby preparing a colorant dispersion liquid 1 in which particles of the colorant (carbon black) having an average particle size of 250 nm are dispersed.

<Preparation of Release Agent Dispersion>

100 g of a paraffin wax (trade name: HNP 0190, manufactured by Nippon Seiro Co., Ltd., melting point: 85° C.), 5 g of a cationic surfactant (trade name: SANIZOL B50, manufactured by Kao Corp.), and 240 g of ion exchange water are mixed and dispersed using a homogenizer (trade name: ULTRA TURRAX T50, manufactured by IKA Japan, K.K.) in a round flask made of stainless steel for 10 minutes. Thereafter, the resultant is further dispersed using a pressure expelling type homogenizer, thereby preparing a release agent dispersion in which particles of a release agent having an average particle size of 550 nm are dispersed.

<Preparation of Toner Mother Particles K1>

234 parts by weight of the resin particle dispersion, 30 parts by weight of the colorant dispersion 1, 40 parts by weight of the release agent dispersion, 0.5 parts by weight of polyaluminum hydroxide (trade name: PAHO 2S, manufactured by Asada Chemical Industry Co., Ltd.), and 600 parts by weight of ion exchange water are placed in a round flask made of stainless steel, and the content is dispersed using a homogenizer (trade name: ULTRA TURRAX T50, manufactured by IKA Japan, K.K.). Thereafter, the mixture is heated in an oil bath while stirring, and is maintained at 40° C. for 30 minutes. At this time, it is confirmed that aggregated particles ($D_{50}$: 4.5 μm) are formed in the mixture. Further, the temperature of the oil bath is increased and maintained at 56° C. for 1 hour. As a result, the value of $D_{50}$ is decreased to 5.3 μm. To this liquid dispersion containing the aggregate particles, 26 parts by weight of the resin particle dispersion are further added, and the mixture is maintained at 50° C. using the oil bath for 30 minutes. After adding 1N sodium hydroxide to adjust the pH of this dispersion containing the aggregate particles to 7.0, the flask is sealed and stirred using a magnetic stirrer while heating, and maintained at 80° C. for 4 hours. The liquid dispersion is cooled, and toner mother particles generated in the liquid dispersion are collected by filtration. The particles are washed with ion exchange water four times, and then freeze-dried to yield toner mother particles K1. The $D_{50}$ of the toner mother particles K1 is 5.9 μm, and the average shape factor $ML^2/A$ is 132.

<Production of Carrier>

14 parts by weight of toluene, 2 parts by weight of a styrene/methacrylate copolymer (component ratio: 90/10), and 0.2 parts by weight of carbon black (trade name: R330, manufactured by Cabot Corp.) are mixed and dispersed by stirring with a stirrer for 10 minutes to prepare a coating solution. This coating solution and 100 parts by weight of ferrite particles (average particle size: 50 μm) are placed in a vacuum degassing type kneader, and are stirred at 60° C. for 30 minutes. Thereafter, the mixture is dried by further heating and degassing by reducing pressure, thereby preparing a carrier. This carrier has a volume specific resistivity of $10^{11}$ Ωcm when an electric field of 1,000 V/cm is applied thereto.

<Preparation of a Toner 1 and a Developing Agent 1>

100 parts by weight of the toner mother particles K1, 1 part by weight of rutile-type titanium oxide (treated with n-decyltrimethoxysilane, particle size: 20 nm), 2.0 parts by weight of silica (prepared by a vapor-phase oxidization method and treated with silicone oil, particle size: 40 nm), 1 part by weight of cerium oxide (average particle size: 0.7 μm), and 0.3 parts by weight of a higher fatty acid alcohol (obtained by pulverizing a higher fatty acid alcohol having a molecular weight of 700 using a jet mill, average particle size: 8.0 μm) are mixed using a 5L Henschel mixer at a circumferential rate of 30 m/s for 15 minutes.

Thereafter, a sieve having a mesh size of 45 μm is used to remove coarse particles from the blend, thereby preparing a toner 1 (black). 100 parts by weight of the carrier and 5 parts by weight of the toner 1 are mixed and stirred using a V-blender at 40 rpm for 20 minutes, and the resultant is sieved with a sieve having a mesh size of 212 μm, thereby obtaining a developer 1 (black).

Table 1 shows the serial number of the electrophotographic photoreceptors used in the Examples and the Comparative Examples, as well as the universal hardness and the creep ratio of the electrophotographic photoreceptors. The universal hardness and the creep ratio are measured in accordance with the aforementioned methods.

TABLE 1

| | Electrophotographic Photoreceptor No. | Universal hardness ($N/mm^2$) | Creep ratio (%) | Velocity difference Δv (%) |
|---|---|---|---|---|
| Example 1 | 1 | 195 | 5.9 | 2.8 |
| Example 2 | 2 | 189 | 6.4 | 1.5 |
| Example 3 | 3 | 198 | 5.5 | 3 |
| Example 4 | 4 | 180 | 7.8 | 3 |
| Example 5 | 5 | 181 | 7.4 | 4.8 |
| Example 6 | 6 | 188 | 5.8 | 3 |
| Example 7 | 1 | 195 | 5.9 | 1 |
| Example 8 | 1 | 195 | 5.9 | 5.5 |
| Example 9 | 14 | 216 | 5.1 | 3 |
| Com. Example 1 | 7 | 175 | 7.7 | 3 |
| Comp. Example 2 | 8 | 223 | 4.5 | 3 |
| Comp. Example 3 | 9 | 210 | 4.8 | 3 |
| Comp. Example 4 | 10 | 225 | 4.5 | 3 |
| Comp. Example 5 | 11 | 185 | 8.5 | 3 |
| Comp. Example 6 | 12 | 230 | 7.9 | 3 |
| Comp. Example 7 | 13 | 198 | 6.1 | 3 |

<Evaluation>

The amount of attrition of the electrophotographic photoreceptor, resistance to filming, and resistance to the passing of toner and ghosting of the electrophotographic photoreceptor are evaluated during the image formation test, or after conducting the same.

(Evaluation of Amount of Attrition)

The amount of attrition of the electrophotographic photoreceptor is obtained by measuring the difference in the thickness of the surface protection layer before and after the 10,000-sheet image forming test, and the attrition rate per 1,000 sheets is calculated therefrom (nm/1,000-sheets). The amount of attrition is obtained at both the image area and the non-image area. The attrition rate is calculated at an imaged portion and a non-imaged portion of the electrophotographic photoreceptor, and the difference between them is also calculated. The results are shown in Table 2.

(Evaluation of Filming Resistance)

The filming resistance of the electrophotographic photoreceptor is evaluated by observing the surface of the electrophotographic photoreceptor after conducting the image formation test (after the formation of 100,000 images) with naked eye, according to the following criteria. The results are shown in Table 2.

A: good

B: a slight degree of filming is partially observed (about 10% or less of the whole area), but is considered to be a tolerable level for practical applications.

C: a filming that affects image quality and causes problems in practical applications is observed.

(Evaluation of Ghost Resistance)

Figure 7:
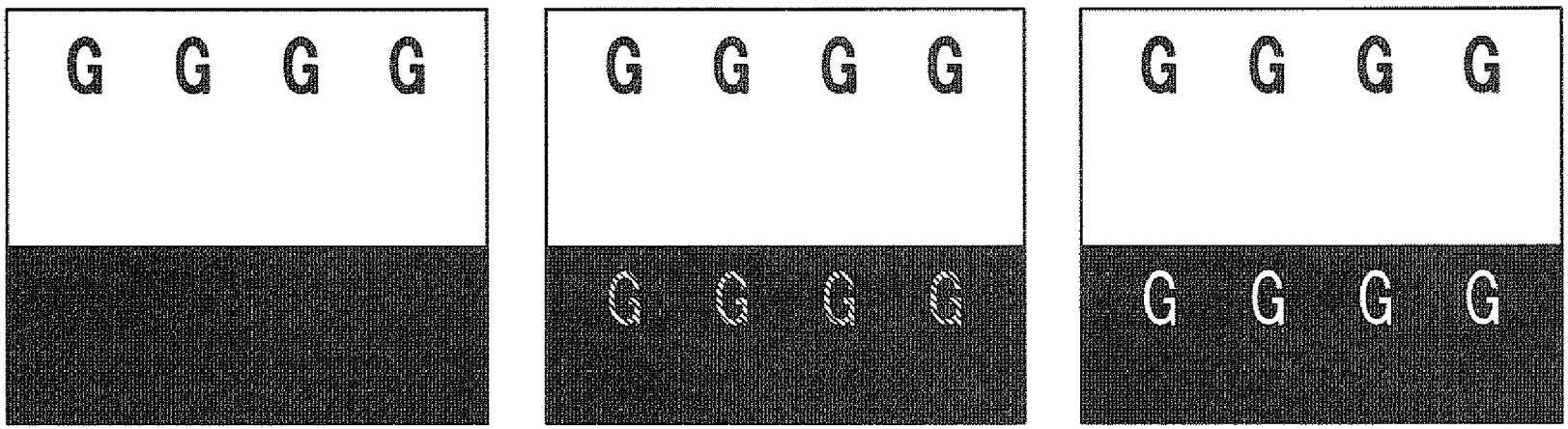
FIG. 7 is an explanatory view showing a benchmark for the evaluation of ghosting.

After conducting the image formation test (after the formation of 100,000 images), a chart having a pattern with characters of G and a black region as shown in FIG. 7A is printed, and the appearance of G with respect to the black region is evaluated with naked eye, according to the following criteria.

A: No ghosting or only a slight degree of the same is observed, as shown in FIG. 7A.

B: Recognizable ghosting is observed, as shown in FIG. 7B.

C: Distinct ghosting is observed, as shown in FIG. 7C.

(Evaluation of Passing of Toner)

After conducting the image formation test (after the formation of 100,000 images), a toner image having an image density (Cin) of 100% is formed on a portion that corresponds to the A3 sheet of the electrophotographic photoreceptor. Without transferring this toner image, the electrophotographic photoreceptor is rotated to move to the cleaning unit. The photoreceptor surface is then cleaned. After the cleaning, a piece of cellophane tape is attached to the surface of the electrophotographic photoreceptor, and is then peeled off. The piece of cellophane tape after being peeled off is attached to a piece of white paper, and the degree of the passing of toner is observed, according to the following criteria.

A: passing of toner is not observed.

B: passing of toner is observed at some portions (about 10% or less of the whole area).

C: passing of toner is observed over a wide area.

On the basis of the above evaluation results, the electrophotographic photoreceptor is evaluated in a comprehensive manner, according to the following criteria.

A: good

B: inferior to grade A, but is tolerable level

C: not tolerable for practical applications

TABLE 2

| | | Amount of attrition | | | Image quality | | | |
|---|---|---|---|---|---|---|---|---|
| | Photoreceptor No. | Imaged portion (nm/1000-sheets) | Non-imaged portion (nm/1000-sheets) | Difference in Attrition ratio | Filming | Ghosting | Passing of toner | Comprehensive evaluation |
| Ex. 1 | 1 | 3.7 | 2.8 | 0.9 | A | A | A | A |
| Ex. 2 | 2 | 3.8 | 2.9 | 0.9 | A | A | A | A |
| Ex. 3 | 3 | 3.3 | 2.6 | 0.7 | A | A | A | A |
| Ex. 4 | 4 | 3.1 | 2.6 | 0.5 | A | A | B | B |
| Ex. 5 | 5 | 3.8 | 2.9 | 0.9 | A | A | B | B |
| Ex. 6 | 6 | 3.8 | 3.3 | 0.5 | A | A | A | A |
| Ex. 7 | 1 | 3.2 | 2.6 | 0.6 | B | A | A | B |
| Ex. 8 | 1 | 3.9 | 3.3 | 0.6 | A | A | B | B |
| Ex. 9 | 14 | 2.9 | 2.3 | 0.6 | A | B | A | B |
| Comp. Ex. 1 | 7 | 4.2 | 2.9 | 1.3 | A | A | C | C |
| Comp. Ex. 2 | 8 | 2.5 | 2.0 | 0.5 | C | C | C | C |
| Comp. Ex. 3 | 9 | 3.8 | 2.5 | 1.3 | B | C | C | C |
| Comp. Ex. 4 | 10 | 2.3 | 1.8 | 0.5 | C | B | B | C |
| Comp. Ex. 5 | 11 | 7.0 | 4.2 | 2.8 | A | A | B | C |
| Comp. Ex. 6 | 12 | 1.3 | 1.2 | 0.1 | C | A | C | C |
| Comp. Ex. 7 | 13 | 29.0 | 22.0 | 7.0 | A | A | A | C |

As is evident from Table 2, occurrence of filming or passing of toner can be suppressed when the electrophotographic photoreceptor having a surface protection layer that satisfies each of the requirements (1) to (3) (for example, electrophotographic photoreceptor 1) are used in an image forming apparatus that operates at a velocity difference Δv in the range of from 1.5% to 5%, as compared with the case in which the electrophotographic photoreceptor according to the invention is not used in the image forming apparatus.

All publications, patent applications, and technical standards mentioned in this specification are herein incorporated by reference to the same extent as if each individual publication, patent application, or technical standard was specifically and individually indicated to be incorporated by reference.

What is claimed is:

1. An electrophotographic photoreceptor comprising, over an electroconductive substrate, a photosensitive layer and a surface protection layer in this order, the surface protection layer satisfying each of the following requirements (1) to (3):

(1) comprising a crosslinked substance of at least one selected from a compound having a guanamine structure or a compound having a melamine structure, and at least one charge transporting material having at least one substituent selected from —OH —$OCH_3$, —$NH_2$, —SH or —COOH;

(2) comprising the at least one selected from a compound having a guanamine structure or a compound having a melamine structure in an amount of from about 0.1% by weight to about 5% by weight; and (3) having a universal hardness of from about 180 N/$mm^2$ to about 220 N/$mm^2$ and a creep ratio of from 5.1% to about 8%, the universal hardness and the creep ratio being obtained by performing a hardness test by pushing a Vickers quadrangular pyramid diamond indenter against the surface protection layer at a maximum load of 20 mN, in an environment of 25° C. and a relative humidity of 50%.

2. The electroconductive photoreceptor according to claim 1, wherein the charge transporting material comprises a compound represented by the following formula (I):

$$F—((—R^{11}—X)_{n1}(R^{12})_{n2}—Y)_{n3} \quad (I)$$

wherein, in formula (I), F represents an organic group derived from a compound having a hole transporting capability, each of $R^{11}$ and $R^{12}$ independently represent a linear or branched alkylene group having 1 to 5 carbon atoms, n1 represents 0 or 1, n2 represents 0 or 1, n3 represents an integer of 1 to 4, X represents an oxygen atom, NH, or a sulfur atom, and Y represents —OH, $OCH_3$, —$NH_2$, —SH or —COOH.

3. The electroconductive photoreceptor according to claim 1, wherein the charge transporting material comprises a compound represented by the following formula (II):

(II)

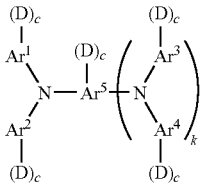

wherein, in formula (II), $Ar^1$ to $Ar^4$ each independently represent a substituted or unsubstituted aryl group; $Ar^5$ represents a substituted or unsubstituted aryl group or a substituted or unsubstituted arylene group; each D independently represents —(—$R^{11}$—X)$_{n1}$($R^{12}$)$_{n2}$—Y, wherein $R^{11}$ and $R^{12}$ each independently represent a linear or branched alkylene group having 1 to 5 carbon atoms, n1 represents 0 or 1, n2 represents 0 or 1, X represents an oxygen atom, NH or a sulfur atom, and Y represents —OH, —$OCH_3$, —$NH_2$, —SH or —COOH; each c independently represents 0 or 1; k represents 0 or 1; and the total number of Ds is from 1 to 4.

4. The electroconductive photoreceptor according to claim 1, wherein the surface protection layer has a universal hardness of from about 1.80 N/mm$^2$ to about 200 N/mm$^2$.

5. The electroconductive photoreceptor according to claim 1, wherein the surface protection layer has a creep ratio of from 5.1% to about 7%.

6. The electroconductive photoreceptor according to claim 1, wherein the surface protection layer has a creep ratio of from about 5.5% to about 7%.

7. The electrophotographic photoreceptor according to claim 1, wherein a solid content concentration of the at least one charge transporting material in the surface protection layer is 80% or more by weight.

8. A process cartridge comprising an electrophotographic photoreceptor and at least one selected from the group consisting of a charging unit that charges the electrophotographic photoreceptor, a toner image forming unit that forms a toner image by developing, with a toner, an electrostatic latent image formed on the electrostatic photoreceptor, and a toner removal unit that removes toner remaining on the surface of the electrophotographic photoreceptor, the electrophotographic photoreceptor comprising, over an electroconductive substrate, a photosensitive layer and a surface protection layer in this order, the surface protection layer satisfying each of the following requirements (1) to (3):

(1) comprising a crosslinked substance of at least one selected from a compound having a guanamine structure or a compound having a melamine structure, and at least one charge transporting material having at least one substituent selected from —OH, $OCH_3$, —$NH_2$, —SH or —COOH;

(2) comprising the at least one selected from a compound having a guanamine structure or a compound having a melamine structure in an amount of from about 0.1% by weight to about 5% by weight; and (3) having a universal hardness of from about 180 N/mm$^2$ to about 220 N/mm$^2$ and a creep ratio of from 5.1% to about 8%, the universal hardness and the creep ratio being obtained by performing a hardness test by pushing a Vickers quadrangular pyramid diamond indenter against the surface protection layer at a maximum load of 20 mN, in an environment of 25° C. and a relative humidity of 50%.

9. The process cartridge according to claim 8, wherein the surface protection layer has a universal hardness of from about 180 N/mm$^2$ to about 200 N/mm$^2$.

10. The process cartridge according to claim 8, wherein the surface protection layer has a creep ratio of from 5.1% to about 7%.

11. The process cartridge according to claim 8, wherein the surface protection layer has a creep ratio of from about 5.5% to about 7%.

12. An image forming apparatus comprising:

an electrophotographic photoreceptor;

a charging unit that charges the electrophotographic photoreceptor;

an electrostatic latent image forming unit that forms an electrostatic latent image on the electrophotographic photoreceptor by exposing the charged electrophotographic photoreceptor to light;

a toner image forming unit that forms a toner image by developing, with a toner, the electrostatic latent image formed on the electrostatic photoreceptor;

a first transfer unit that transfers the toner image from the electrophotographic photoreceptor to an intermediate transfer medium;

a second transfer unit that transfers the toner image from the intermediate transfer medium to an image receiving medium;

and a toner removal unit that removes toner remaining on the surface of the electrophotographic photoreceptor, the electrophotographic photoreceptor comprising, over an electroconductive substrate, a photosensitive layer and a surface protection layer in this order, the surface protection layer satisfying each of the following requirements (1) to (3):

(1) comprising a crosslinked substance of at least one selected from a compound having a guanamine structure or a compound having a melamine structure, and at least one charge transporting material having at least one substituent selected from —OH, $OCH_3$, —$NH_2$, —SH or —COOH;

(2) comprising the at least one selected from a compound having a guanamine structure or a compound having a melamine structure in an amount of from about 0.1% by weight to about 5% by weight; and (3) having a universal hardness of from about 180 N/mm$^2$ to about 220 N/mm$^2$ and a creep ratio of from 5.1% to about 8%, the universal hardness and the creep ratio being obtained by performing a hardness test by pushing a Vickers quadrangular pyramid diamond indenter against the surface protection layer at a maximum load of 20 mN, in an environment of 25° C. and a relative humidity of 50%.

13. The image forming apparatus according to claim 12, wherein a velocity difference Δv represented by the following expression (a) is from about 1.5% to about 5%:

$$\Delta v = |v2 - v1| v1 \times 100 \quad (a)$$

wherein, in expression (a), v1 (mm/s) represents the velocity of rotation of the electrophotographic photoreceptor, and v2 (mm/s) represents the velocity of rotation of the intermediate transfer medium.

14. The image forming apparatus according to claim 13, wherein the velocity difference Δv is from about 2% to 4%.

15. The image forming apparatus according to claim 12, wherein a solid content concentration of the at least one charge transporting material in the surface protection layer is 80% or more by weight.

* * * * *